US007416286B2

(12) United States Patent
Murata

(10) Patent No.: US 7,416,286 B2
(45) Date of Patent: Aug. 26, 2008

(54) INKJET RECORDING HEAD AND INKJET RECORDING DEVICE

(75) Inventor: Michiaki Murata, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 364 days.

(21) Appl. No.: 11/066,369

(22) Filed: Feb. 25, 2005

(65) Prior Publication Data

US 2005/0285903 A1 Dec. 29, 2005

(30) Foreign Application Priority Data

Jun. 29, 2004 (JP) ..... 2004-191971
Jun. 29, 2004 (JP) ..... 2004-191972
Jun. 29, 2004 (JP) ..... 2004-191973
Dec. 15, 2004 (JP) ..... 2004-363253

(51) Int. Cl.
*B41J 2/05* (2006.01)
*B41J 2/045* (2006.01)

(52) U.S. Cl. ..... 347/58; 347/70; 347/71

(58) Field of Classification Search ..... 347/58, 347/68, 70–72
See application file for complete search history.

(56) References Cited

U.S. PATENT DOCUMENTS 6,345,887 B1 * 2/2002 Sato ..... 347/72
6,533,402 B2 * 3/2003 Miyata ..... 347/68
2003/0081080 A1 * 5/2003 Moriya et al. ..... 347/68

FOREIGN PATENT DOCUMENTS

JP 2-301445 12/1990
JP 9-323414 12/1997
JP 10193621 A * 7/1998

* cited by examiner

*Primary Examiner*—Matthew Luu
*Assistant Examiner*—Lisa M Solomon
(74) *Attorney, Agent, or Firm*—Fildes & Outland, P.C.

(57) ABSTRACT

An inkjet recording head having: a nozzle ejecting ink drops; a pressure chamber which communicates with the nozzle and in which ink is filled; a vibrating plate structuring a portion of the pressure chamber; an ink pooling chamber pooling ink to be supplied to the pressure chamber via an ink flow path; and a piezoelectric element displacing the vibrating plate. The ink pooling chamber is provided at a side of the vibrating plate opposite the side at which the pressure chamber is provided. A driving IC, which applies voltage to the piezoelectric element, is mounted on a piezoelectric element substrate which is formed so as to include the vibrating plate. Accordingly, there is provided the inkjet recording head which realizes a higher density of nozzles and an accompanying formation of wires at a fine pitch to realize higher resolution, and which can be compact.

20 Claims, 51 Drawing Sheets

UP
LO

UP
LO

UP
LO

UP
LO

INKJET RECORDING HEAD AND INKJET RECORDING DEVICE

CROSS-REFERENCE TO RELATED APPLICATION

This application claims priority under 35 USC 119 from Japanese Patent Application Nos. 2004-191971, 2004-191972, 2004-191973 and 2004-363253, the disclosures of which are incorporated by reference herein.

BACKGROUND OF THE INVENTION

1. Field of the Invention

The present invention relates to an inkjet recording head which has a nozzle which ejects ink drops, a pressure chamber which communicates with the nozzle and in which ink is filled, a vibrating plate structuring a portion of the pressure chamber, an ink pooling chamber which pools ink to be supplied to the pressure chamber via an ink flow path, and a piezoelectric element which displaces the vibrating plate, and to an inkjet recording device equipped with this inkjet recording head.

2. Description of the Related Art

There have conventionally been known inkjet recording devices in which characters, images or the like are printed onto a recording medium such as a recording sheet or the like which is conveyed-in along a subscanning direction, by ejecting (expelling) ink drops selectively from plural nozzles of an inkjet recording head (hereinafter, simply called "recording head" upon occasion) which moves reciprocatingly in a main scanning direction.

Such an inkjet recording device has piezoelectric system recording heads, thermal system recording heads, or the like. For example, in the case of a piezoelectric system recording head, as shown in FIGS. 32 and 33, a piezoelectric element (an actuator which converts electrical energy into mechanical energy) 206 is provided at a pressure chamber 204 to which ink 200 is supplied from an ink tank via an ink pooling chamber 202. The piezoelectric element 206 flexurally deforms in a concave form so as to reduce the volume of the pressure chamber 204, thereby applying pressure to the ink 200 therein and ejecting the ink 200 as an ink drop 200A from a nozzle 208 which communicates with the pressure chamber 204.

In recent years, the ability to achieve high resolution printing while keeping the inkjet recording head low-cost and compact has come to be demanded of inkjet recording heads structured in this way. In order to address such demands, nozzles must be disposed at a high density. However, in current recording heads, as illustrated, because the ink pooling chamber 202 is provided next to the nozzles 208 (between the nozzle 208 and the nozzle 208), there are limits to placing the nozzles 208 at a high density.

Further, the inkjet recording head is provided with driving ICs for applying voltage to predetermined piezoelectric elements. Conventionally, as shown in FIGS. 34A and 34B, the driving ICs are mounted at an FPC (flexible printed circuit board) 210. Namely, connection is carried out by joining bumps 212, which are formed on the FPC 210, to the metal electrode surfaces of the piezoelectric elements 206 which are the top surfaces thereof. Because the driving ICs (not shown) are mounted at the FPC 210, the piezoelectric elements 206 and the driving ICs are electrically connected at this stage.

There is a method of connecting electrode terminals, which are provided at the external surface of the recording head, and electrode terminals, which are on the mounting substrate at which the driving ICs are mounted, by a wire bonding method (see, for example, Japanese Patent Application Laid-Open (JP-A) No. 2-301445). Further, there is a method in which, after joining and connecting the driving ICs to the electrode terminals provided at the external surface of the recording head, connection is carried out by joining an FPC to the electrode terminals of the lead wires provided at the recording head (see, for example, JP-A No. 9-323414).

In either case, wires having a fine pitch (e.g., a pitch of 10 μm or less) cannot be formed. Therefore, if the nozzle density becomes high, problems arise such as the sizes of the mounting substrate and the FPC become large, there are impediments to making the inkjet recording head compact, and costs increase. In addition, if the nozzle density becomes high, there is the problem that wires having desired resistance values cannot be led-around. Namely, there are limits to increase the density of the nozzles, which limits are due to the limitations on the density of the wires.

SUMMARY OF THE INVENTION

The present invention has been made in view of the above circumstances and has an object to overcome the above problems and to provide an inkjet recording head in which it is possible to realize a higher density of nozzles and the accompanying formation of wires at a fine pitch such that higher resolution can be achieved, and which can be made more compact, and to provide an inkjet recording device equipped with this inkjet recording head.

In order to achieve the above object, an inkjet recording head of a first aspect of the present invention has: a nozzle ejecting ink drops; a pressure chamber which communicates with the nozzle and in which ink is filled; a vibrating plate structuring a portion of the pressure chamber; an ink pooling chamber pooling ink to be supplied to the pressure chamber via an ink flow path; a piezoelectric element displacing the vibrating plate; a driving IC applying voltage to the piezoelectric element; a wire supplying a signal to the driving IC; and a top plate member at which the wire is provided, wherein the ink pooling chamber is provided at a side of the vibrating plate opposite the side at which the pressure chamber is provided, and the driving IC is mounted on a piezoelectric element substrate which is formed so as to include the vibrating plate, and the ink pooling chamber includes a capping member, which is provided separately from the top plate member and which is a cap of the ink pooling chamber, and a partitioning wall member, which is formed of resin and is a partitioning wall of the ink pooling chamber.

In the first aspect of the present invention, because pressure chambers can be disposed adjacent to one another, the nozzles, which are provided at the respective pressure chambers, can be disposed at a high density. Further, by using a photolithographic technique of a semiconductor process in forming the metal wires which are led-out from the piezoelectric elements, fine wires of a pitch of 10 μm or less can be formed. Further, connecting the wires to the driving ICs in vicinities of the piezoelectric elements allows the lengths of the wires to be shortened (can contribute to a lowering of the resistances of the wires). Namely, in accordance with these structures, it is possible to accommodate a higher density of the nozzles, with practical, low resistance values of the wires. Accordingly, higher resolution can be realized.

Further, in the first aspect of the present invention, the ink pooling chamber is structured by the capping member and the resin partitioning wall which is formed of resin. Further, because the top plate member, which structures the top plate of the inkjet recording head, is provided separately from the capping member, the top plate member and the capping member can be manufactured easily. The structure and materials of the top plate member which satisfy the requisite properties, characteristics, and the like can be selected, without being affected by the capping member.

For example, if the capping member is formed of glass (a second aspect), the ink sealing ability of the ink pooling chamber can be maintained good.

Further, if the capping member is formed of resin (a third aspect), the ink pooling chamber can be structured inexpensively.

Even if the capping member and the partitioning wall member are an integrally-molded resin member (a fourth aspect), the ink pooling chamber can be manufactured inexpensively.

In any of the first through fourth aspects, when an air damper, which mitigates pressure waves of the ink pooling chamber, is provided at the capping member (a fifth aspect), the pressure waves of the ink pooling chamber can be mitigated, and the occurrence of problems caused by these pressure waves can be suppressed.

Any of the first through fifth aspects can be structured such that a bump for connection to the piezoelectric element substrate is provided at the top plate member (a sixth aspect).

A seventh aspect of the present invention has the feature that, in any of the first through sixth aspects, an ink supplying port for supplying ink into the ink pooling chamber is provided at the capping member.

By providing an ink supplying port at the capping member in this way, ink can be supplied without providing a new member for supplying ink into the ink pooling chamber. In this structure, if an insert-through hole, through which the ink supplying port is inserted, is formed in the top plate member (an eighth aspect), ink can be supplied to the ink pooling chamber even if there is a top plate member.

A ninth aspect of the present invention has the feature that, in any of the first through eighth aspects, the nozzles are disposed in a form of a matrix.

In the ninth aspect of the present invention, the nozzles can be disposed in the form of a high-density matrix. Accordingly, higher resolution can be realized.

A tenth aspect of the present invention has the feature that, in any of the first through ninth aspects, the driving IC is surface-mounted on the piezoelectric element substrate.

In accordance with the tenth aspect of the present invention, high-density electrical connection can be achieved easily, and it is thereby possible to make the recording head more compact. Note that the driving IC has connection terminals which are arranged two-dimensionally, in order to handle high-density electrical connection. The mounting is, for example, Ball Grid Array (BGA) mounting or flip-chip mounting. Either of these methods may be selected in accordance with the required connection terminal pitch. However, in the case of the present invention, flip-chip mounting is most suitable from the standpoint that the driving IC can be made to be thin, and from the standpoint that it is possible to form connection terminals at a pitch of an even higher density.

An eleventh aspect of the present invention has the feature that, in any of the first through tenth aspects, the driving IC is disposed between the vibrating plate and the top plate member.

In the eleventh aspect of the present invention, the driving IC is disposed between the vibrating plate and the top plate of the ink pooling chamber. In this way, as compared with a case in which the driving IC is mounted at the exterior of the recording head, the length of the wire between the piezoelectric element and the driving IC can be made shorter, and accordingly, the wire resistance can be lowered. This can therefore be a structure which is suited to increasing the density of the nozzles. Further, because the driving IC is incorporated within the recording head, it is possible to make the recording head more compact.

A twelfth aspect of the present invention has the feature that, in any of the first through eleventh aspects, a resin material is filled in a gap of a space where the driving IC is disposed, between the vibrating plate and the top plate member.

In the twelfth aspect, the bond strength between the top plate and the piezoelectric element substrate is increased. Further, because the driving IC is sealed by a resin material, the driving IC can be protected from the external environment, such as moisture and the like.

A thirteenth aspect of the present invention has the feature that, in any of the first through twelfth aspects, a wire connecting the piezoelectric element and the driving IC is covered by a resin material.

In the thirteenth aspect of the present invention, corrosion of the wire due to ink can be prevented.

A fourteenth aspect of the present invention has the feature that, in the thirteenth aspect, the wire is covered by being sandwiched by two resin layers whose coefficients of thermal expansion are substantially equivalent.

In the fourteenth aspect of the present invention, there is little generation of thermal stress.

A fifteenth aspect of the present invention is an inkjet recording device provided with the inkjet recording head of any of the first through fourteenth aspects.

The inkjet recording device of the fifteenth aspect of the present invention can accommodate a higher nozzle density, and can realize a higher resolution.

As described above, in any of these cases, the present invention can provide an inkjet recording head in which it is possible to realize a higher density of nozzles and the accompanying formation of wires at a fine pitch such that higher resolution can be achieved, and which can be made more compact.

BRIEF DESCRIPTION OF THE DRAWINGS

Preferred embodiments of the present invention will be described in detail based on the following figures, wherein.

DETAILED DESCRIPTION OF THE INVENTION

Figure 1:
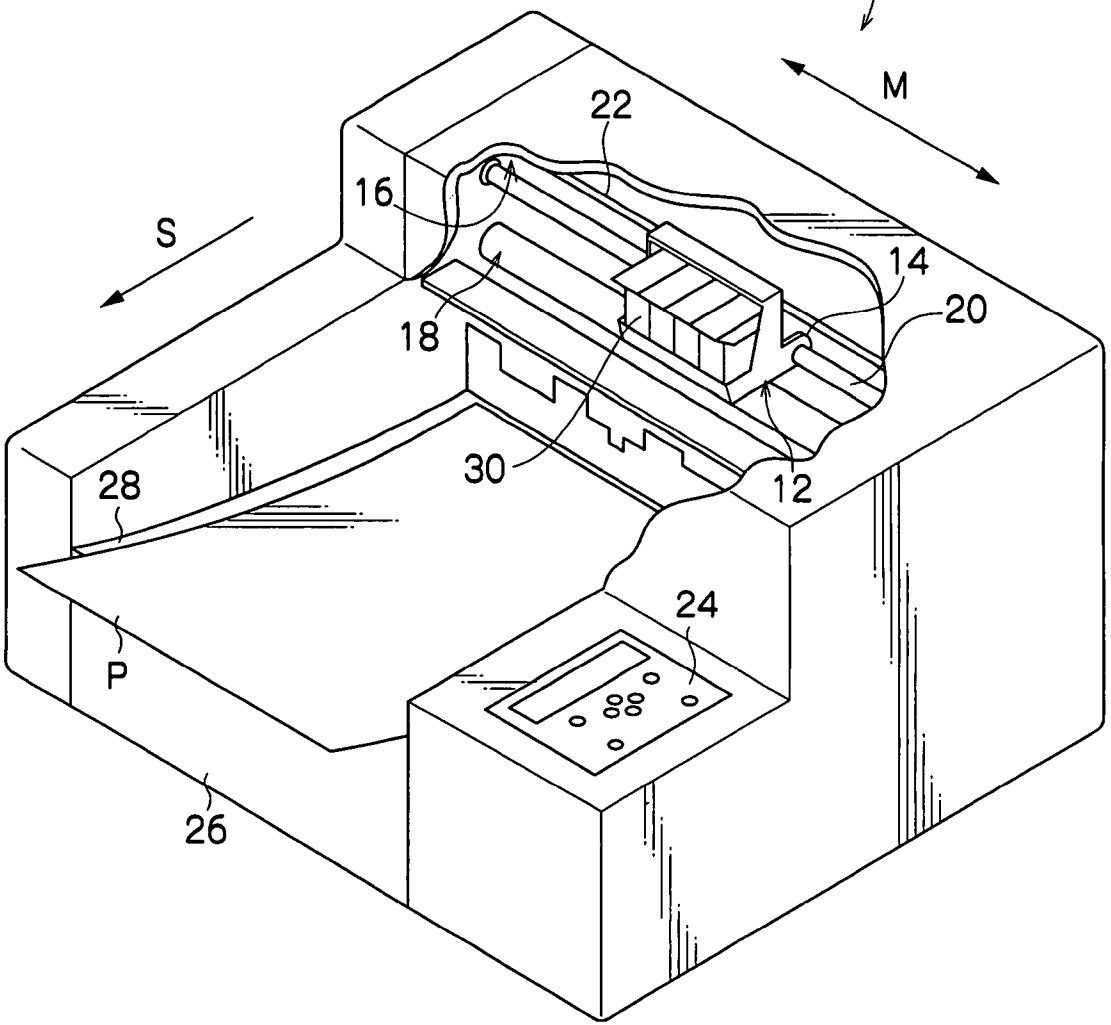
FIG. 1 is a schematic perspective view of an inkjet recording device of the present invention.

Hereinafter, embodiments of the present invention will be described in detail on the basis of the drawings. Explanation will be given in which a recording sheet P is used as a recording medium. The conveying direction of the recording sheet P in an inkjet recording device 10 is the subscanning direction and is denoted by arrow S, and the direction orthogonal to this conveying direction is the main scanning direction and is denoted by arrow M. Further, in the drawings, when arrow UP and arrow LO are shown, they express the upward direction and the downward direction, respectively, and when up and down are to be expressed, they correspond to these arrows, respectively.

First, a summary of the inkjet recording device 10 will be described. As shown in FIG. 1, the inkjet recording device 10 has a carriage 12 in which are installed inkjet recording units 30 (inkjet recording heads 32) of black, yellow, magenta and cyan. A pair of brackets 14 project from the side of the carriage 12 which is the upstream side in the conveying direction of the recording sheet P. Open holes 14A which are round (see FIG. 2) are formed in the brackets 14. A shaft 20, which spans in the main scanning direction, is inserted through the open holes 14A.

A driving pulley (not shown) and a driven pulley (not shown), which structure a main scanning mechanism 16, are disposed at the both ends in the main scanning direction. A portion of a timing belt 22, which is trained around the driving pulley and the driven pulley and which travels in the main scanning direction, is fixed to the carriage 12. Accordingly, the carriage 12 is supported so as to be able to move reciprocatingly in the main scanning direction.

A sheet feed tray 26, in which the recording sheets P before image printing are placed in a bundle, is provided at the inkjet recording device 10. A sheet discharge tray 28 is provided above the sheet feed tray 26. The recording sheets P, on which images have been printed by the inkjet recording heads 32, are discharged out onto the sheet discharge tray 28. Also provided is a subscanning mechanism 18 formed from a discharging roller and a conveying roller which conveys the recording sheets P, which are fed-out one-by-one from the sheet feed tray 26, at a predetermined pitch in the subscanning direction.

In addition, a control panel 24 for carrying out various types of settings at the time of printing, a maintenance station (not shown), and the like are provided at the inkjet recording device 10. The maintenance station is structured so as to include a capping member, a suction pump, a dummy jet receptacle, a cleaning mechanism, and the like, and carries out maintenance operations such as suctioning and recovering, dummy jetting, cleaning, and the like.

Figure 2:
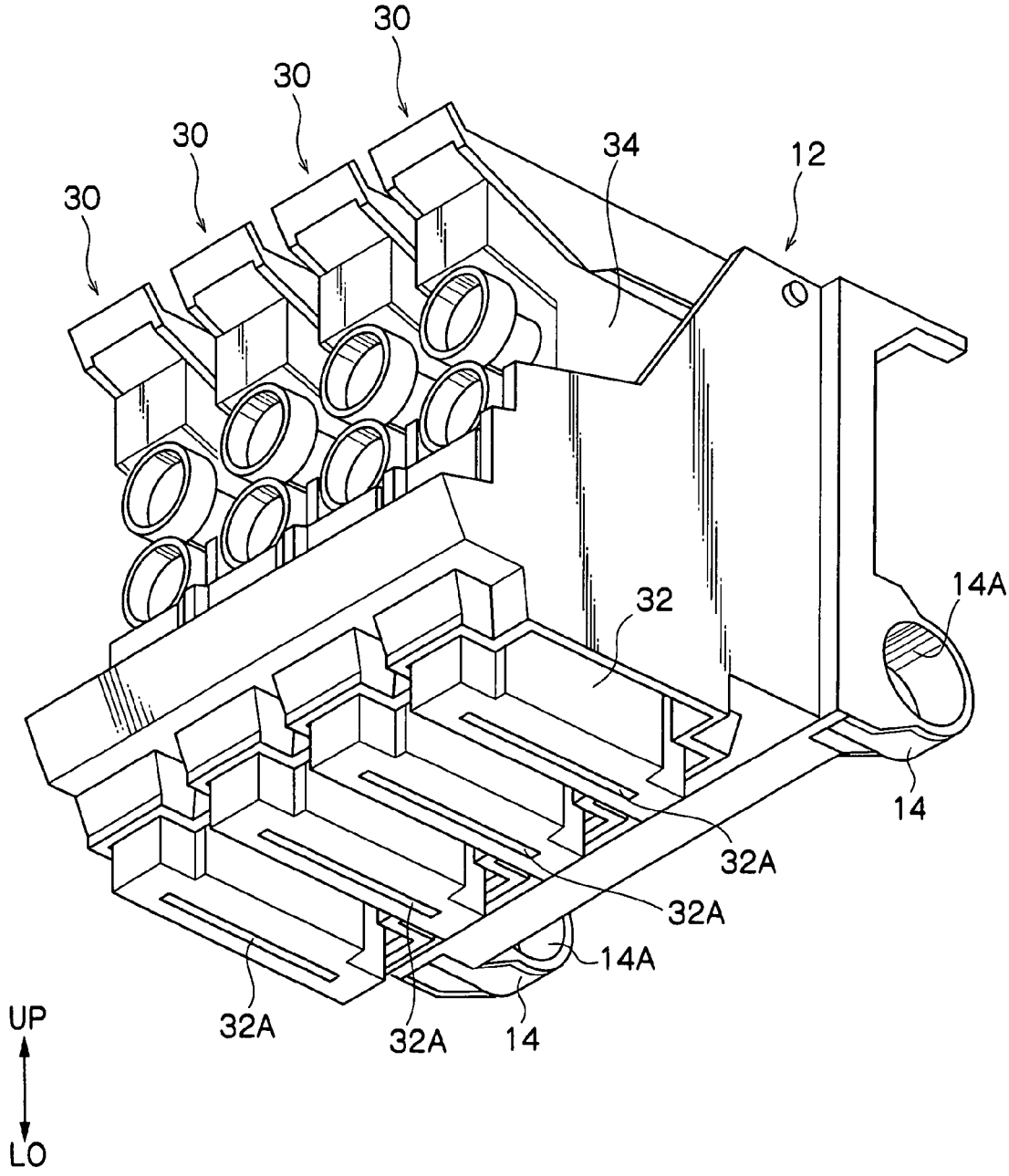
FIG. 2 is a schematic perspective view of inkjet recording units installed in a carriage of the inkjet recording device of the present invention.

As shown in FIG. 2, at the inkjet recording unit 30 of each color, the inkjet recording head 32 and an ink tank 34, which supplies ink to the inkjet recording head 32, are structured integrally. The inkjet recording unit 30 is installed in the carriage 12 such that plural nozzles 56 (see FIG. 3), which are formed in an ink ejecting surface 32A at the center of the bottom surface of the inkjet recording head 32, face the recording sheet P. Accordingly, due to the inkjet recording heads 32 selectively ejecting ink drops from the nozzles 56 onto the recording sheet P while the inkjet recording heads 32 are moved in the main scanning direction by the main scanning mechanism 16, a portion of an image based on image data is recorded at a predetermined band region.

When movement of one time in the main scanning direction is completed, the recording sheet P is conveyed by a predetermined pitch in the subscanning direction by the subscanning mechanism 18. A portion of the image based on the image data is recorded on the next band region while the inkjet recording heads 32 (the inkjet recording units 30) are again moved in the main scanning direction (in the direction opposite to that previously). By repeating this operation plural times, the entire image which is based on the image data is recorded on the recording sheet P in full color.

Figure 3:
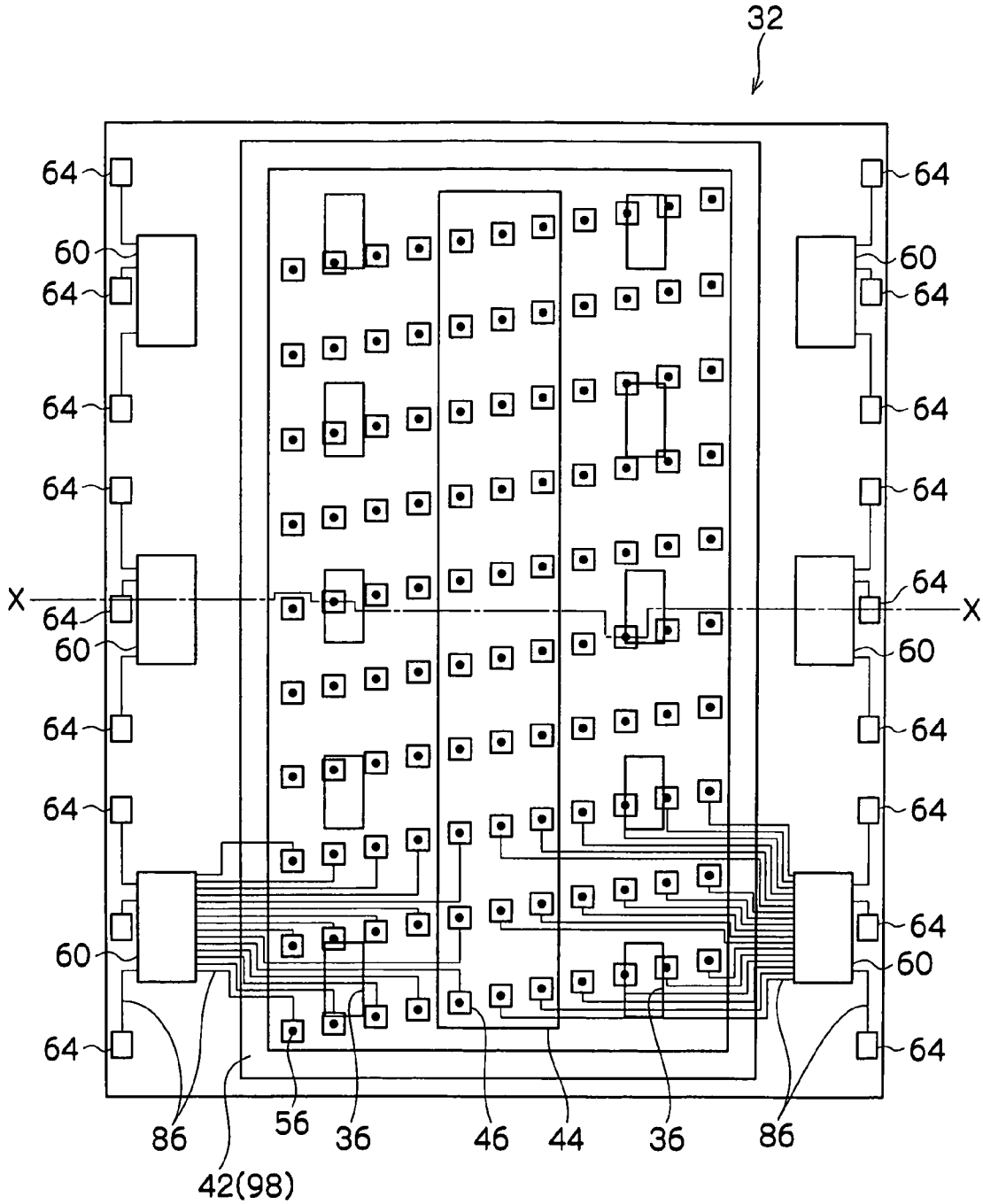
FIG. 3 is a schematic plan view showing the structure of an inkjet recording head of a first embodiment of the present invention.
Figure 4:
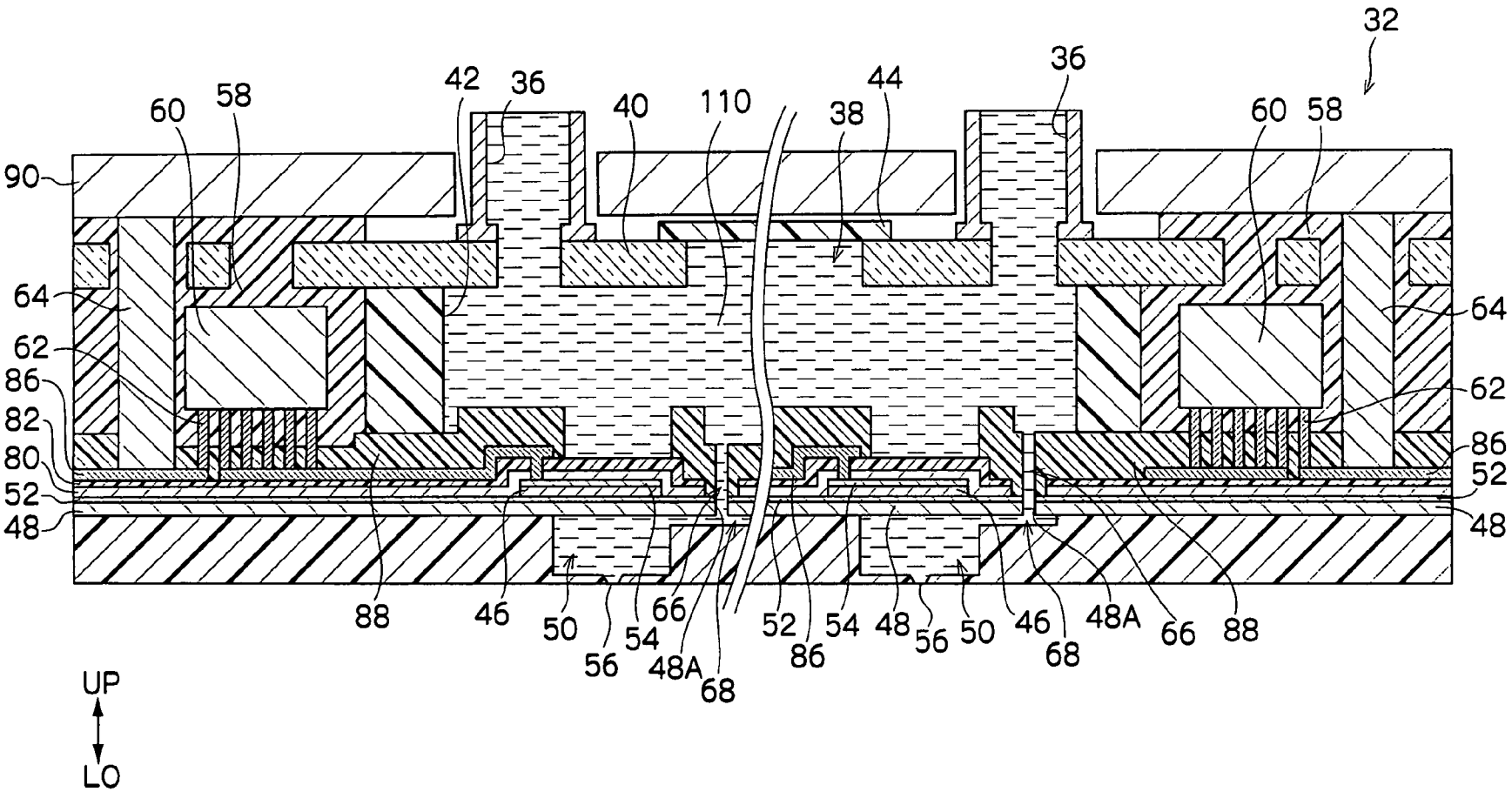
FIG. 4 is a schematic sectional view taken along line X-X of FIG. 3.

Next, the inkjet recording head 32 in the inkjet recording device 10 having the above-described structure will be described in detail. FIG. 3 is a schematic plan view showing the structure of the inkjet recording head 32 of the first embodiment, and FIG. 4 is a schematic sectional view taken along line X-X of FIG. 3. As shown in FIGS. 3 and 4, a top plate member 90 is disposed at the inkjet recording head 32. In the present embodiment, the top plate member 90 is structured by a so-called printed wiring board (PWB) which is plate-shaped, and is the top plate of the entire inkjet recording head 32. Note that metal wires (not shown), which are for energizing driving ICs 60 which will be described later, are provided at the top plate member 90. These metal wires are covered and protected by a resin film, such that erosion of the metal wires due to an ink 110 (corrosion) is prevented.

Ink supplying ports 36, which communicate with the ink tank 34, are provided at the inkjet recording head 32. The ink 110, which is injected-in from these ink supplying ports 36, is pooled in an ink pooling chamber 38.

The configuration and the volume of the ink pooling chamber 38 are regulated by a capping member 40, which is provided separately from the top plate member 90 and is disposed parallel to the top plate member 90, and a partitioning wall member 42 which is joined to the capping member 40. Plural ink supplying ports 36 are formed in lines at predetermined places of the capping member 40. Further, an air damper 44 (a photosensitive dry film 96 which will be described later), which is made of resin and mitigates pressure waves within the ink pooling chamber 38, is provided at the top surface of the capping member 40, between the ink supplying ports 36 which form the lines.

The capping member 40 is formed of glass and in the shape of a plate, and can maintain the ink sealing ability of the ink pooling chamber 38 good.

The partitioning wall member 42 is molded of resin (a photosensitive dry film 98 which will be described later), and partitions the ink pooling chamber 38 into a rectangular shape. Further, the ink pooling chamber 38 is separated, above and below, into piezoelectric elements 46 and pressure chambers 50, via a vibrating plate 48 which is flexurally deformed in the top-bottom direction by the piezoelectric elements 46. Namely, the piezoelectric elements 46 and the vibrating plate 48 are structured so as to be disposed between the ink pooling chamber 38 and the pressure chambers 50, and the ink pooling chamber 38 and the pressure chambers 50 are structured so as to not exist on the same horizontal plane.

Accordingly, the pressure chambers 50 can be disposed in states of being near to one another, and the nozzles 56 can be disposed in the form of a matrix and at a high density. Due to such a structure, an image can be formed in a wide band region due to the carriage 12 moving one time in the main scanning direction. Therefore, the scanning time can be made to be short. Namely, it is possible to realize high-speed printing in which an image is formed over the entire surface of the recording sheet P in a short time and by a small number of times of movement of the carriage 12.

The piezoelectric element 46 is adhered onto the top surface of the vibrating plate 48 for each pressure chamber 50. The vibrating plate 48 is molded of a metal such as SUS or the like, and is elastic at least in the top-bottom direction. When the piezoelectric element 46 is energized (i.e., when voltage is applied to the piezoelectric element 46), the vibrating plate 48 flexurally deforms (is displaced) in the top-bottom direction. Note that the vibrating plate 48 may be an insulating material such as glass or the like. A lower electrode 52, which is one polarity, is disposed at the bottom surfaces of the piezoelectric elements 46. Upper electrodes 54, which are the other polarity, are disposed on the top surfaces of the piezoelectric elements 46. The driving ICs 60 are electrically connected to the upper electrodes 54 by metal wires 86.

The piezoelectric elements 46 are covered and protected by a low water permeable insulating film (an $SiO_x$ film) 80. The low water permeable insulating film ($SiO_x$ film) 80, which covers and protects the piezoelectric elements 46, is formed under the condition that the moisture permeability is low. Therefore, the low water permeable insulating film 80 can prevent poor reliability due to moisture penetrating into the piezoelectric elements 46 (a deterioration in the piezoelectric characteristic caused by the oxygen within the PZT film reducing). Note that the vibrating plate 48, which is formed of metal (SUS or the like) and contacts the lower electrode 52, also functions as a low-resistance GND wire.

Moreover, at the piezoelectric elements 46, the top surface of the low water permeable insulating film ($SiO_x$ film) 80 is covered and protected by a resin film 82. In this way, the resistance to erosion by the ink 110 is ensured at the piezoelectric elements 46. The metal wires 86 as well are covered and protected by a resin protective film 88, such that erosion due to the ink 110 is prevented.

The regions above the piezoelectric elements 46 are covered and protected by the resin film 82, and are not covered by the resin protective film 88. Because the resin film 82 is a flexible resin layer, due to such a structure, impeding of displacement of the piezoelectric elements 46 (the vibrating plate 48) is prevented (the piezoelectric elements 46 (the vibrating plate 48) can flexurally deform appropriately in the top-bottom direction). However, at the resin layer above the piezoelectric element 46, the thinner the layer, the better the effect of suppressing the impeding of displacement. Therefore, the resin protective film 88 is not covered above the piezoelectric elements 46.

The driving ICs 60 are disposed at the outer sides of the ink pooling chamber 38 which is prescribed by the partitioning wall member 42, and between the capping member 40 and the vibrating plate 48. The driving ICs 60 are structured so as to not be exposed (not project out) from the vibrating plate 48 or the capping member 40. Accordingly, the inkjet recording head 32 can be made more compact.

Figure 5:
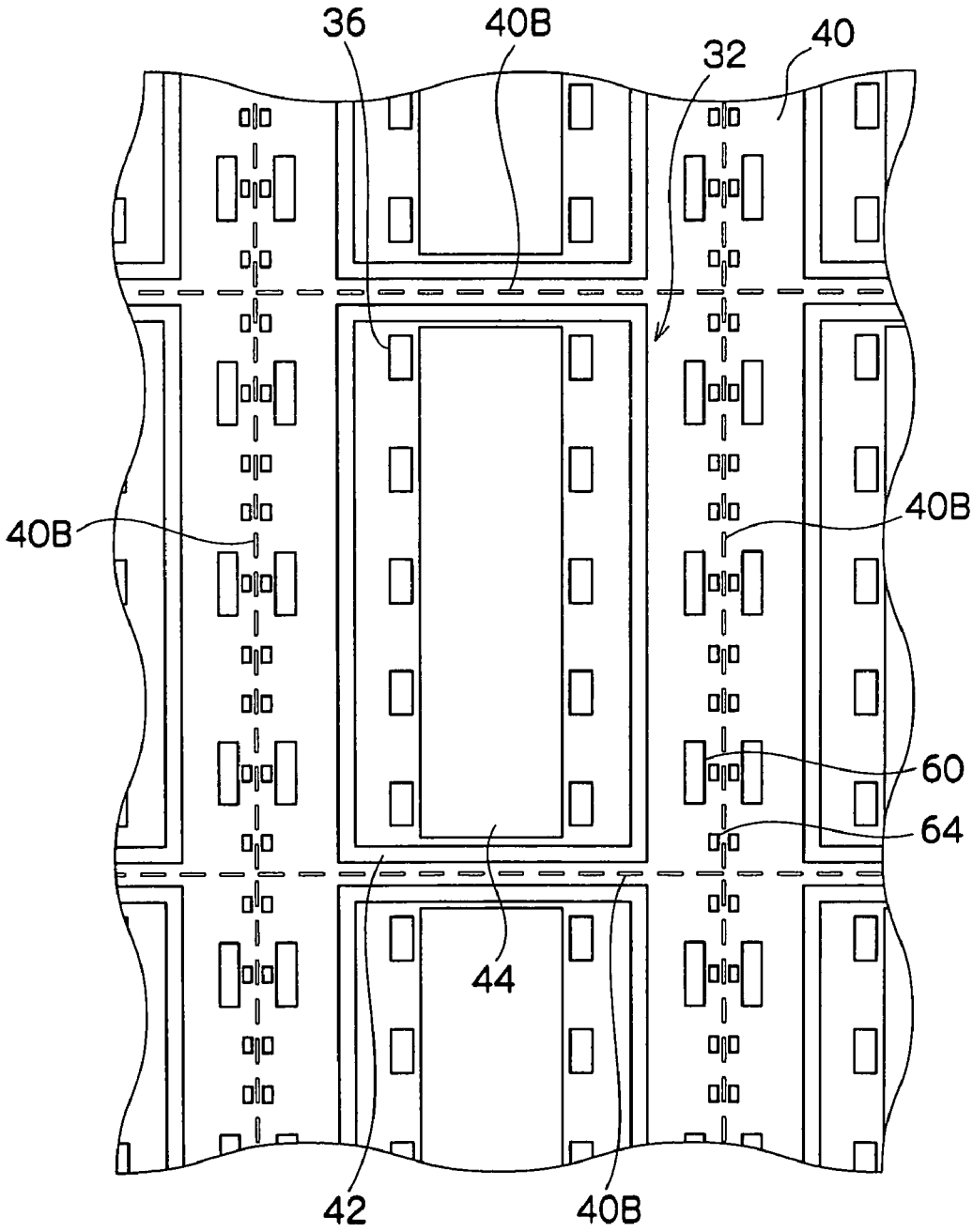
FIG. 5 is a schematic plan view showing a top plate before being cut as the inkjet recording heads of the first embodiment of the present invention.

The peripheries of the driving ICs 60 are sealed by a resin material 58. As shown in FIG. 5, plural injection openings 40B of the resin material 58 which seals the driving ICs 60 are formed in the top plate member 90 and the capping member 40 in the manufacturing step, in a grid-like form so as to partition the respective inkjet recording heads 32. After the uniting (joining) of a piezoelectric element substrate 70 and a flow path substrate 72 which will be described later, the top plate member 90 and the capping member 40 are cut along the injection openings 40B which are sealed (closed) by the resin material 58. In this way, the plural inkjet recording heads 32, which have the nozzles 56 (see FIG. 3) in a matrix form, are manufactured at one time.

Figure 6:
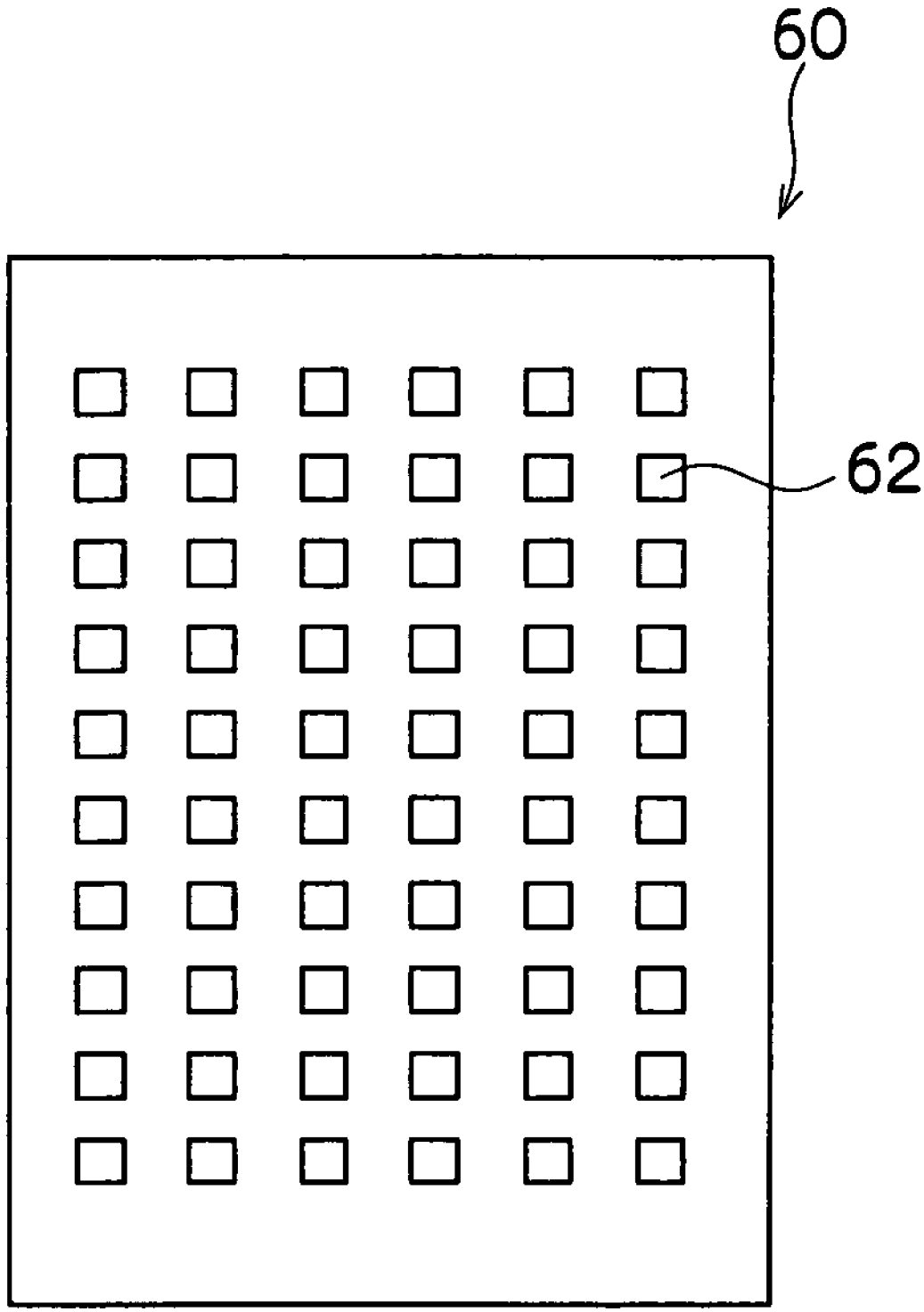
FIG. 6 is a schematic plan view showing bumps of a driving IC of the inkjet recording head of the present invention.

As shown in FIGS. 4 and 6, plural bumps 62 project out by predetermined heights and in the form of a matrix at the bottom surface of the driving IC 60, so as to be flip-chip mounted at the metal wires 86 of the piezoelectric element substrate 70 at which the piezoelectric elements 46 are formed on the vibrating plate 48. Accordingly, high-density connection to the piezoelectric elements 46 can be realized easily, and a reduction in the height of the driving IC 60 is possible (the driving IC 60 can be made thinner). For this reason as well, the inkjet recording head 32 can be made more compact.

Bumps 64 are provided at the outer sides of the driving ICs 60 in FIG. 3. The bumps 64 connect metal wires (not shown) provided at the top plate member 90, and the metal wires 86 provided at the piezoelectric element substrate 70. The bumps 64 are of course provided so as to be higher than the heights of the driving ICs 60 mounted on the piezoelectric element substrate 70.

Accordingly, the metal wires of the top plate member 90 are energized from the main body of the inkjet recording device 10, and the metal wires 86 are energized from the metal wires of the top plate member 90 via the bumps 64, and the driving ICs 60 are energized therefrom. Voltage is applied to the piezoelectric elements 46 at predetermined times by the driving ICs 60, such that the vibrating plate 48 is flexurally deformed in the top-bottom direction. The ink 110 filled in the pressure chambers 50 is thereby pressurized, such that ink drops are ejected from the nozzles 56.

One nozzle 56 which ejects the ink drops is provided for each pressure chamber 50, at a predetermined position thereof. The pressure chamber 50 and the ink pooling chamber 38 are connected by an ink flow path 66 and an ink flow path 68 communicating with one another. The ink flow path 66 bypasses the piezoelectric element 46 and passes through a through-hole 48A formed in the vibrating plate 48. The ink flow path 68 extends horizontally in FIG. 4 from the pressure chamber 50. The ink flow path 68 is provided in advance so as to be a little longer than the portion actually connected to the ink flow path 66, such that the ink flow path 68 can be aligned with the ink flow path 66 (such that they can reliably be made to communicate with one another) at the time of manufacturing the inkjet recording head 32.

Next, the manufacturing processes of the inkjet recording head 32, which is structured as described above, will be described in detail on the basis of FIGS. 7 through 13. Note that, in the following description, a printed wiring board (PWB substrate) is used as an example of the top plate member 90.

Figure 7:
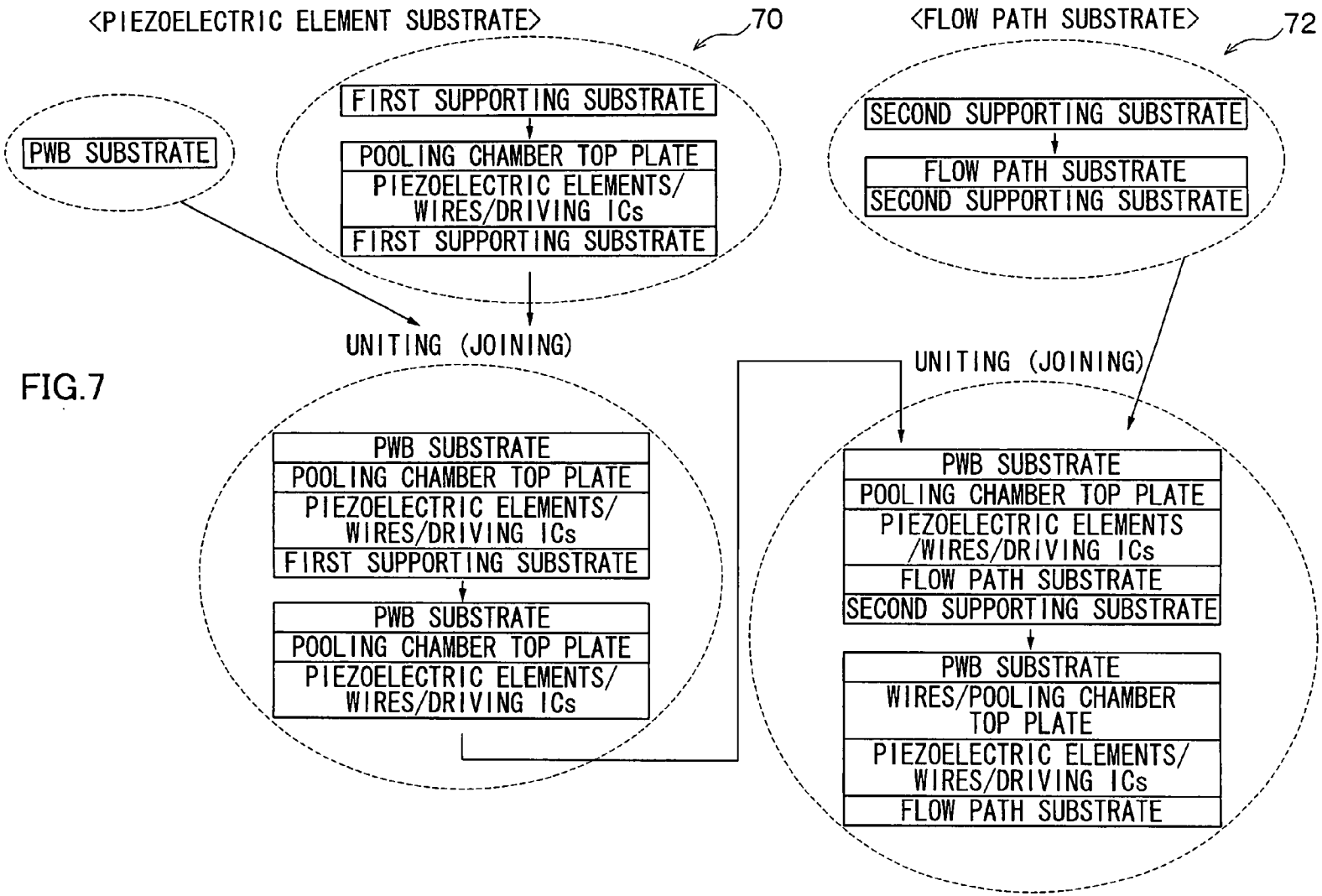
FIG. 7 is a diagram explaining the overall processes for manufacturing the inkjet recording head of the first embodiment of the present invention.

As shown in FIG. 7, the inkjet recording head 32 is manufactured by forming the piezoelectric element substrate 70 and the flow path substrate 72 separately, and uniting (joining) the two together. Thus, the process of manufacturing the piezoelectric element substrate 70 will be described first. The top plate member 90 (the PWB substrate) is united (joined) to the piezoelectric element substrate 70 before the flow path substrate 72.

Figures 8A, 8B, 8C, 8D, 8E, 8F:
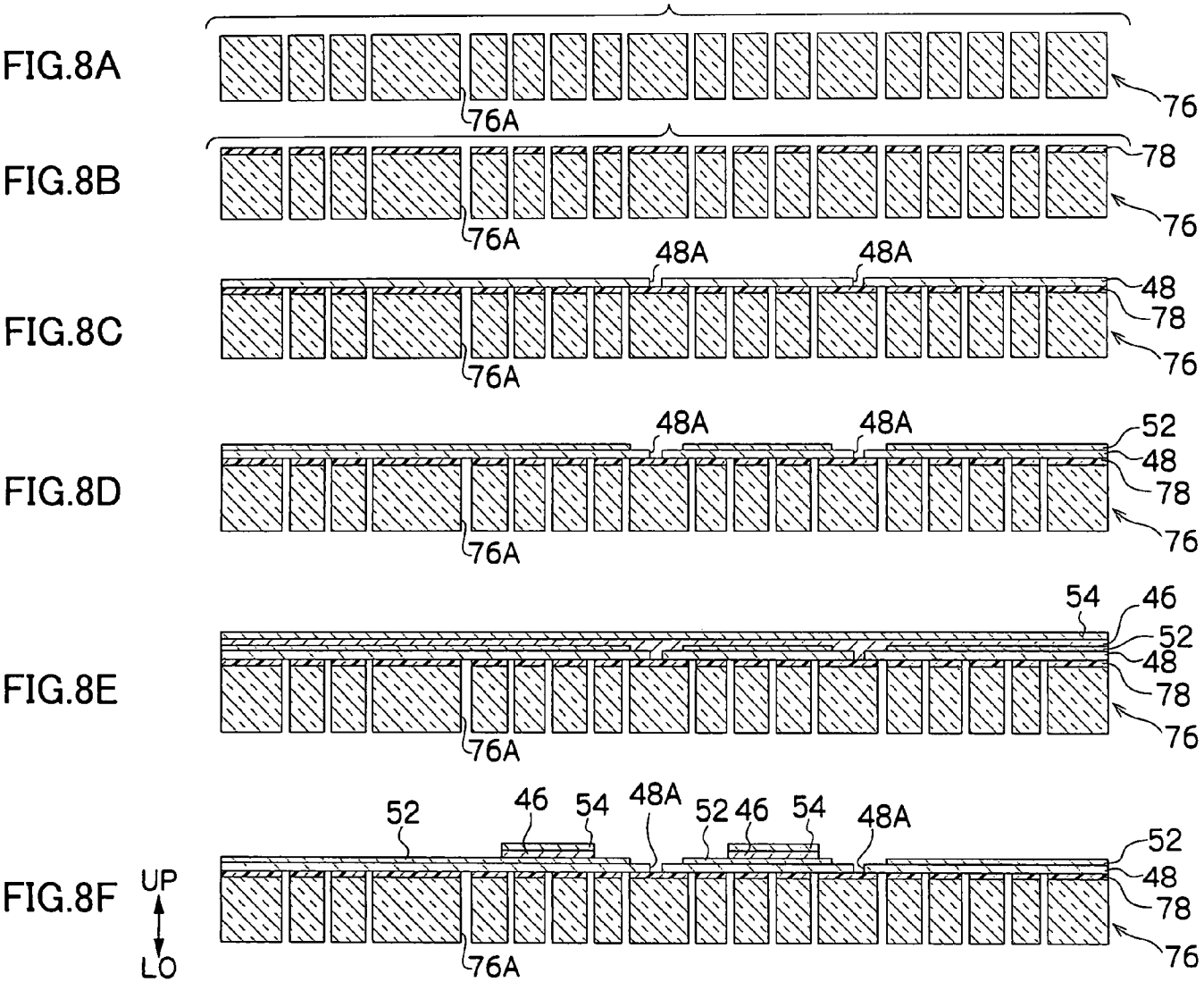
FIGS. 8A through 8K are diagrams explaining processes of manufacturing a piezoelectric element substrate relating to the first embodiment of the present invention.

As shown in FIG. 8A, first, a first supporting substrate 76, which is formed of glass and in which plural through-holes 76A are formed, is prepared. The first supporting substrate 76 may be any material provided that it does not flex, and is not limited to being formed of glass, but glass is preferable as it is hard and inexpensive. Femtosecond pulse laser machining of a glass substrate, exposure and development of a photosensitive glass substrate (e.g., PEG3C manufactured by Hoya Corporation), and the like are known as methods for fabricating the first supporting substrate 76.

Then, as shown in FIG. 8B, an adhesive 78 is applied to the top surface (the obverse) of the first supporting substrate 76, and, as shown in FIG. 8C, the vibrating plate 48 which is formed of metal (SUS or the like) is adhered on the top surface. At this time, the through-holes 48A of the vibrating plate 48 and the through-holes 76A of the first supporting substrate 76 are not superposed (do not overlap). Note that an insulating substrate of glass or the like may be used as the material of the vibrating plate 48.

Here, the through-holes 48A of the vibrating plate 48 are for forming the ink paths 66. Further, the reasons why the through-holes 76A are provided in the first supporting substrate 76 are in order to allow a chemical liquid (solvent) to flow-in to the boundary surface between the first supporting substrate 76 and the vibrating plate 48 in a later step, and in order to dissolve the adhesive 78 and peel the first supporting substrate 76 from the vibrating plate 48. Further, the reason why the through-holes 76A of the first supporting substrate 76 and the through-holes 48A of the vibrating plate 48 are made to not overlap is in order for the respective materials which are used in manufacturing to not leak out from the bottom surface (the reverse surface) of the first supporting substrate 76.

Next, as shown in FIG. 8D, the lower electrode 52, which is layered on the top surface of the vibrating plate 48, is patterned. Concretely, metal film sputtering (film thickness: 500 Å to 3000 Å), resist formation by photolithography, patterning (etching), and resist peeling by oxygen plasma are carried out. This lower electrode 52 is at a ground potential. Next, in step 8E, a PZT film, which is the material of the piezoelectric elements 46, and the upper electrodes 54 are layered in that order by sputtering on the top surface of the lower electrode 52. As shown in FIG. 8F, the piezoelectric elements 46 (the PZT film) and the upper electrodes 54 are patterned.

Concretely, PZT film sputtering (film thickness: 3 μm to 15 μm), metal film sputtering (film thickness: 500 Å to 3000 Å), resist formation by photolithography, patterning (etching), and resist peeling by oxygen plasma are carried out. Examples of the material for the lower and upper electrodes include Au, Ir, Ru, Pt, and the like, which are heat-resistant and have good affinity with the PZT material which is the piezoelectric elements.

Figures 8G, 8H, 8I, 8J:
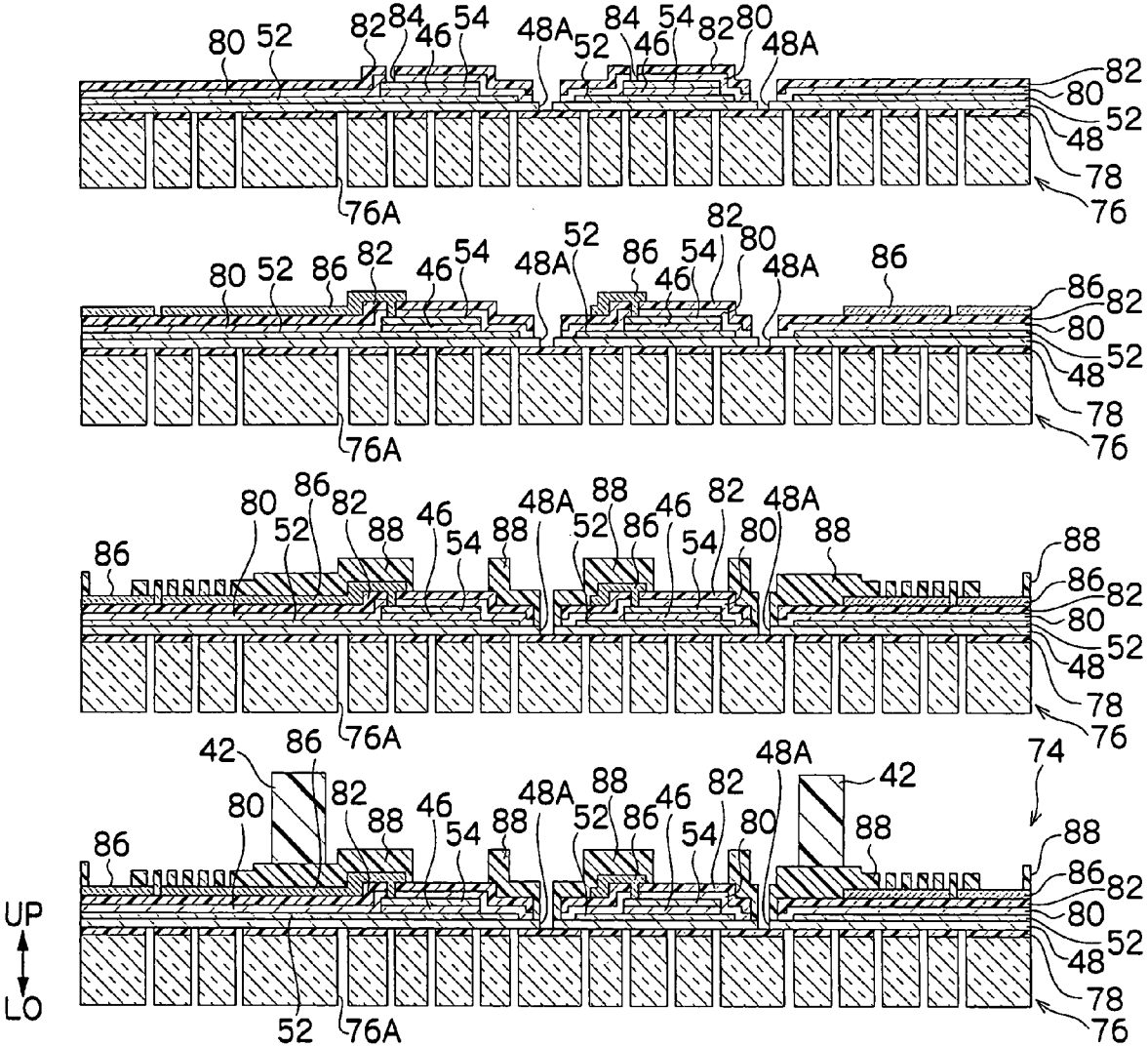

Thereafter, as shown in FIG. 8G, the low water permeable insulating film ($SiO_x$ film) 80 is layered on the top surfaces of the lower electrode 52 and the upper electrodes 54 which are exposed at the top surface. Then, the resin film 82 which is ink-resistant and flexible, e.g., a resin film of a polyimide, a polyamide, an epoxy, a polyurethane, a silicone, or the like, is layered on the top surface of the low water permeable insulating film ($SiO_x$ film) 80. By patterning these, openings 84 (contact holes) for connecting the piezoelectric elements 46 and the metal wires 86 are formed.

Concretely, the following processes are carried out: the low water permeable insulating film ($SiO_x$ film) 80 which has a high dangling bond density is formed by Chemical Vapor Deposition (CVD), a photosensitive polyimide (e.g., photosensitive polyimide Durimide 7520 manufactured by FUJIFILM Electronics Materials Co., Ltd.) is coated, exposed, and developed so as to be patterned, and the $SiO_x$ film is etched by using the photosensitive polyimide as a mask, by Reactive Ion Etching (RIE) using $CF_4$ gas. Note that the $SiO_x$ film is used as the low water permeable insulating film here, but the low water permeable insulating film such as an $SiN_x$ film, an $SiO_xN_y$ film, or the like may be used.

Next, as shown in FIG. 8H, a metal film is layered on the top surfaces of the resin film 82 and the upper electrodes 54 within the openings 84, and the metal wires 86 are patterned. Concretely, the following processes are carried out: an Al film (thickness: 1 μm) is formed by sputtering, a resist is formed by photolithography, the Al film is etched by RIE using a chlorine gas, and the resist film is peeled off by oxygen plasma. The upper electrodes 54 and the metal wires 86 (the Al film) are joined. Note that, although not illustrated, the openings 84 are provided above the lower electrode 52 as well, and the metal wires 86 are connected in the same way as with the upper electrodes 54.

Then, as shown in FIG. 8I, the resin protective film 88 (e.g., photosensitive polyimide Durimide 7320 manufactured by FUJIFILM Electronics Materials Co., Ltd.) is layered on the top surfaces of the metal wires 86 and the resin film 82, and is patterned. This resin protective film 88 is formed of the same type of resin material as the resin film 82. Further, at this time, the resin protective film 88 is not layered on the regions above the piezoelectric elements 46 where the metal wires 86 are not patterned (only the resin film 82 is layered thereat).

The reason why the resin protective film 88 is not layered above the piezoelectric elements 46 (on the top surface of the resin film 82) is in order to prevent the displacement (flexural deformation in the top-bottom direction) of the vibrating plate 48 (the piezoelectric elements 46) from being impeded. Further, when the metal wires 86, which are led-out from the upper electrodes 54 of the piezoelectric elements 46 (connected to the upper electrodes 54), are covered by the resin protective film 88, because the resin protective film 88 is formed of the same type of resin material as the resin film 82 on which the metal wires 86 are layered, the joining forces thereof which cover the metal wires 86 are strong, and corrosion of the metal wires 86 due to the ink 110 penetrating-in from the boundary surface can be prevented.

Because the resin protective film 88 is formed of the same type of resin material as the partitioning wall member 42 as well, the joining force with respect to the partitioning wall member 42 is also strong. Accordingly, the ink 110 penetrating-in from the boundary surface is prevented even more. Further, using the same type of resin material in this way is advantageous in that, because the coefficients of thermal expansion thereof are substantially equivalent, there is little generation of thermal stress.

Next, as shown in FIG. 8J, the photosensitive resin 98, which is to become the partitioning wall member 42, is patterned on the resin protective film 88.

Figure 8K:
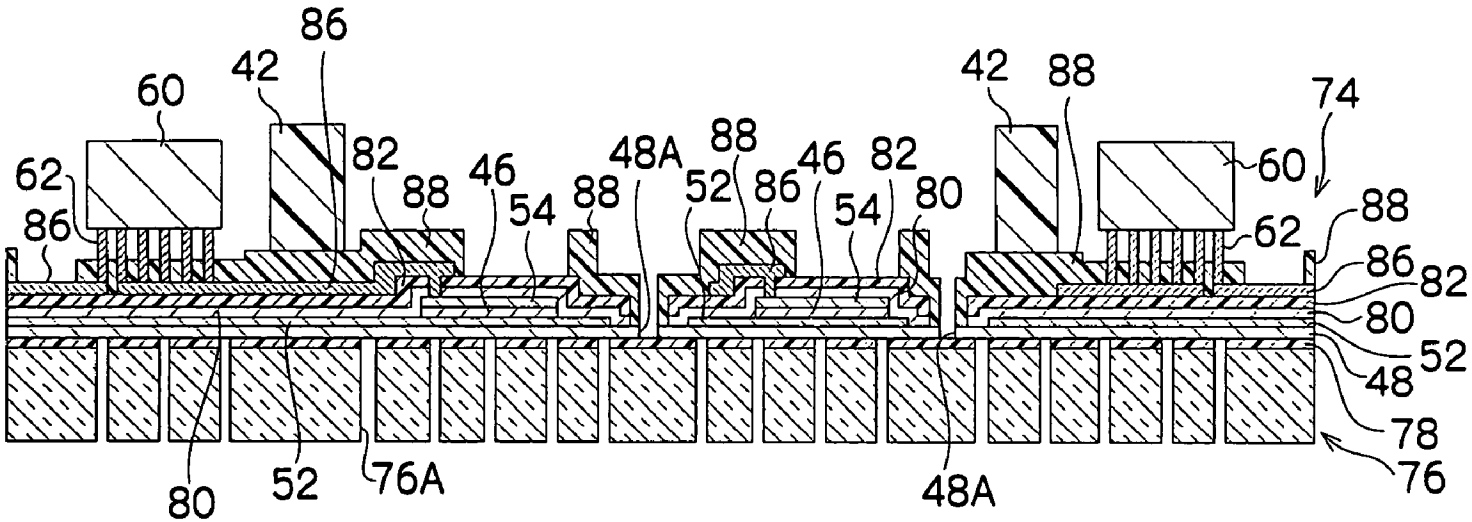

Then, as shown in FIG. 8K, the driving ICs 60 are flip-chip mounted on the metal wires 86 via the bumps 62. At this time, the driving ICs 60 are worked to a predetermined thickness (70 μm to 300 μm) in a grinding process carried out in advance at the end of the semiconductor wafer processes. If the driving ICs 60 are too thick, patterning of the partitioning wall member 42 and formation of the bumps 64 are difficult.

Electroplating, electroless plating, ball bumps, screen printing, or the like can be used as the method for forming the bumps 62 for flip-chip mounting the driving ICs 60 on the metal wires 86.

Figures 9A, 9B, 9C, 9D:
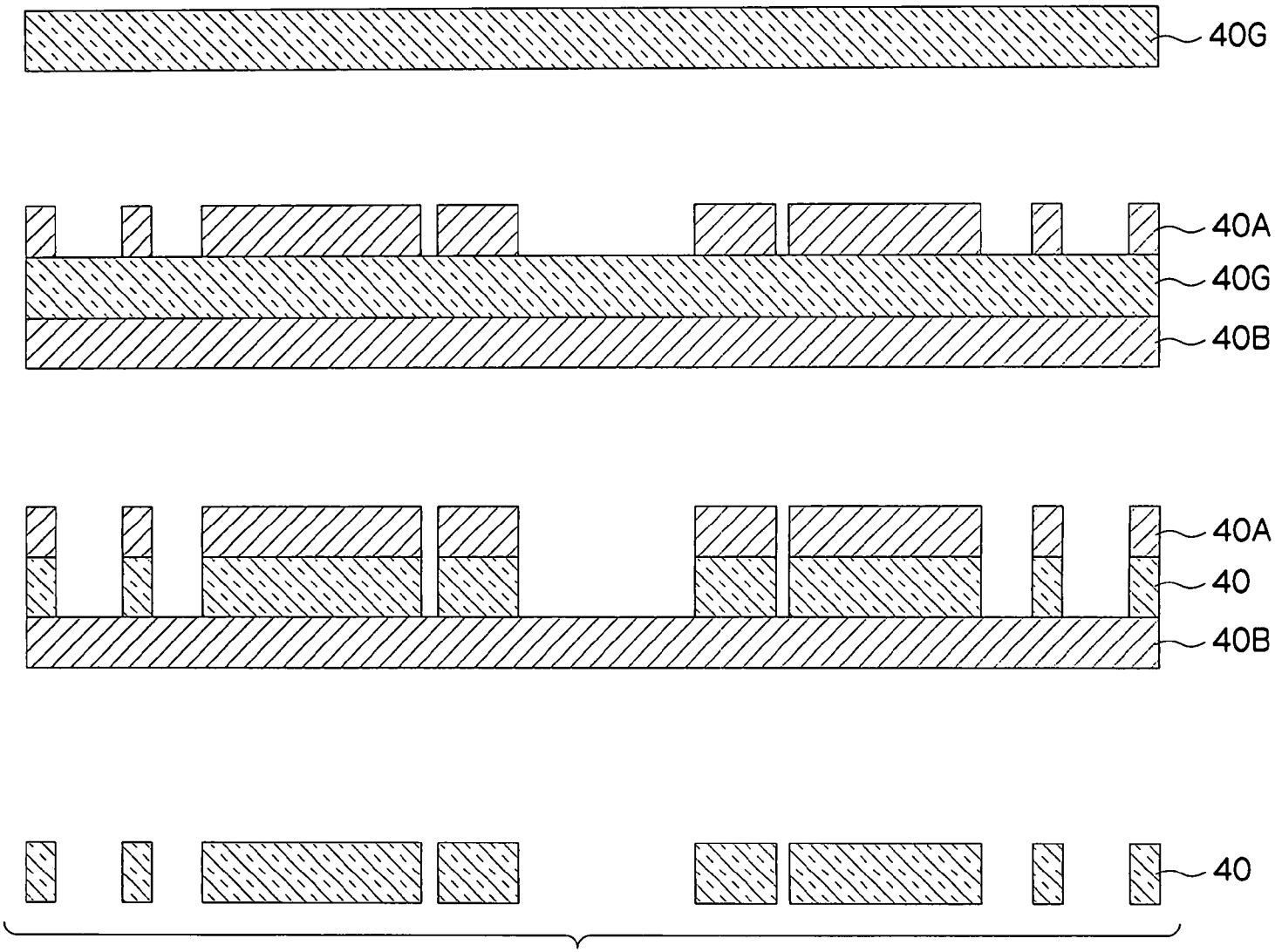
FIGS. 9A through 9D are diagrams explaining processes of manufacturing a capping member relating to the first embodiment of the present invention.

Next, the capping member 40 is fabricated as shown in FIGS. 9A through 9D. In fabricating the capping member 90, as shown in FIG. 9A, first, a glass substrate 40G (base material) of a predetermined thickness is prepared.

As shown in FIG. 9B, a resist 40A is patterned by photolithography on one surface of the glass substrate 40G The entire opposite surface is covered by a resist 40B for protection. Here, the resist 40B for protection is applied in order to prevent the glass substrate 40G from being etched from the reverse surface (i.e., the surface where a resist 40B for protection is applied) of the surface at which the resist 40A is applied, in the subsequent wet ($SiO_2$) etching step. Note that, in a case in which a photosensitive glass is used as the capping member 40, this step of applying the resist 40B for protection can be omitted.

Next, as shown in FIG. 9C, wet ($SiO_2$) etching by an HF solution is carried out on the glass substrate 40G. Thereafter, as shown in FIG. 9D, the resists 40A, 40B are peeled-off by oxygen plasma.

Figure 10A:
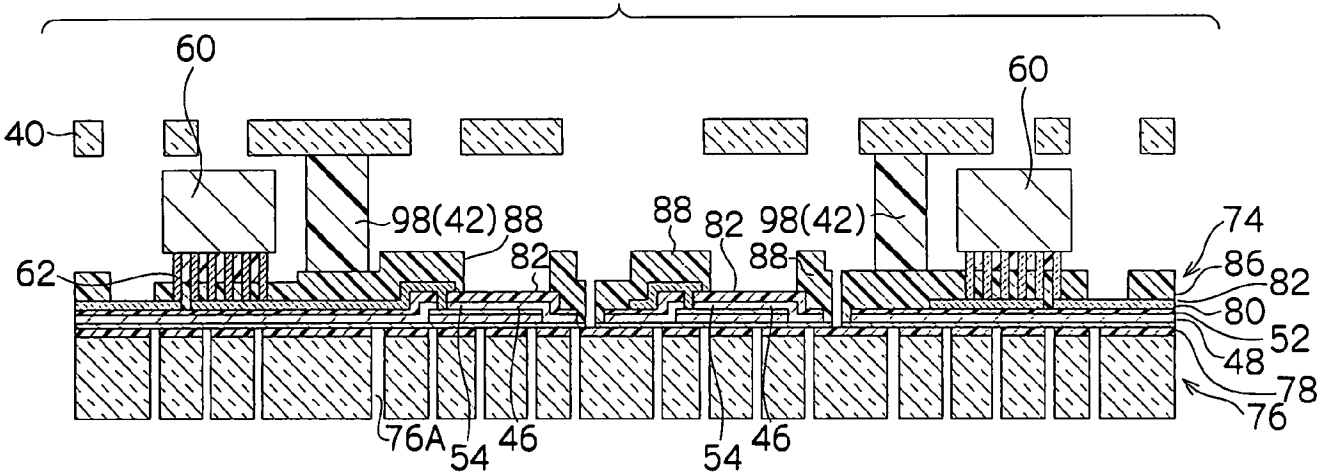
FIGS. 10A and 10B are diagrams explaining processes of manufacturing the piezoelectric element substrate relating to the first embodiment of the present invention.

Next, the capping member 40 obtained in this way is joined (e.g., thermocompression bonded) to the partitioning wall member 42 as shown in FIG. 10A.

Figure 10B:
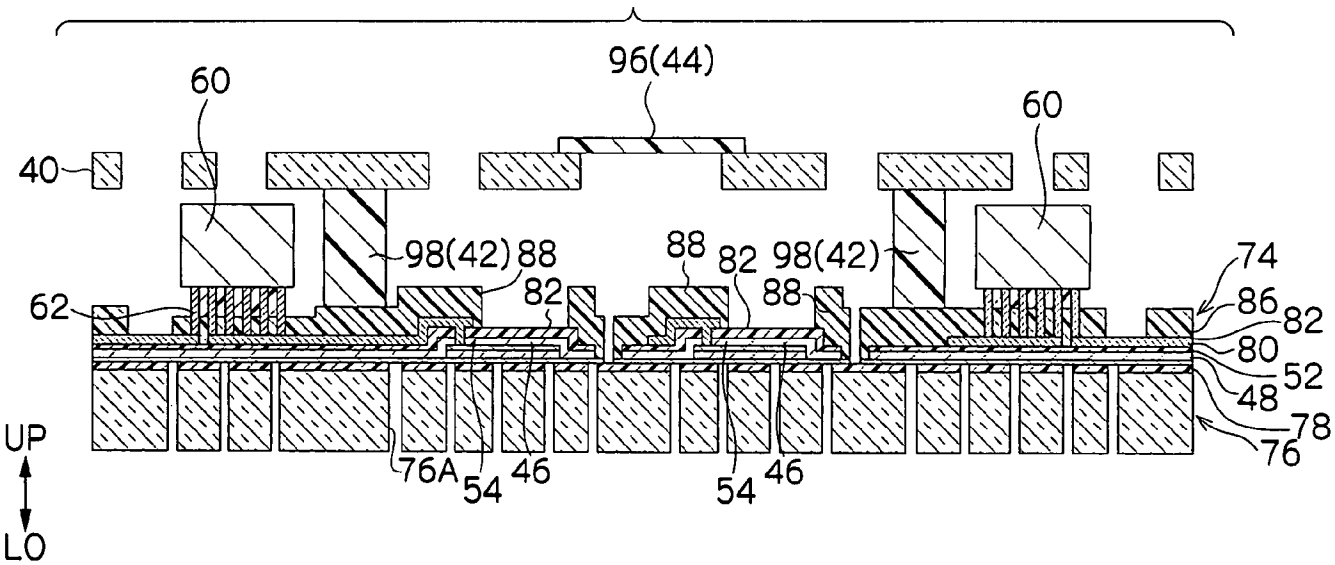

Then, as shown in FIG. 10B, the photosensitive dry film 96 is affixed to an opening portion of the capping member 40. The air damper 44 shown in FIG. 4 is provided by this photosensitive dry film 96.

In this way, the piezoelectric element substrate 70 is fabricated, and the PWB substrate, which is the top plate member 90, is united (joined) thereto.

Figure 11A:
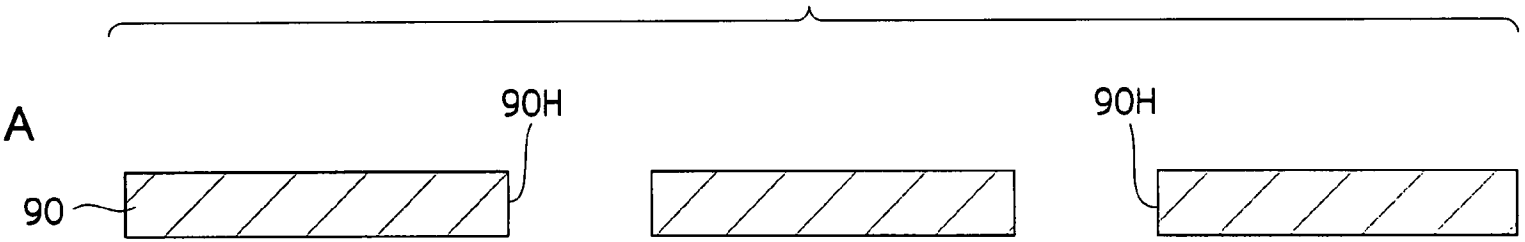
FIGS. 11A and 11B are diagrams explaining processes of manufacturing a top plate member relating to the present invention.

In manufacturing the top plate member 90, as shown in FIG. 11A, by using a material such that the top plate member 90 itself has a thickness (0.3 mm to 1.5 mm) which can ensure strength of an extent needed for the top plate member 90 to be a supporting body, there is no need to provide a separate supporting body. Further, the desired metal wires can be provided easily on the PWB substrate by a general method. Insert-through holes 90H for the ink supplying ports 36 to be inserted therethrough are formed in the top plate member 90.

Figure 11B:
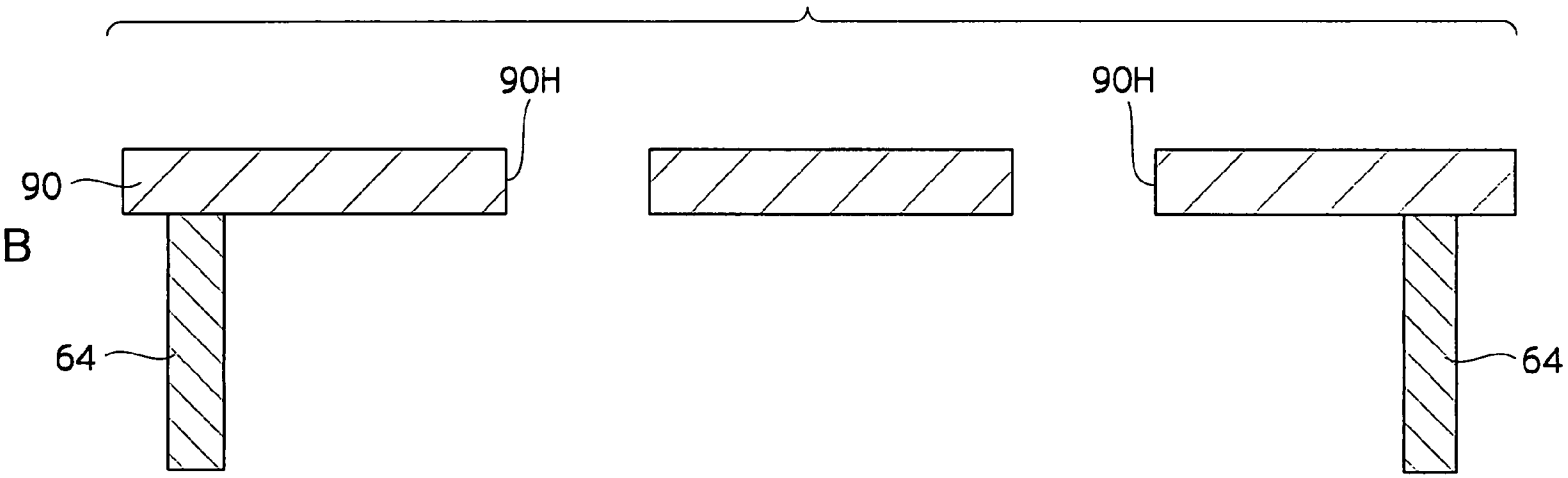

As shown in FIG. 11B, the bumps 64 are formed by plating or the like on the metal wires at the top plate member 90. In order to electrically connect these bumps 64 to the metal wires 86 of the ICs 60, as illustrated, the heights of the bumps 64 are formed to be higher than the combined thicknesses of the capping member 40, the partitioning wall member 42, and the photosensitive dry film 96.

Figure 12A:
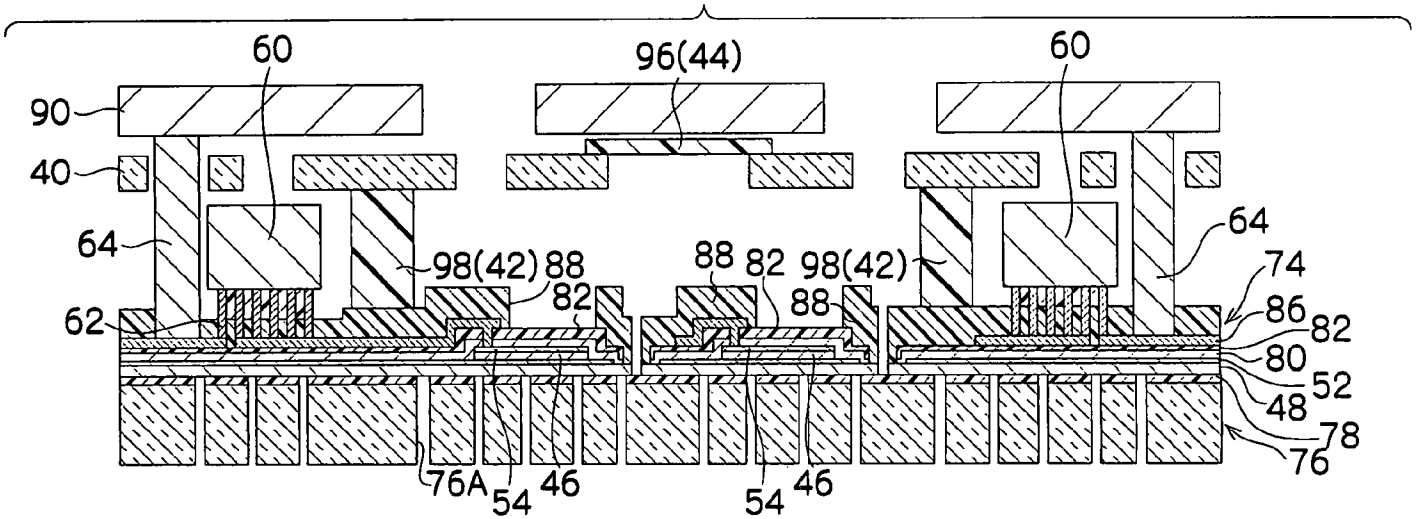
FIGS. 12A through 12D are diagrams explaining processes of joining the top plate member to the piezoelectric element substrate relating to the first embodiment of the present invention.

After the top plate member 90 is manufactured in this way, as shown in FIG. 12A, the top plate member 90 is placed on the piezoelectric element substrate 70, and the both are united (joined) together by thermocompression bonding. Namely, the bumps 64 are joined to the metal wires 86.

At this time, the heights of the bumps 64 are higher than the combined thicknesses of the capping member 40, the partitioning wall member 42, and the photosensitive dry film 96. Therefore, the bumps 64 are automatically joined to the metal wires 86.

Figure 12B:
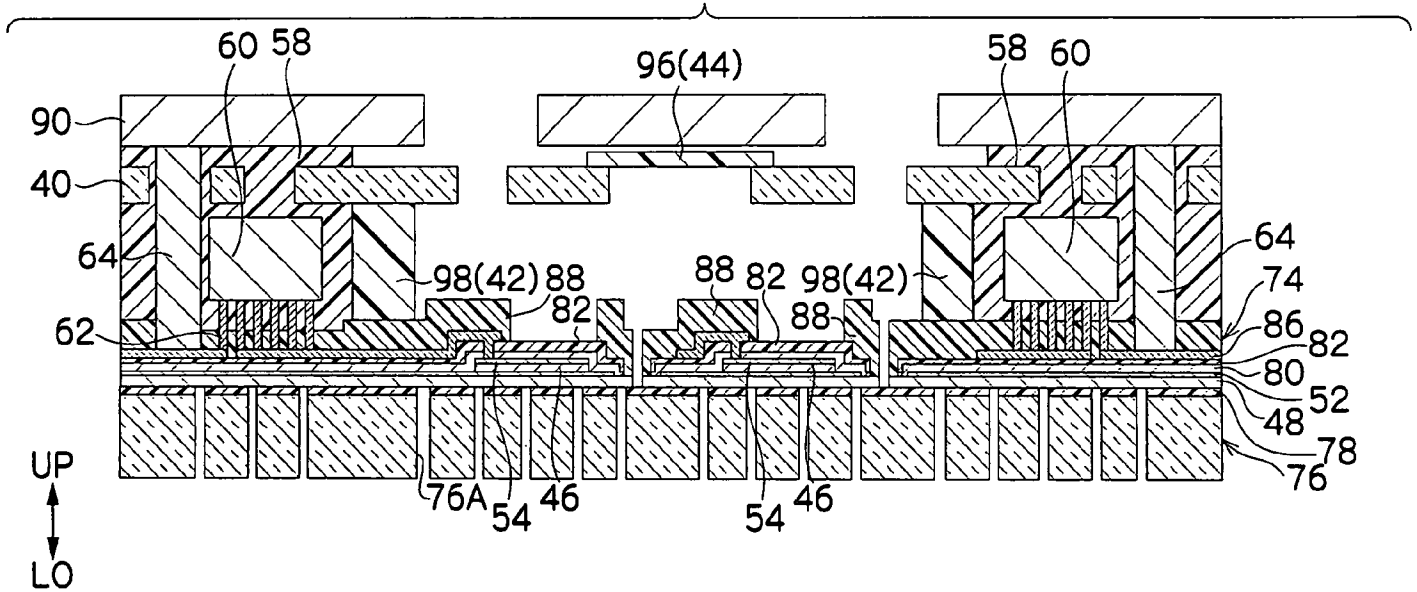

When the joining of the partitioning wall member 42 and the bumps 64 is completed, as shown in FIG. 12B, the resin material 58 for sealing (e.g., an epoxy resin) is injected-in at the driving ICs 60. Namely, the resin material 58 is made to flow-in from the injection openings 40B (see FIG. 5) which are formed in the top plate member 90 and the capping member 40. When the resin material 58 is injected-in and the driving ICs 60 are sealed in this way, the driving ICs 60 can be protected from the external environment such as moisture and the like, and the bonding strength of the piezoelectric element substrate 70 and the top plate member 90 can be improved. Further, it is possible to avoid damage in the later steps, e.g., damage due to water or ground pieces at the time when the finished piezoelectric element substrate 70 is divided into the inkjet recording heads 32 by dicing.

Figure 12C:
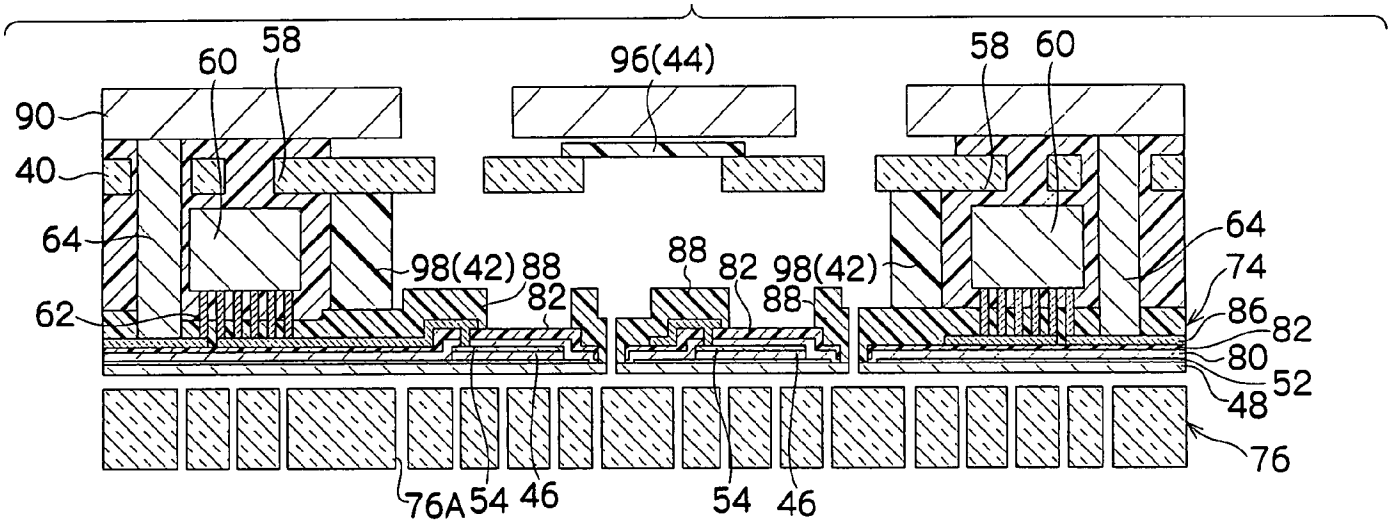
Figure 12D:
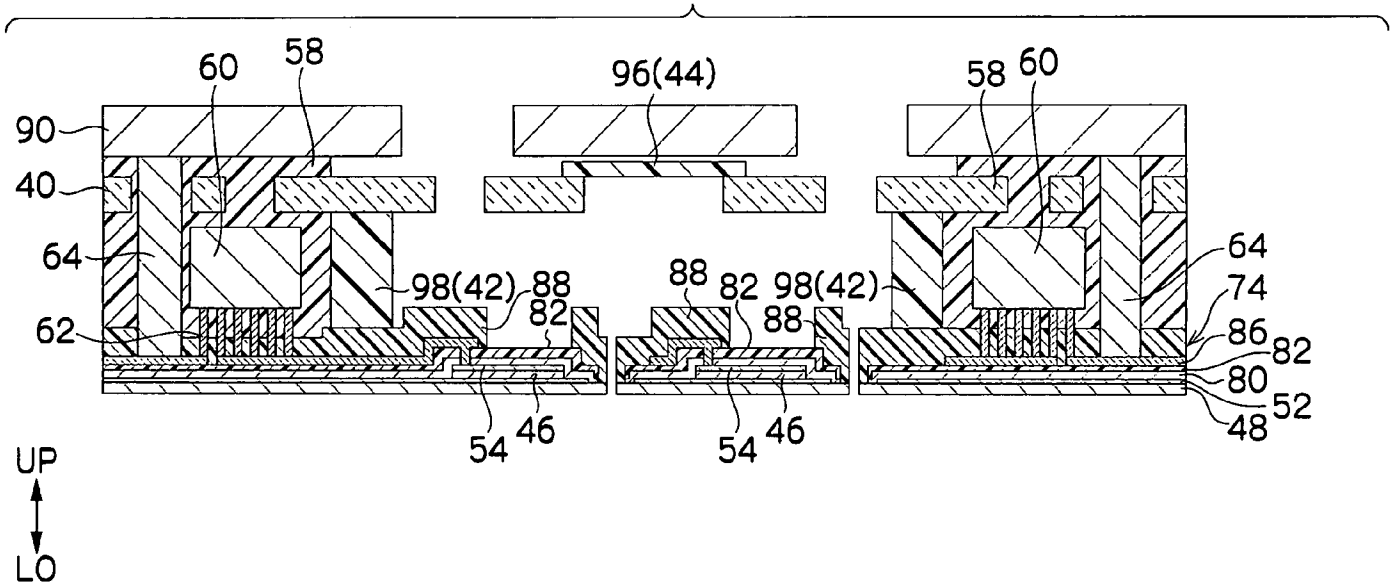

Next, as shown in FIG. 12C, by injecting-in an adhesive peeling solution from the through-holes 76A of the first supporting substrate 76 and selectively dissolving the adhesive 78, the first supporting substrate 76 is peeled-off from the piezoelectric element substrate 70. In this way, as shown in FIG. 12D, the piezoelectric element substrate 70, with which the top plate member 90 is united (joined), is completed. Then, from this state, the top plate member 90 becomes the supporting body of the piezoelectric element substrate 70.

Figures 13A, 13B, 13C, 13D, 13E:
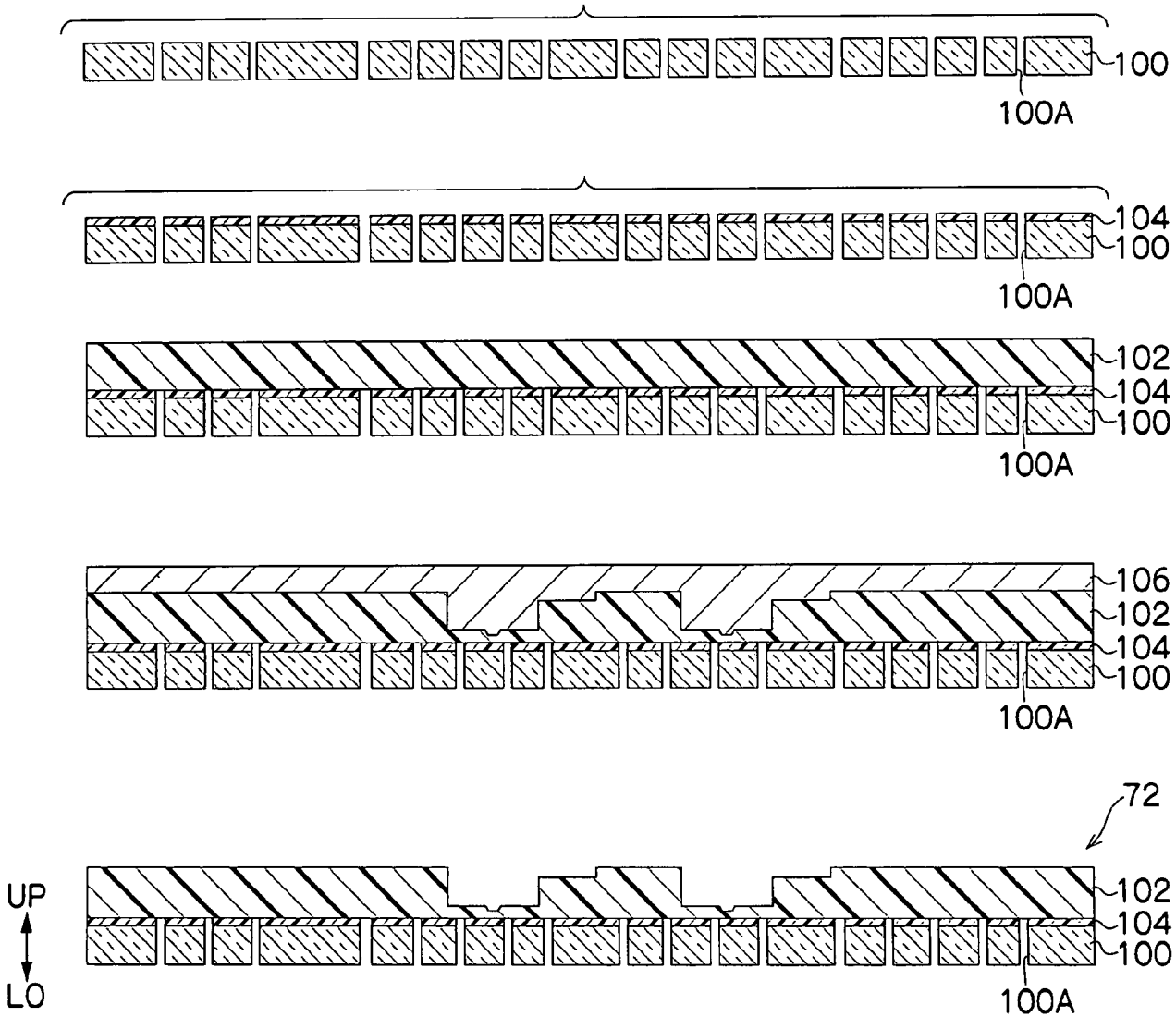
FIGS. 13A through 13E are diagrams explaining processes of manufacturing a flow path substrate relating to the present invention.

On the other hand, as shown in FIG. 13A, in the fabricating of the flow path substrate 72, first, a second supporting substrate 100 which is formed of glass and in which plural through-holes 100A are formed, is prepared. In the same way as the first supporting substrate 76, the second supporting substrate 100 may be any material provided that it does not flex, and is not limited to being formed of glass, but glass is preferable as it is hard and inexpensive. Femtosecond pulse laser machining of a glass substrate, exposure and development of a photosensitive glass substrate (e.g., PEG3C manufactured by Hoya Corporation), and the like are known as methods for fabricating the second supporting substrate 100.

Then, as shown in FIG. 13B, an adhesive 104 is coated on the top surface (the obverse) of the second supporting substrate 100. As shown in FIG. 13C, a resin substrate 102 (e.g., an amideimide substrate of a thickness of 0.1 mm to 0.5 mm) is adhered to the top surface (the obverse) thereof.

Then, as shown in FIG. 13D, the top surface of the resin substrate 102 is pushed against a mold 106, and heating and pressurizing processings are carried out. Thereafter, as shown in FIG. 13E, by separating the mold 106 from the resin substrate 102, the flow path substrate 72, in which the pressure chambers 50 and the nozzles 56 and the like are formed, is completed.

Figure 14A:
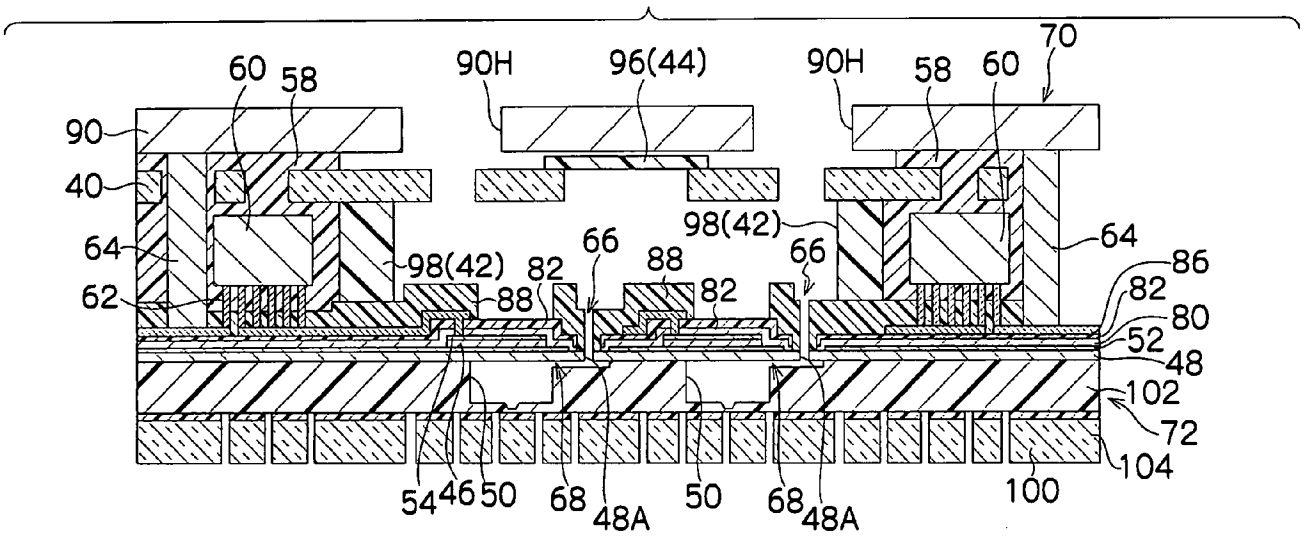
FIGS. 14A through 14F are diagrams explaining processes of joining the flow path substrate to the piezoelectric element substrate relating to the first embodiment of the present invention.

When the flow path substrate 72 is completed in this way, as shown in FIG. 14A, the piezoelectric element substrate 70 and the flow path substrate 72 are united (joined) by thermo-compression bonding.

Figure 14B:
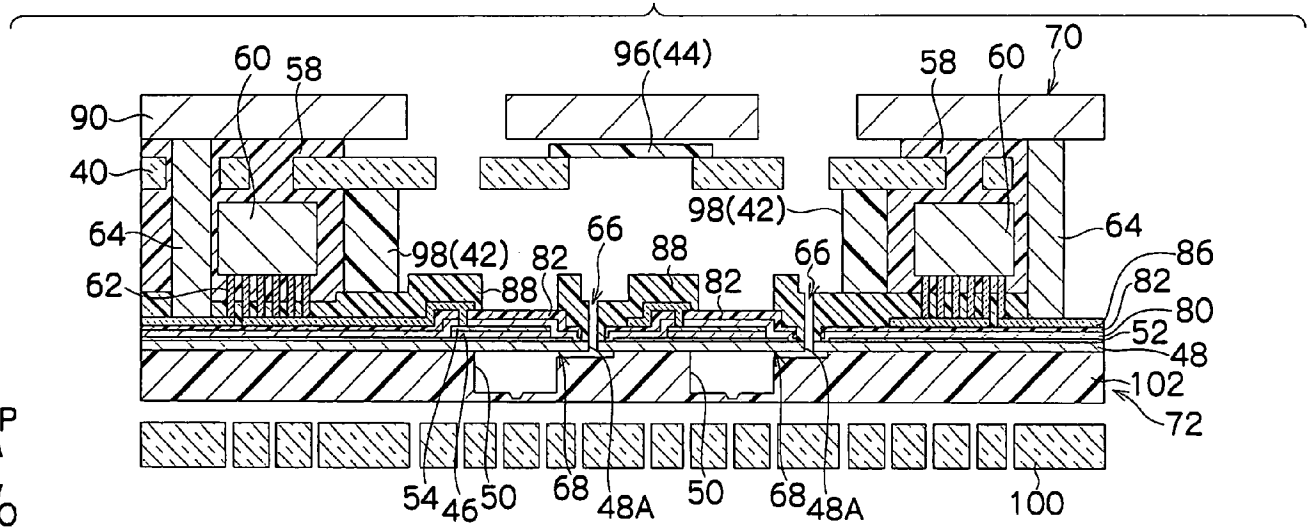

Next, as shown in FIG. 14B, by injecting-in an adhesive peeling solution from the through-holes 100A of the second supporting substrate 100 and selectively dissolving the adhesive 104, the second supporting substrate 100 is peeled-off from the flow path substrate 72.

Figure 14C:
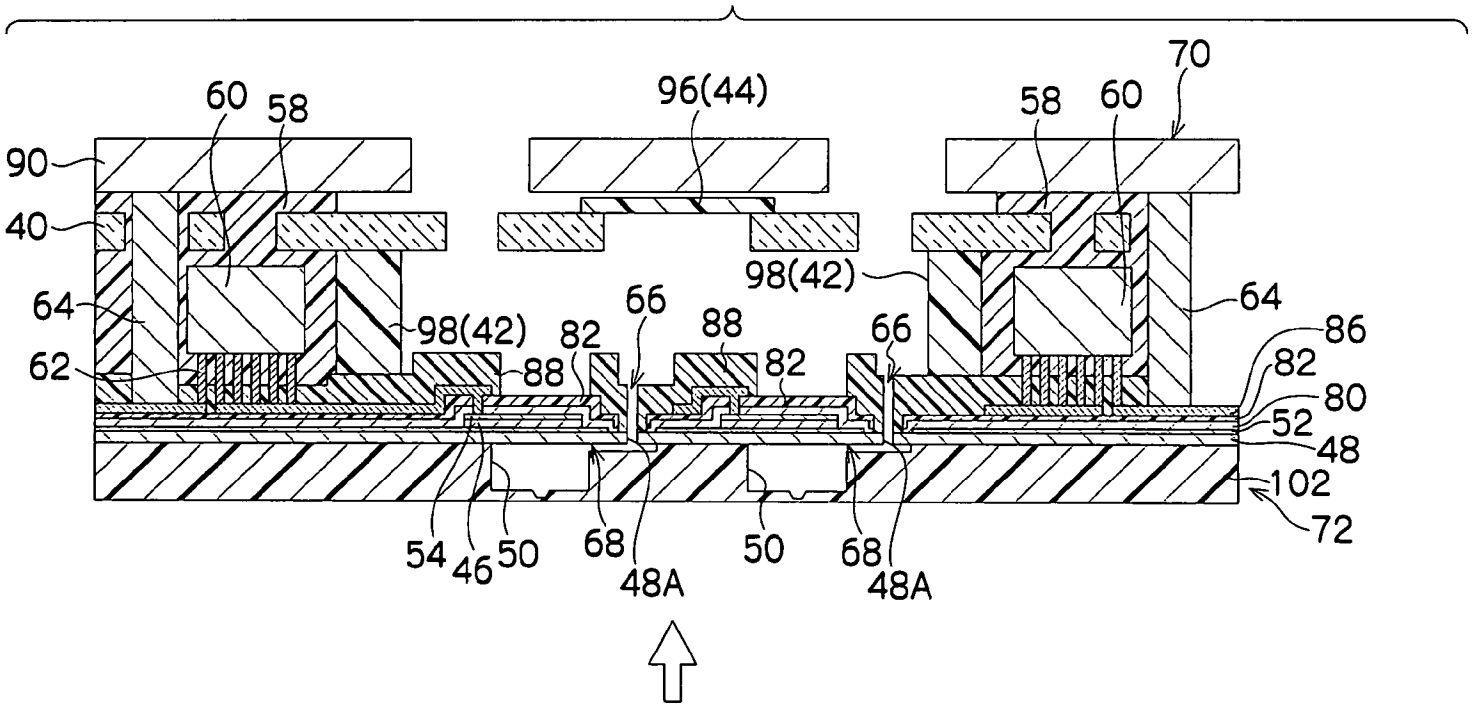
Figure 14D:
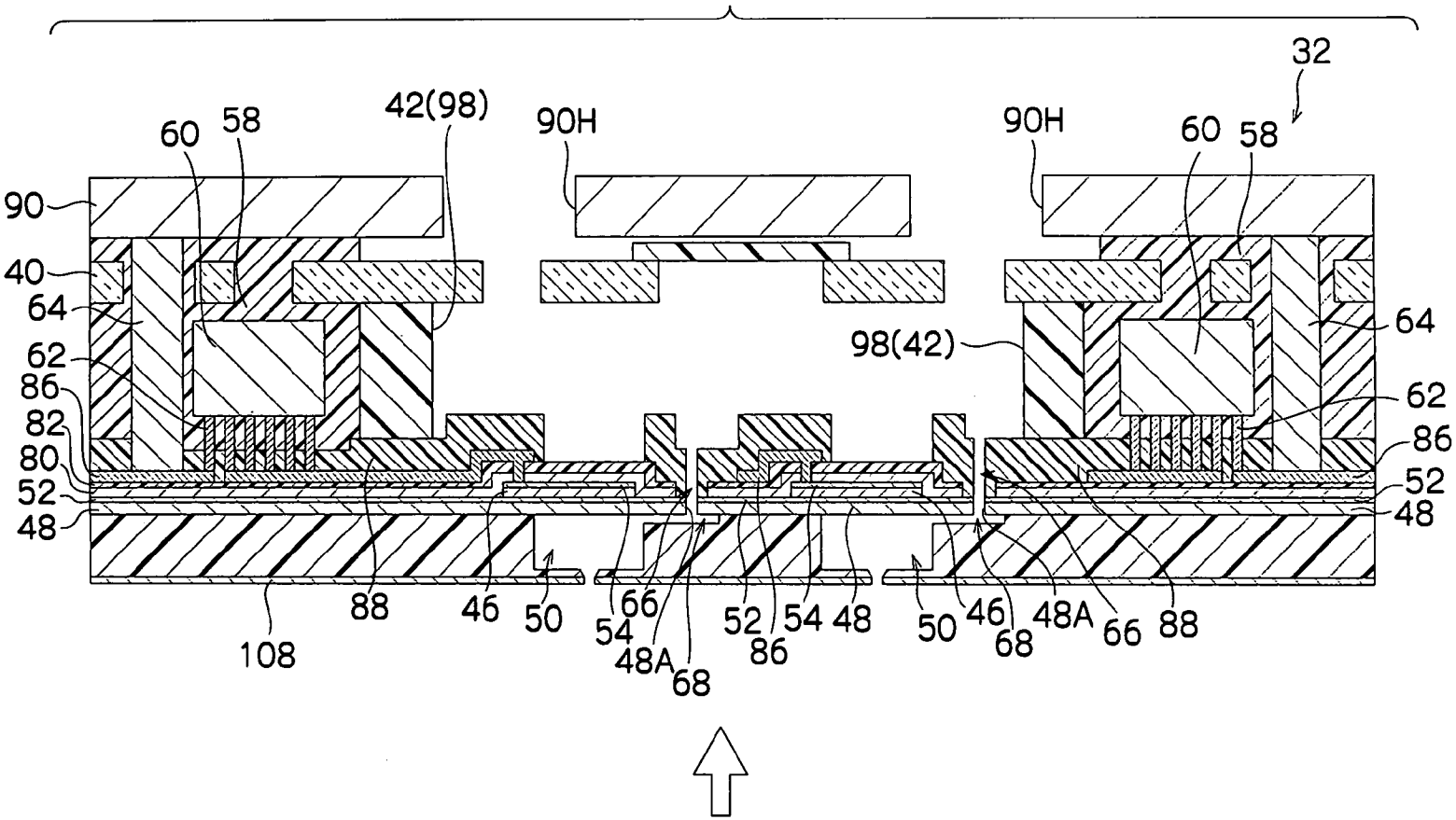
Figure 14E:
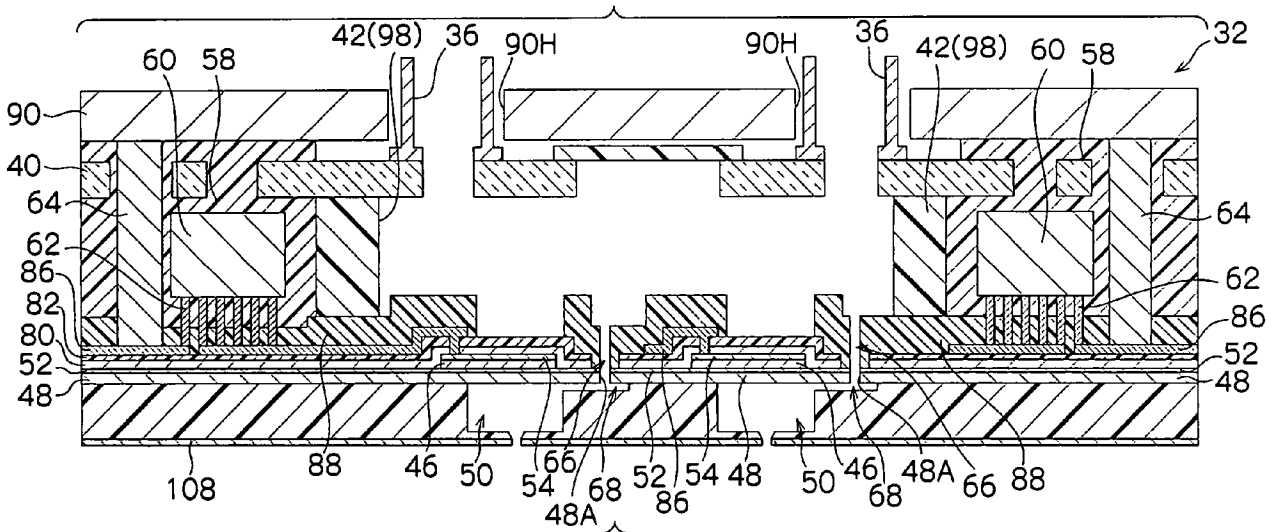
Figure 14F:
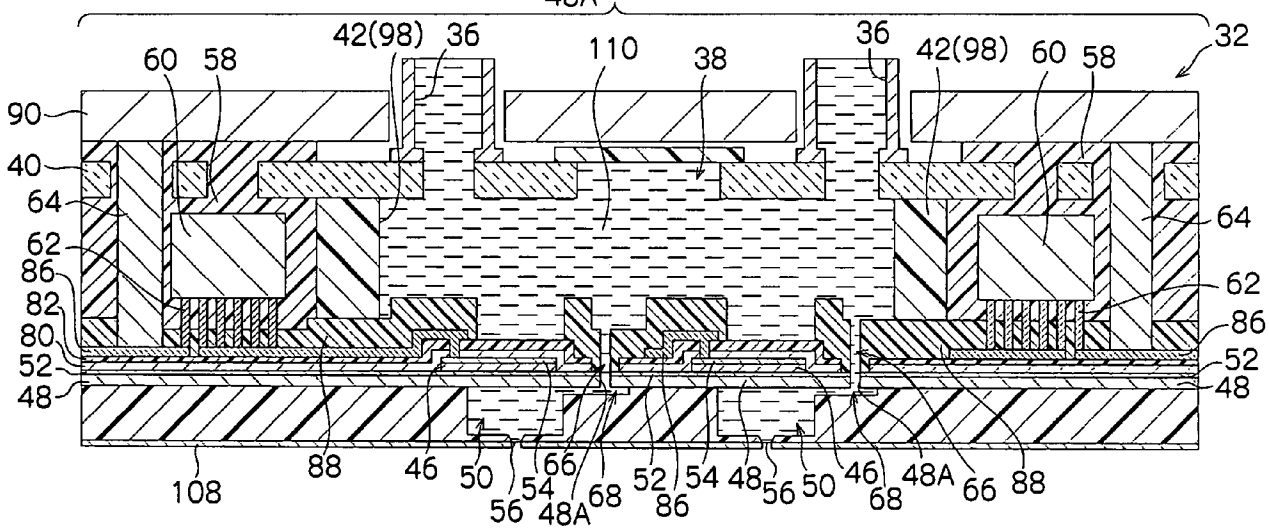

Thereafter, as shown in FIG. 14C, the surface from which the second supporting substrate 100 has been peeled-off is subjected to polishing processing using an abrasive whose main component is alumina, or to RIE processing using oxygen plasma. In this way, the surface layer is removed, and the nozzles 56 are opened. Then, as shown in FIG. 14D, a fluorine material 108 (e.g., Cytop manufactured by Asahi Glass Co., Ltd.), which serves as a water repellant, is applied onto the bottom surface where the nozzles 56 are open. Then, as shown in FIG. 14E, by inserting the ink supplying ports 36 through the insert-through holes 90H of the top plate member 90 and mounting the ink supplying ports 36 to the capping member 40, the inkjet recording head 32 is completed. As shown in FIG. 14F, the ink 110 can be filled into the ink pooling chamber 38 and the pressure chambers 50.

Figure 15:
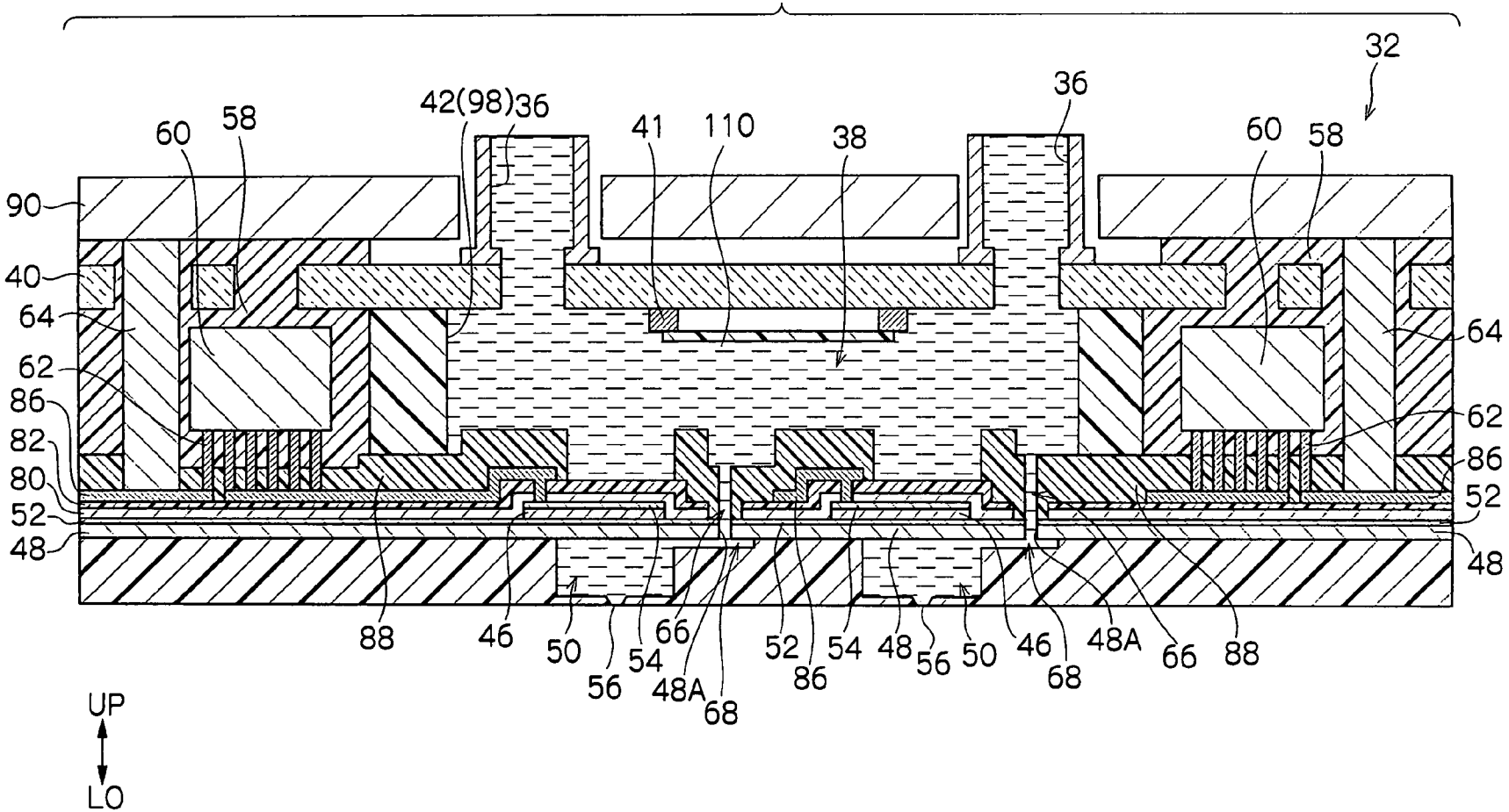
FIG. 15 is an explanatory diagram showing an inkjet recording head having a different air damper arrangement in the first embodiment of the present invention.

Note that the air damper 44 is not limited to the structure in which the photosensitive dry film 96 is affixed so as to cover the opening portion of the capping member 40. For example, as shown in FIG. 15, the air damper 44 may be substantially incorporated in the ink pooling chamber 38, via a supporting member 41 which is mounted to the capping member 40.

Next, operation of the inkjet recording device 10, which is provided with the inkjet recording head 32 which is manufactured as described above, will be described. First, when an electric signal instructing printing is sent to the inkjet recording device 10, one of the recording sheets P is picked-up from the sheet feed tray 26, and is conveyed to a predetermined position by the subscanning mechanism 18.

On the other hand, at the inkjet recording unit 30, the ink 110 has already been injected-in (filled-in) in the ink pooling chamber 38 of the inkjet recording head 32 from the ink tank 34 and via the ink supplying ports 36. The ink 110 which is filled in the ink pooling chamber 38 is supplied to (filled into) the pressure chambers 50 via the ink flow paths 66, 68. At this time, a meniscus, in which the surface of the ink 110 is slightly concave toward the pressure chamber 50 side, is formed at the distal end (the ejecting opening) of the nozzle 56.

Then, while the inkjet recording heads 32, which are installed in the carriage 12, move in the main scanning direction, due to ink drops being selectively ejected from the plural nozzles 56, a portion of the image based on the image data is recorded in a predetermined band region of the recording sheet P. Namely, voltage is applied to predetermined piezoelectric elements 46 at predetermined times by the driving ICs 60, the vibrating plate 48 is flexurally deformed in the top-bottom direction (is out-of-plane vibrated), pressure is applied to the ink 110 within the pressure chambers 50, and the ink 110 is ejected as ink drops from predetermined nozzles 56.

When a portion of the image based on the image data is recorded on the recording sheet P in this way, the recording sheet P is conveyed a predetermined pitch by the subscanning mechanism 18. In the same way as described above, due to ink drops being selectively ejected from the plural nozzles 56 again while the inkjet recording heads 32 move in the main scanning direction, a portion of the image based on the image data is recorded at the next band region of the recording sheet P. When these operations are repeatedly carried out and the image based on the image data is completely recorded on the recording sheet P, the subscanning mechanism 18 conveys the recording sheet P to the end and discharges the recording sheet P onto the sheet discharge tray 28. In this way, printing processing (image recording) onto the recording sheet P is completed.

Here, at the inkjet recording head 32, the ink pooling chamber 38 is provided at the side opposite the pressure chambers 50 (the top side), with the vibrating plate 48 (the piezoelectric elements 46) therebetween. In other words, the vibrating plate 48 (the piezoelectric elements 46) is disposed between the ink pooling chamber 38 and the pressure chambers 50, and the ink pooling chamber 38 and the pressure chambers 50 do not exist on the same horizontal plane. Accordingly, the pressure chambers 50 are disposed near to one another, and the nozzles 56 are disposed at a high density.

Further, the driving ICs 60, which apply voltage to the piezoelectric elements 46, are disposed between the vibrating plate 48 and the top plate member 90, and are not exposed (do not project) further outwardly than the vibrating plate 48 and the top plate member 90 (the driving ICs 60 are incorporated within the inkjet recording head 32). Accordingly, as compared with a case in which the driving ICs 60 are mounted on the exterior of the inkjet recording head 32, the lengths of the metal wires 86, which connect the piezoelectric elements 46 and the driving ICs 60, can be made to be short, and the metal wires 86 can thereby be made to have low resistance.

Namely, a high density of the nozzles 56, i.e., a high-density, matrix-like arrangement of the nozzles 56, can be realized at a practical wire resistance value. A higher resolution can thereby be realized. Further, the driving ICs 60 are flip-chip mounted on the piezoelectric element substrate 70 where the piezoelectric elements 46 and the like are formed at the vibrating plate 48. Therefore, high-density wire connections can be realized easily, and a reduction in the heights of the driving ICs 60 is also achieved (the driving ICs 60 can be made thinner). Accordingly, the inkjet recording head 32 can be made more compact. Concretely, in electrical connection by a conventional FPC method, the nozzle resolution is limited to 600 npi (nozzles per pitch). However, in the system of the present invention, a 1200 npi array can be achieved easily. Further, when compared with the case of the 600 npi nozzle array, the size can be made to be ½ or less because it suffices to not use an FPC.

Further, because the gaps around the driving ICs 60 are filled-in by the resin material 58, the bond strength between the top plate member 90 and the piezoelectric element substrate 70 increases. Moreover, the driving ICs 60 are sealed by the resin material 58. Therefore, the driving ICs 60 can be protected from the external environment such as moisture and the like. Further, because the metal wires 86, which are on the piezoelectric element substrate 70 and which connect the piezoelectric elements 46 and the driving ICs 60, are covered by the resin protective film 88, corrosion of the metal wires 86 due to the ink 110 can be prevented. Moreover, because the resin protective film 88 and the resin film 82, which sandwich and cover the metal wires 86, are formed of the same type of resin material, the coefficients of thermal expansion thereof are substantially equivalent, and therefore, there is little generation of thermal stress.

In the present invention, the capping member 40 of the ink pooling chamber 38 and the top plate member 90 of the inkjet recording head 32 are structured as separate members. Therefore, the ink pooling chamber 38 can be manufactured inexpensively. Further, the top plate member 90 can be structured optimally, such as the structure and materials which satisfy the requisite properties and characteristics can be selected or the like, without being affected by the capping member 40. When the top plate member 90 is structured by a PWB substrate as described above, a widely-used substrate can be used. Therefore, working and pattern formation of the top plate member 90 can be carried out easily, and the inkjet recording head 32 can be structured at a low cost. If, for example, a glass substrate is used as the top plate member 90 instead, because a photolithographic method of a semiconductor process can be applied, fine working and pattern formation on the glass substrate can be carried out easily. If a resin plate is used instead of a PWB substrate, molding of the top plate member 90 is easy, and the top plate member 90, i.e., the inkjet recording head 32, can be structured at a low cost.

Further, because the capping member 40 structuring the ink pooling chamber 38 is formed of glass and the partitioning wall member 42 is formed of resin, the ink sealability of the ink pooling chamber 38 can be maintained good.

Figure 16:
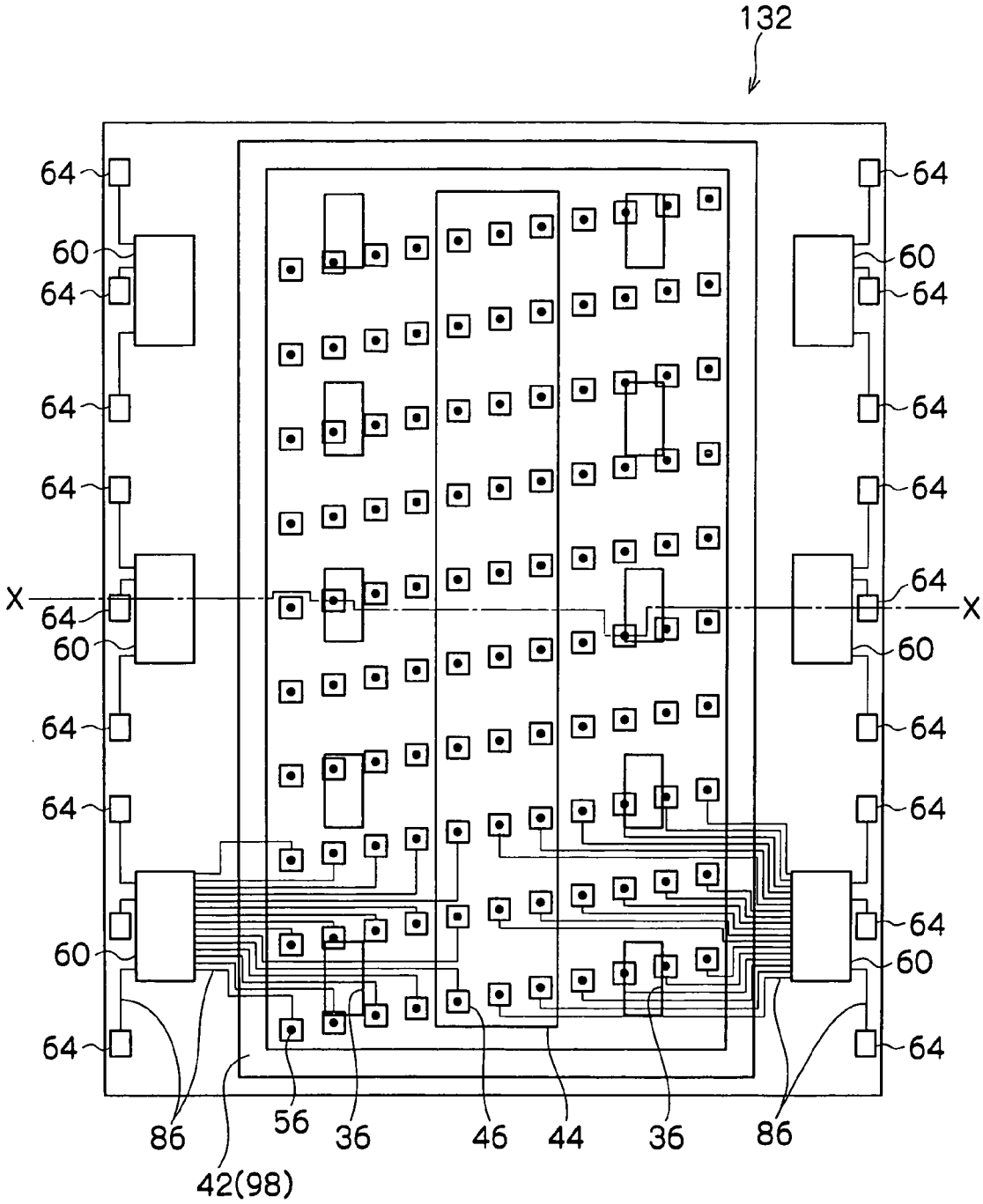
FIG. 16 is a schematic plan view showing the structure of an inkjet recording head of a second embodiment of the present invention.
Figure 17:
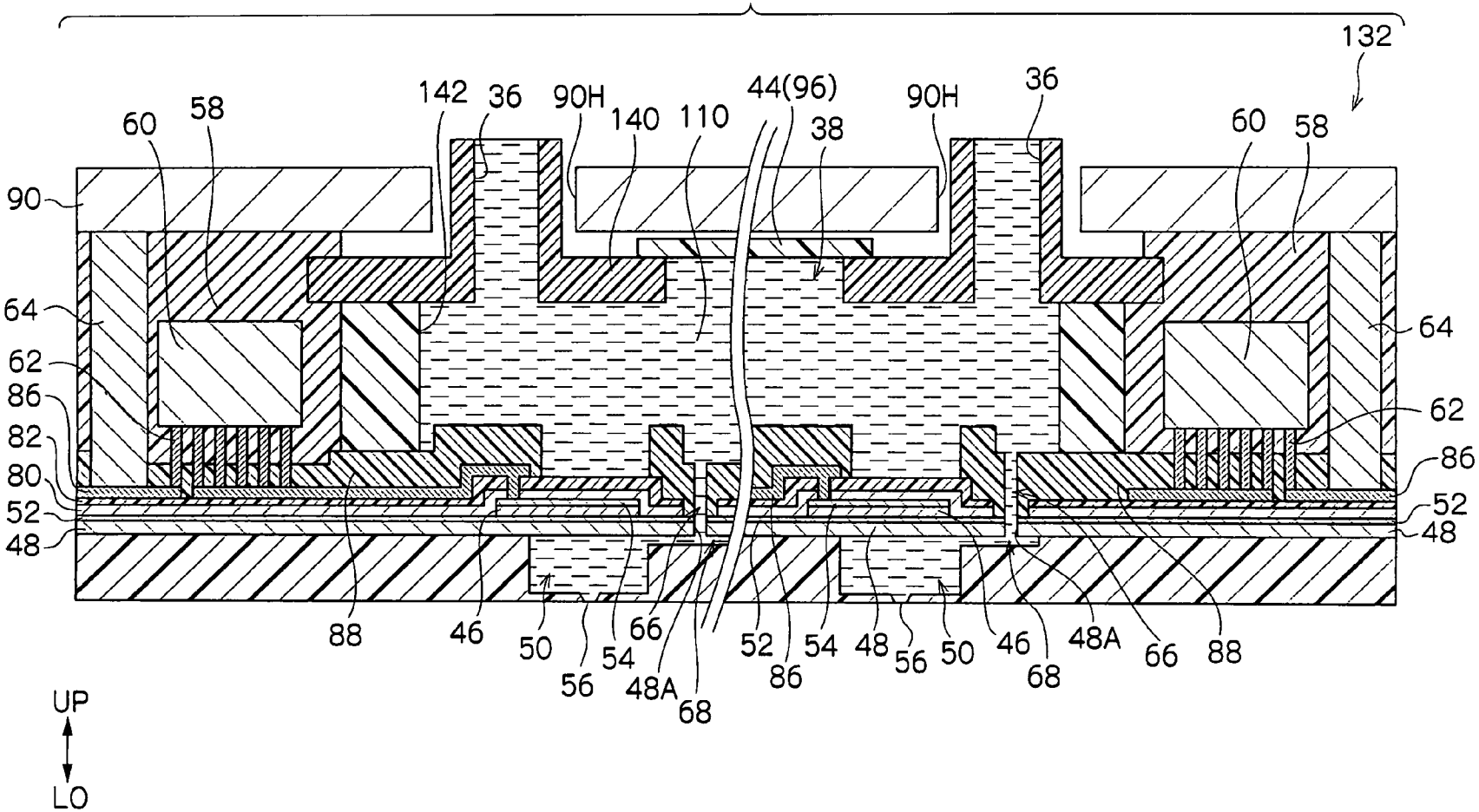
FIG. 17 is a schematic sectional view taken along line X-X of FIG. 16.

Next, an inkjet recording head 132 of a second embodiment, and the method of manufacture thereof, will be described. Note that the same structural elements as those of the inkjet recording head 32 of the first embodiment are denoted by the same reference numerals, and detailed description thereof is omitted. FIG. 16 is a schematic plan view showing the structure of the inkjet recording head 132, and FIG. 17 is a schematic sectional view taken along line X-X of FIG. 16.

The configuration and the volume of the ink pooling chamber 38 of the inkjet recording head 132 are regulated by a capping member 140, which is provided separately from the top plate member 90 and is disposed parallel to the top plate member 90, and a partitioning wall member 142 which is provided separately from the capping member 140 and is joined to the capping member 140. Plural ink supplying ports 36 are formed in lines at predetermined places of the capping member 140. Ink can be supplied to the ink pooling chamber 38 without the need for a new member for supplying ink.

The capping member 140 and the partitioning wall member 142 are joined together strongly by, for example, thermocompression bonding, such that the ink sealing ability of the ink pooling chamber 38 can be maintained good.

Next, the method of manufacturing the inkjet recording head 132 of the second embodiment will be described. Note that, in the following description, in the same way as in the first embodiment, a printed wiring board (a PWB substrate) is used as an example of the top plate member 90.

Figure 19:
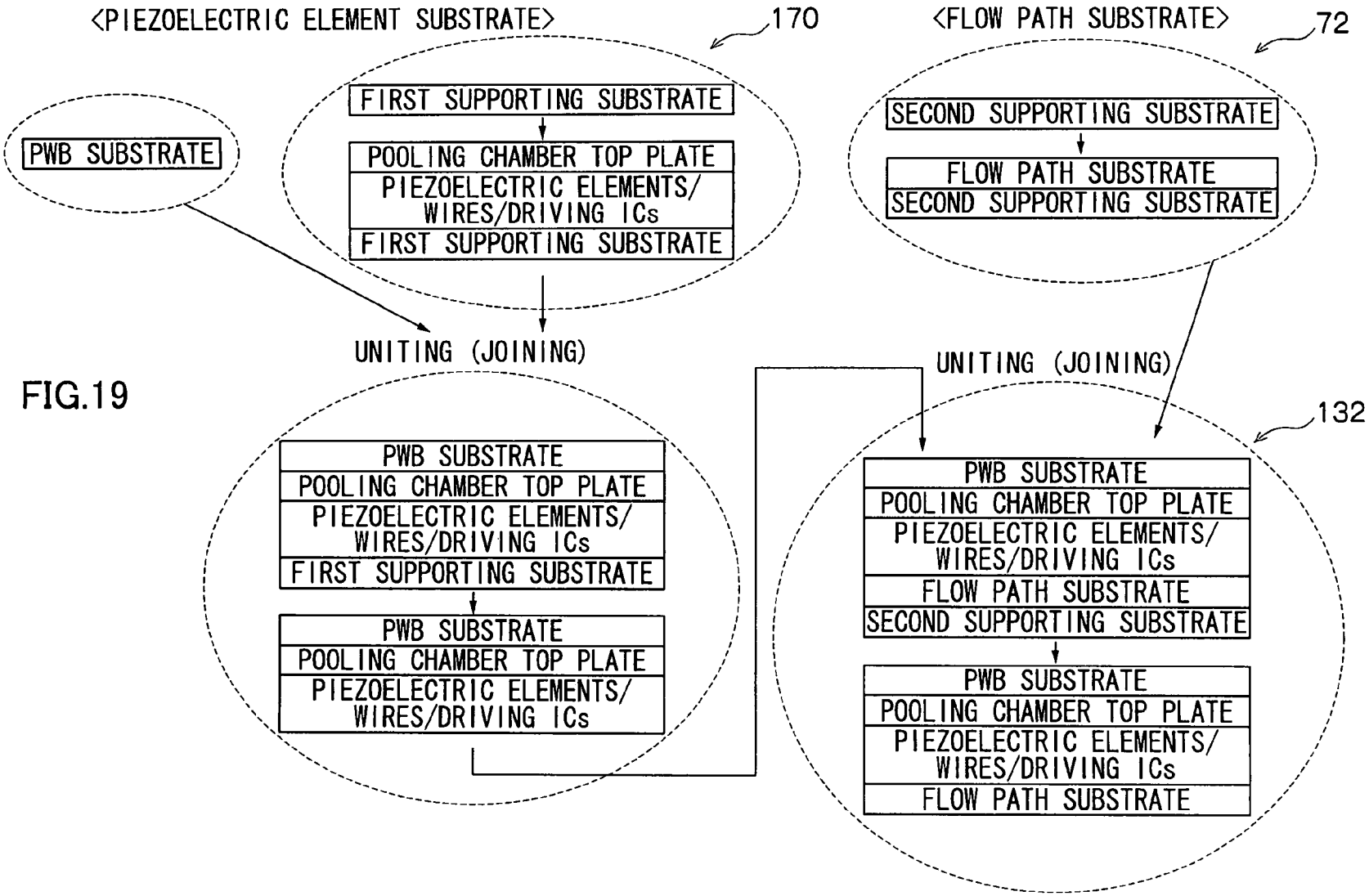
FIG. 19 is a diagram explaining the overall processes of manufacturing the inkjet recording head of the second embodiment of the present invention.

As shown in FIG. 19, in the same way as in the first embodiment, the inkjet recording head 132 is manufactured by fabricating a piezoelectric element substrate 170 and the flow path substrate 72 separately, and uniting (joining) the two together. The top plate member 90 (the PWB substrate) is united (joined) to the piezoelectric element substrate 170 before the flow path substrate 72.

Figures 20A, 20B, 20C, 20D, 20E, 20F:
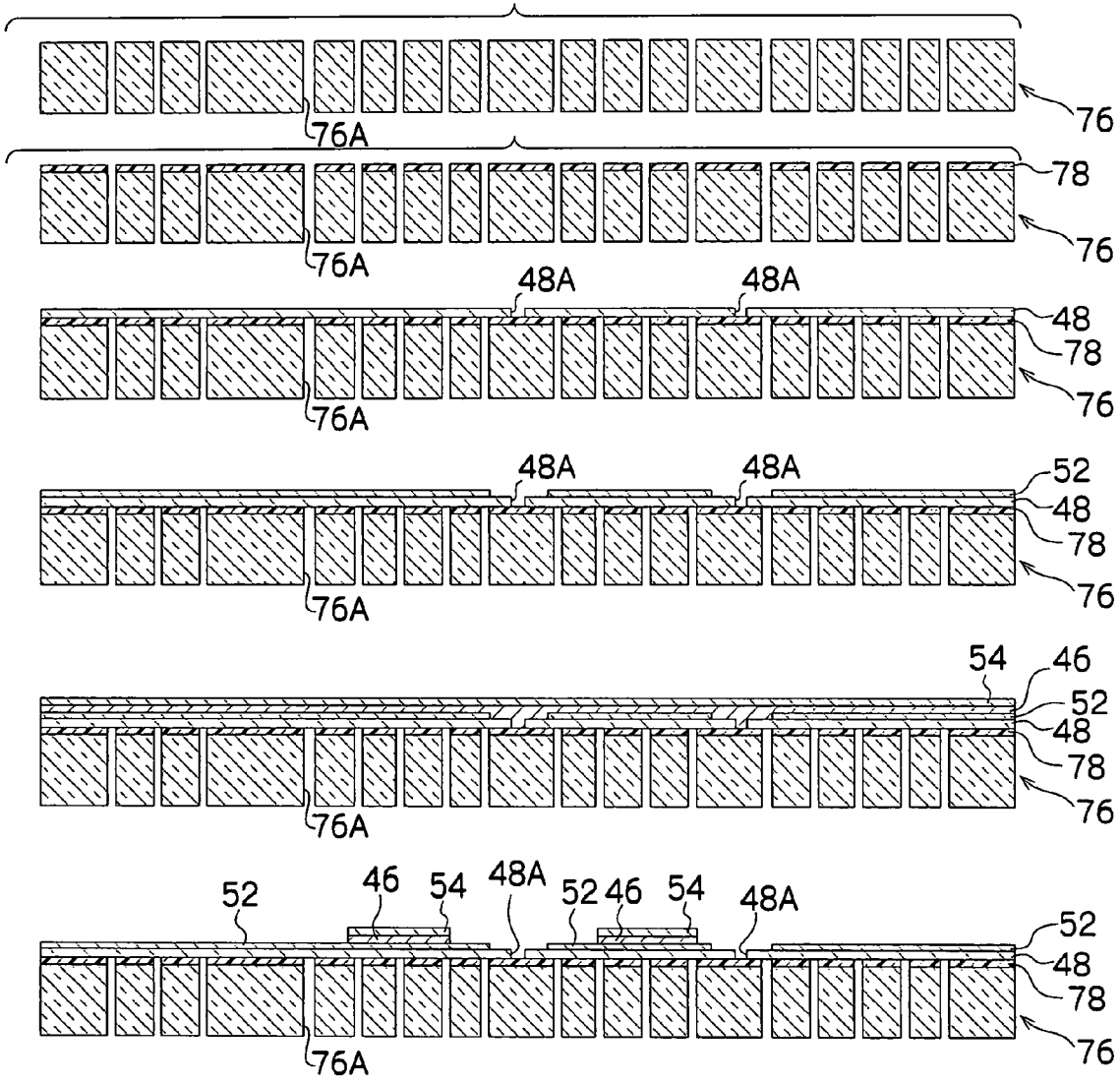
FIGS. 20A through 20M are diagrams explaining processes of manufacturing a piezoelectric element substrate relating to the second embodiment of the present invention.

As shown in FIG. 20A, first, the first supporting substrate 76, which is formed of glass and in which plural the through-holes 76A are formed, is prepared. As shown in FIG. 20B, the adhesive 78 is applied to the top surface (the obverse) of the first supporting substrate 76, and, as shown in FIG. 20C, the vibrating plate 48 is adhered on the top surface thereof.

Next, as shown in FIG. 20D, the lower electrode 52, which is layered on the top surface of the vibrating plate 48, is patterned. Then, as shown in FIG. 20E, a PZT film, which is the material of the piezoelectric elements 46, and the upper electrodes 54 are layered in that order by sputtering on the top surface of the lower electrode 52. As shown in FIG. 20F, the piezoelectric elements 46 (the PZT film) and the upper electrodes 54 are patterned.

Figures 20G, 20H, 20I, 20J:
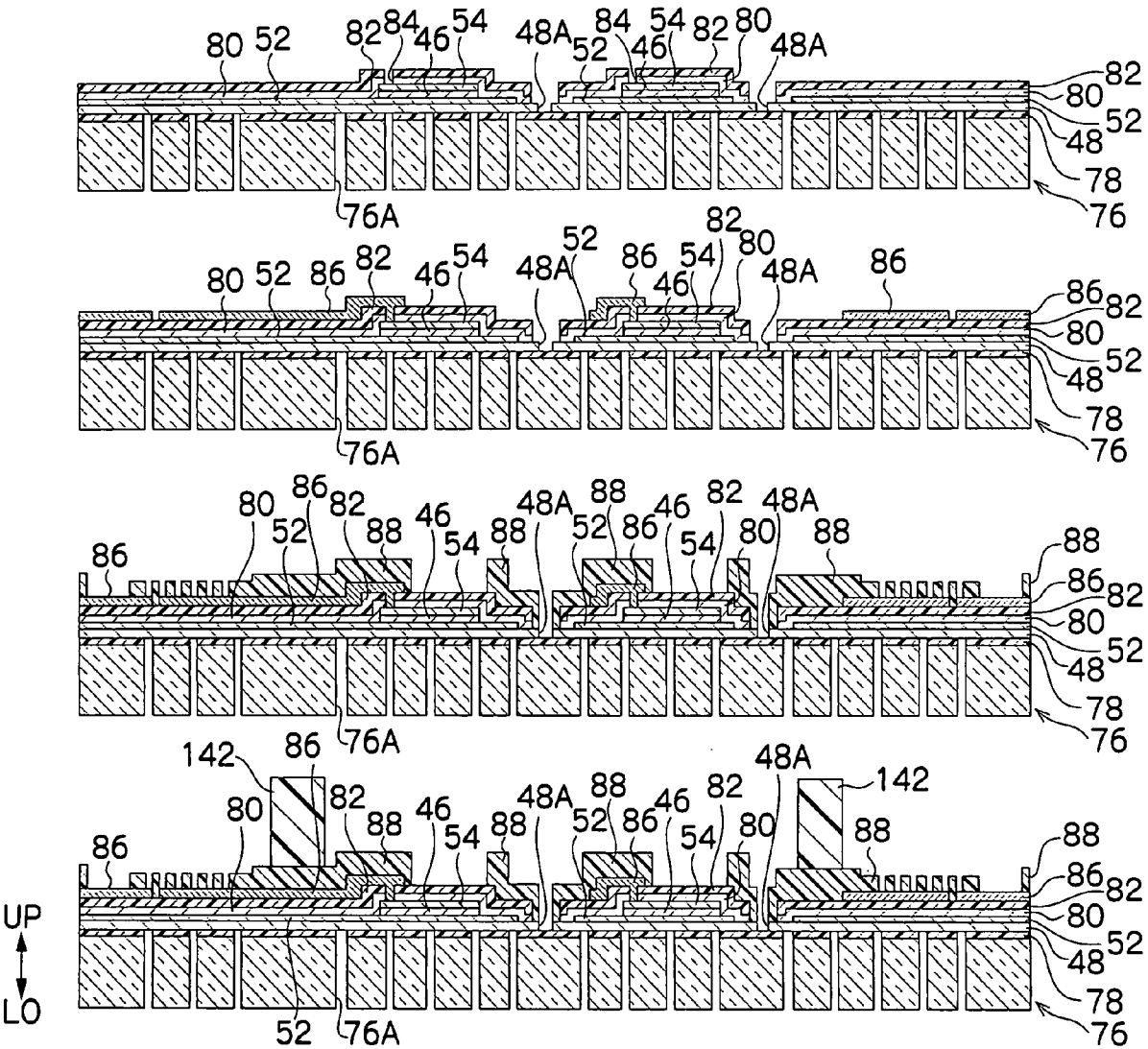

Thereafter, as shown in FIG. 20G, the low water permeable insulating film ($SiO_x$ film) 80 is layered on the top surfaces of the lower electrode 52 and the upper electrodes 54 which are exposed at the top surface, and the resin film 82 is layered on the top surface of this low water permeable insulating film ($SiO_x$ film) 80. By patterning these, the openings 84 (contact holes) for connecting the piezoelectric elements 46 and the metal wires 86 are formed.

Next, as shown in FIG. 20H, a metal film is layered on the top surfaces of the resin film 82 and the upper electrodes 54 within the openings 84, and the metal wires 86 are patterned.

Then, as shown in FIG. 20I, the resin protective film 88 is layered on the top surfaces of the metal wires 86 and the resin film 82, and is patterned.

Next, as shown in FIG. 20J, the photosensitive resin, which will become the partitioning wall member 142, is patterned on the resin protective film 88.

Figure 20K:
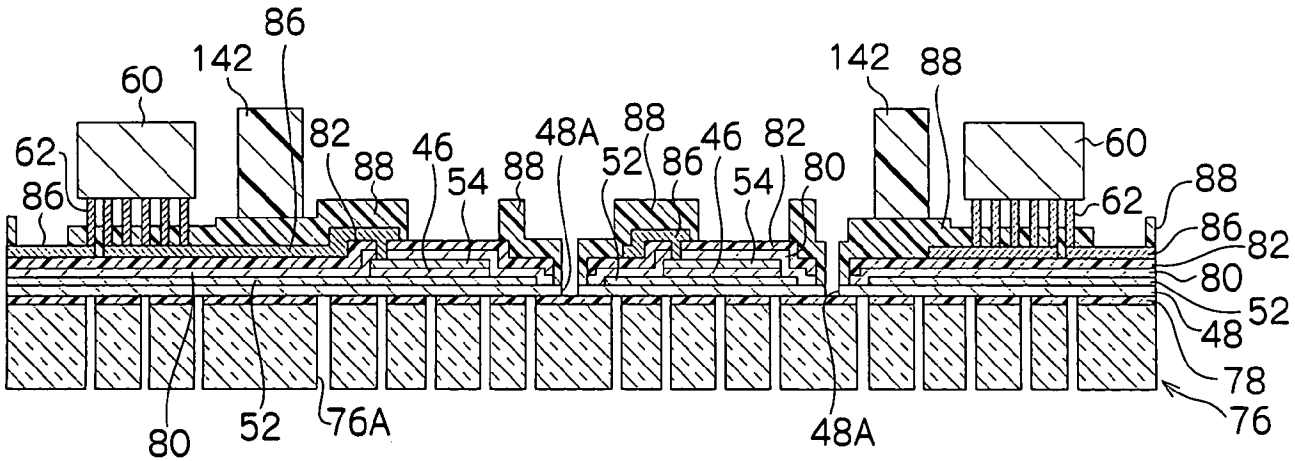

Then, as shown in FIG. 20K, the driving ICs 60 are flip-chip mounted on the metal wires 86 via the bumps 62.

Figure 20L:
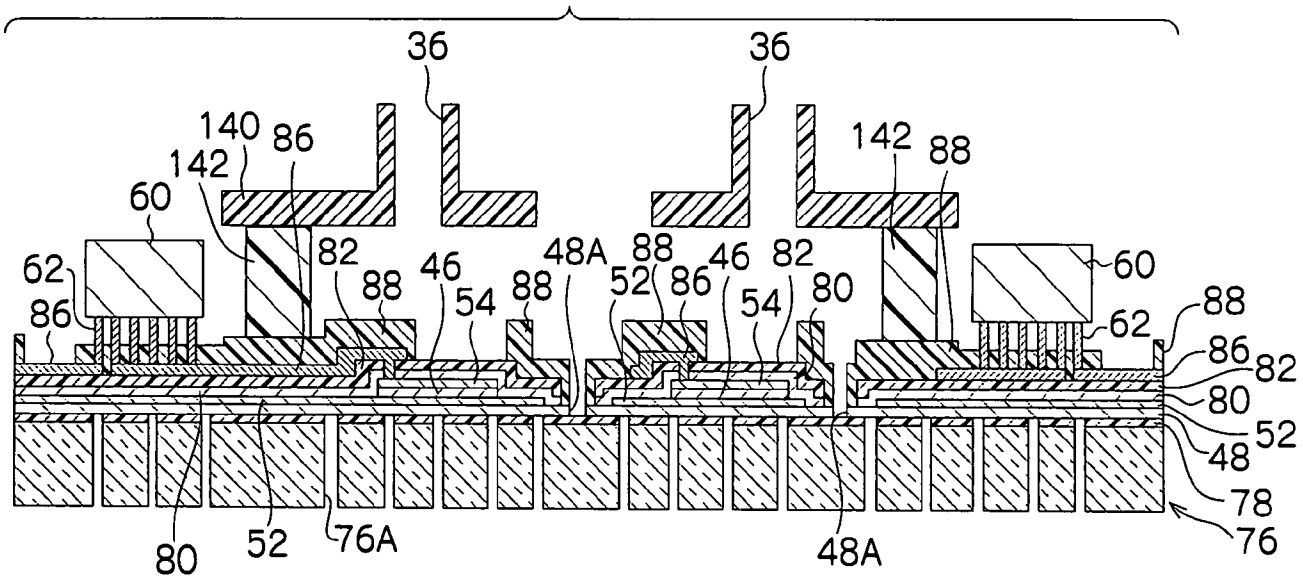

The above-described processes are substantially similar to those of the inkjet recording head 32 of the first embodiment. However, in the processes of manufacturing the inkjet recording head 132 of the second embodiment, in addition, as shown in FIG. 20L, a resin plate, which will become the capping member 140, is joined (e.g., thermocompression bonded) to the partitioning wall member 142. Note that the tubular ink supplying ports 36, which are for supplying the ink to the ink pooling chamber 38, are formed in advance in this resin plate.

Figure 20M:
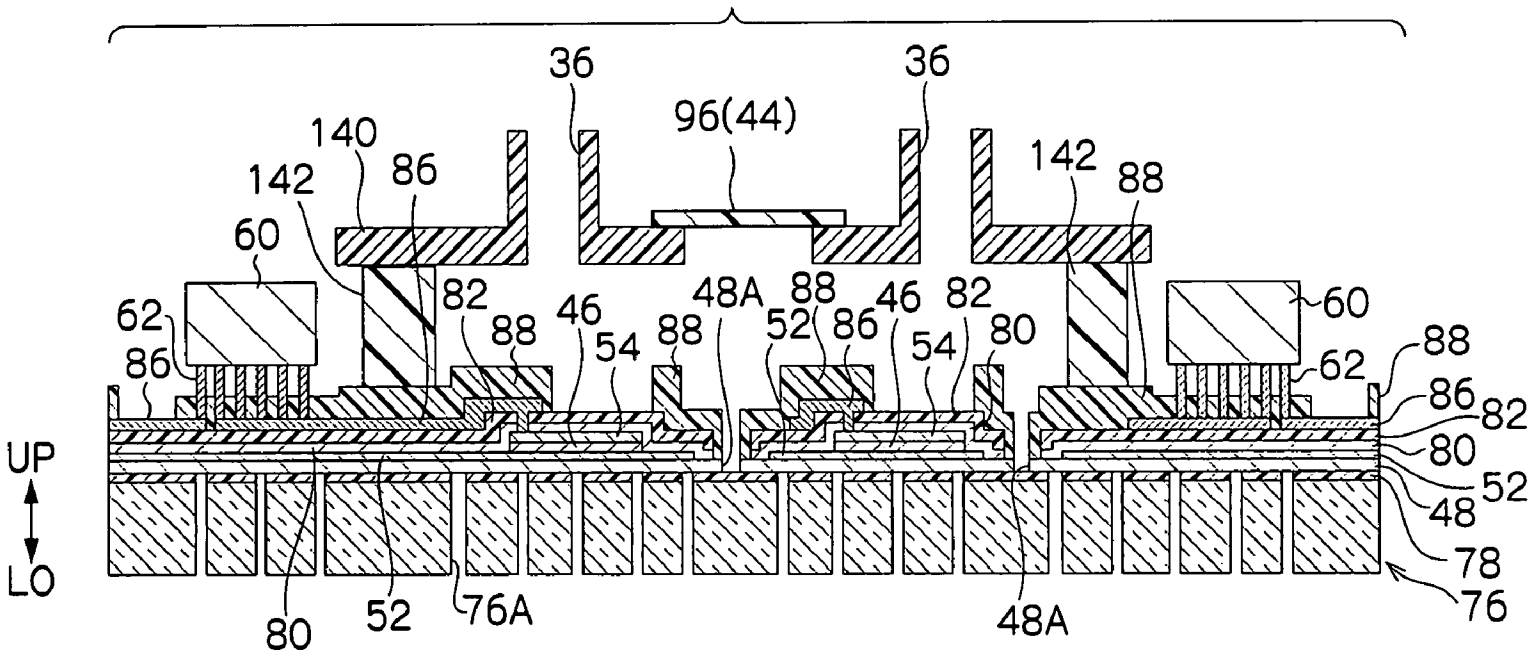

Then, as shown in FIG. 20M, the photosensitive dry film 96 is affixed to the opening portion of the capping member 140. The air damper 44 shown in FIG. 17 is provided by this photosensitive dry film 96.

In this way, the piezoelectric element substrate 170 is manufactured, and the PWB substrate which is the top plate member 90 is united (joined) to this piezoelectric element substrate 170.

Because the top plate member 90 can be manufactured in the same way as in the first embodiment, description of the manufacturing processes thereof is omitted.

Figure 21A:
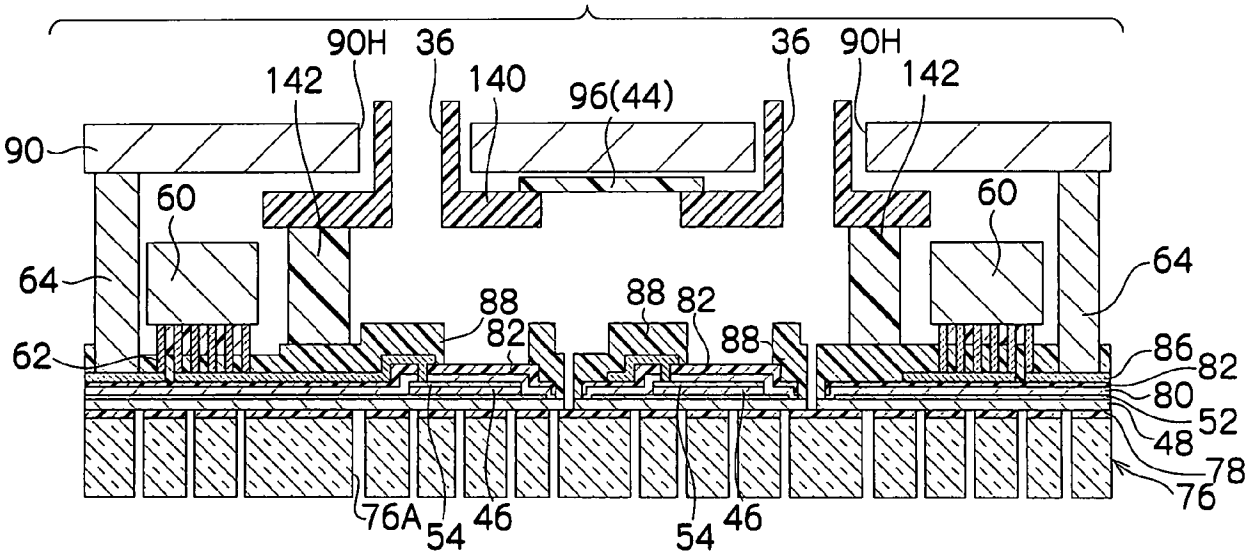
FIGS. 21A through 21D are diagrams explaining processes of joining a top plate member to the piezoelectric element substrate relating to the second embodiment of the present invention.

When the top plate member 90 is completed, as shown in FIG. 21A, the top plate member 90 is placed on the piezoelectric element substrate 170, and the both are united (joined) together by thermocompression bonding. Namely, the bumps 64 are joined to the metal wires 86.

At this time, the heights of the bumps 64 are higher than the combined thicknesses of the capping member 140, the partitioning wall member 142, and the photosensitive dry film 96. Therefore, the bumps 64 are automatically joined to the metal wires 86.

Figure 18:
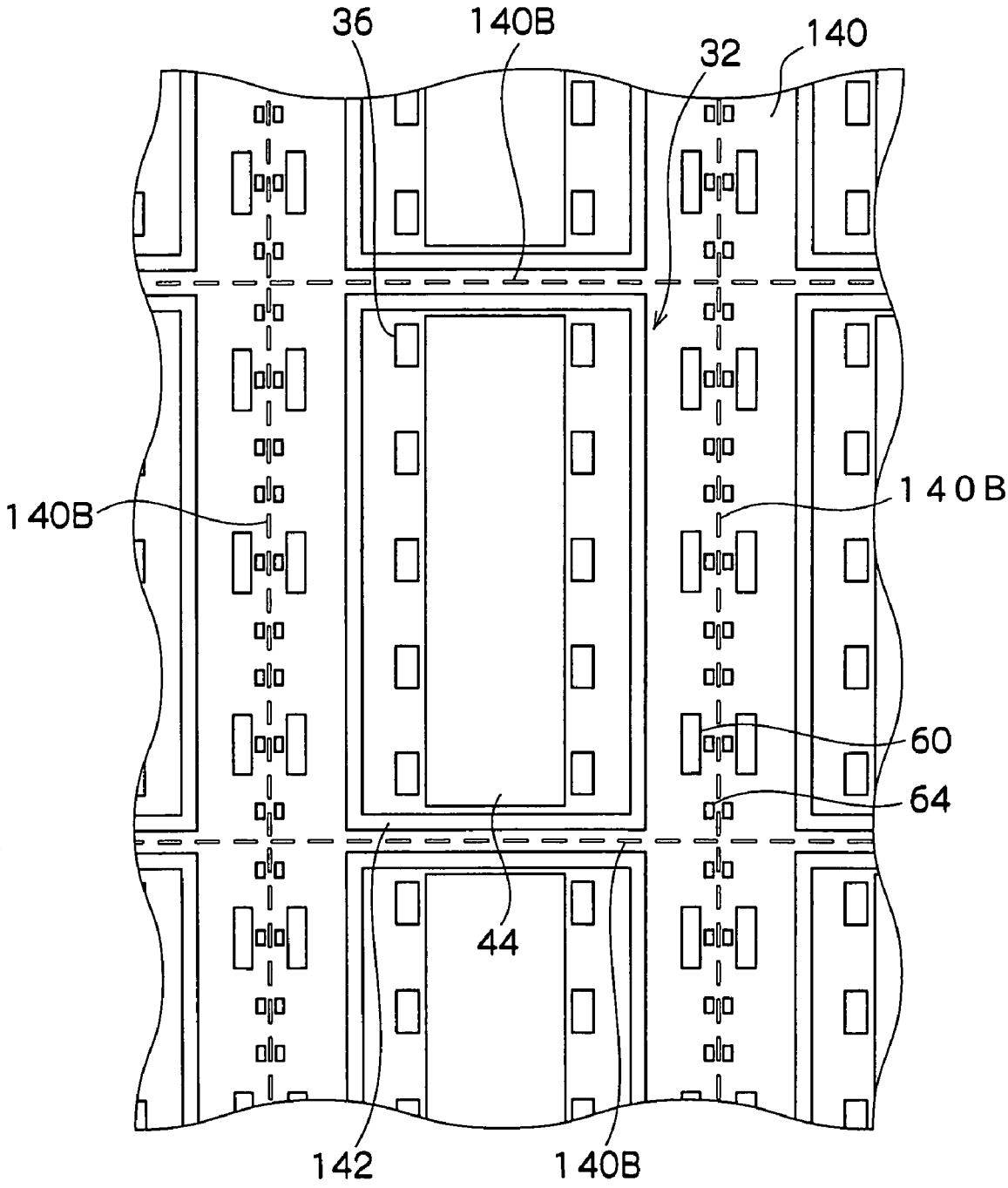
FIG. 18 is a schematic plan view showing a top plate before being cut as the inkjet recording heads relating to the second embodiment of the present invention.
Figure 21B:
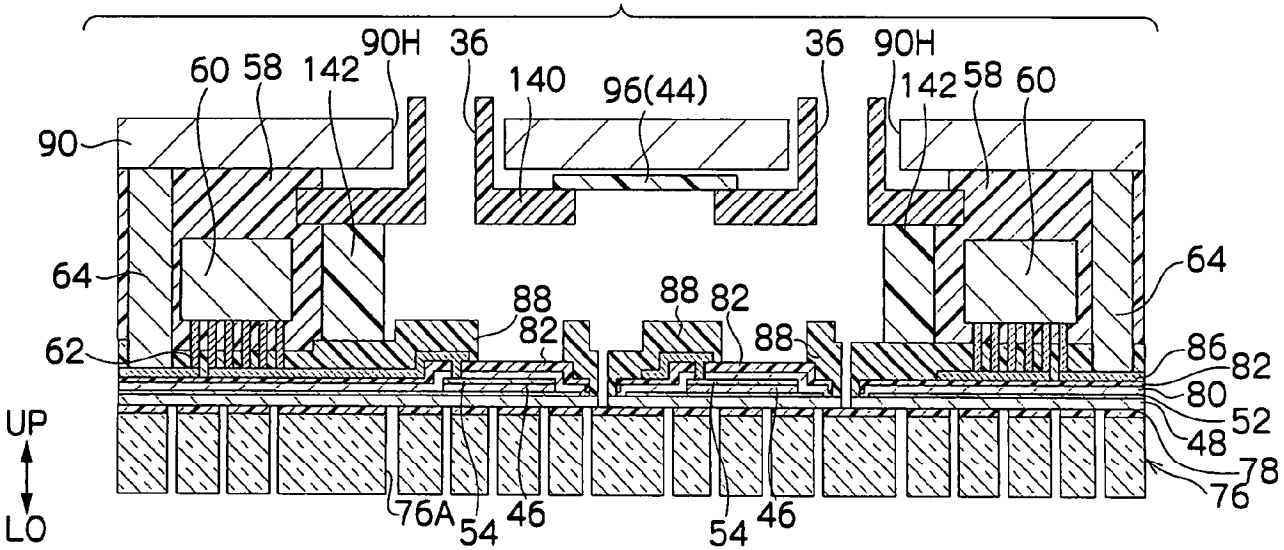

When the joining of the partitioning wall member 142 and the bumps 64 is completed, as shown in FIG. 21B, the resin material 58 for sealing (e.g., an epoxy resin) is injected-in at the driving ICs 60. Namely, the resin material 58 is made to flow-in from the injection openings 140B (see FIG. 18) which are formed in the top plate member 90.

Figure 21C:
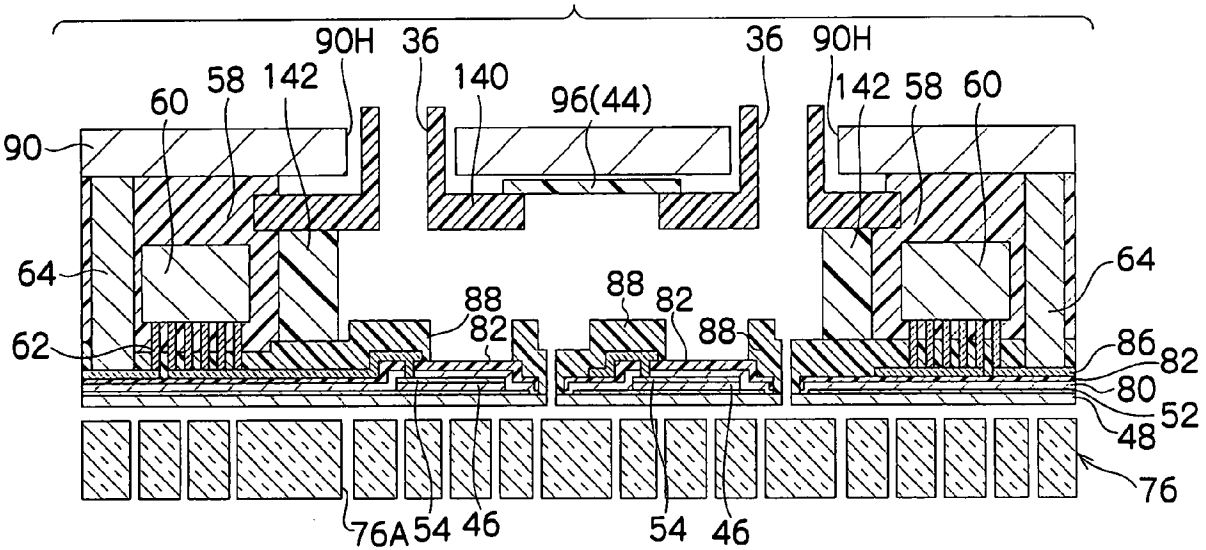
Figure 21D:
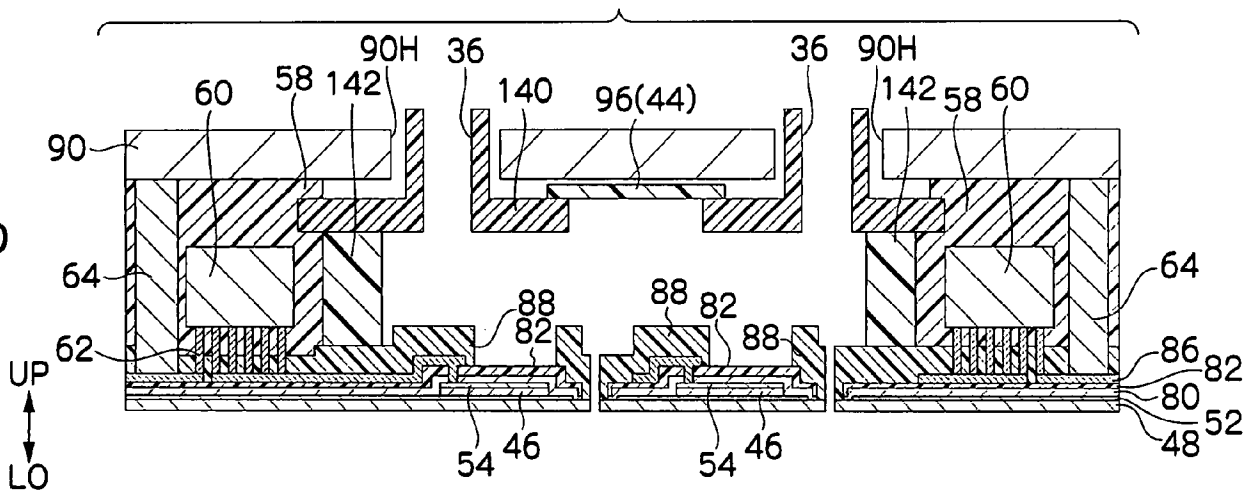

Next, as shown in FIG. 21C, an adhesive peeling solution is injected-in from the through-holes 76A of the first supporting substrate 76, and the first supporting substrate 76 is peeled-off from the piezoelectric element substrate 170. In this way, as shown in FIG. 21D, the piezoelectric element substrate 170, with which the top plate member 90 is united (joined), is completed. Then, from this state, the top plate member 90 becomes the supporting body of the piezoelectric element substrate 170.

Because the flow path substrate 72 can be manufactured in the same way as in the first embodiment, description of the manufacturing processes thereof is omitted.

Figure 22A:
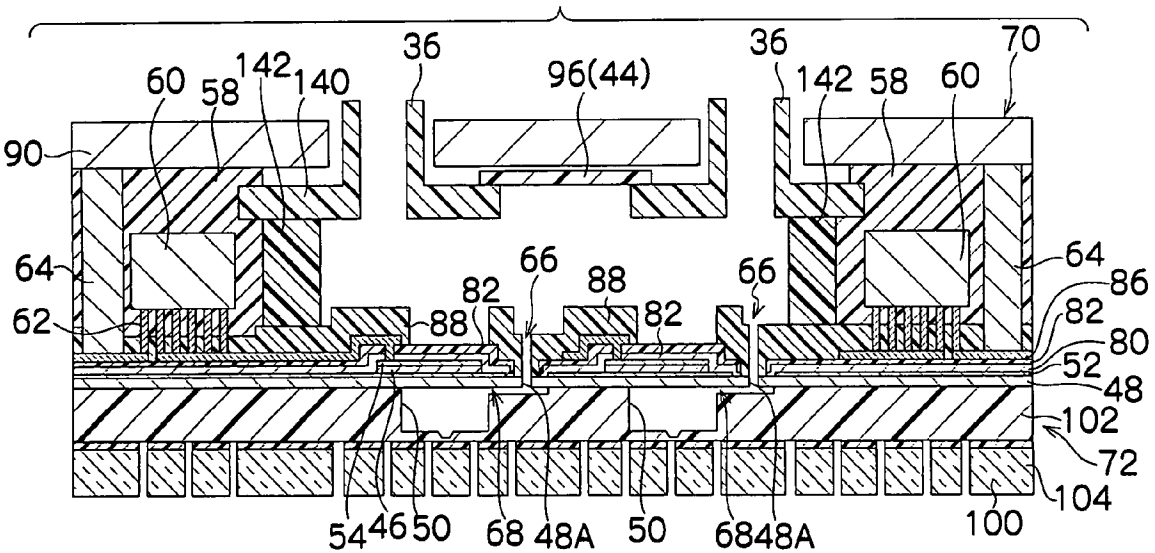
FIGS. 22A through 22E are diagrams explaining processes of joining a flow path substrate to the piezoelectric element substrate relating to the second embodiment of the present invention.

When the flow path substrate 72 is completed, as shown in FIG. 22A, the piezoelectric element substrate 170 and the flow path substrate 72 are united (joined) together by thermocompression bonding.

Figure 22B:
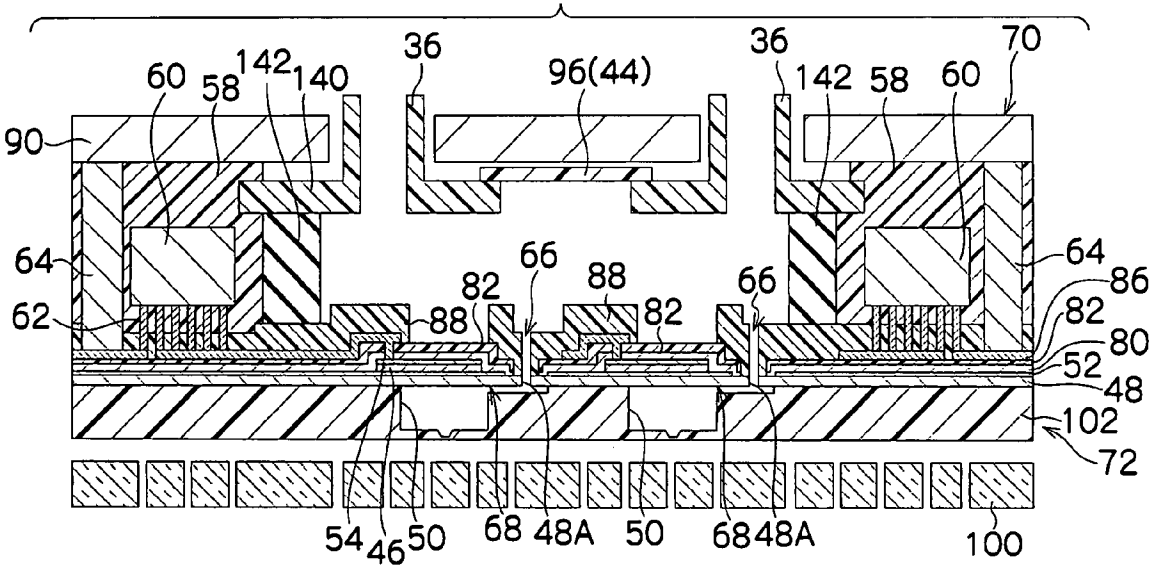

Next, as shown in FIG. 22B, an adhesive peeling solution is injected-in from the through-holes 100A of the second supporting substrate 100, and the second supporting substrate 100 is peeled-off from the flow path substrate 72.

Figure 22C:
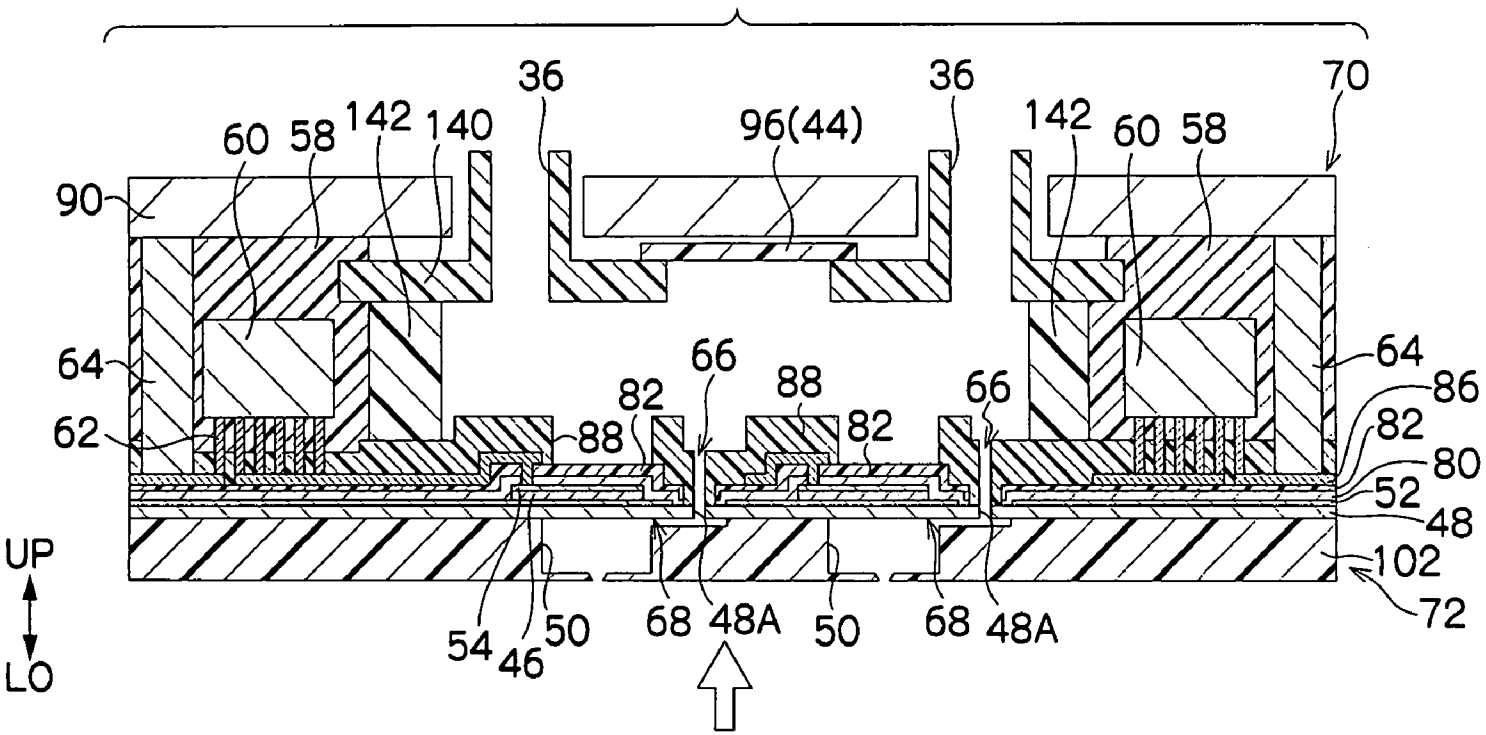
Figure 22D:
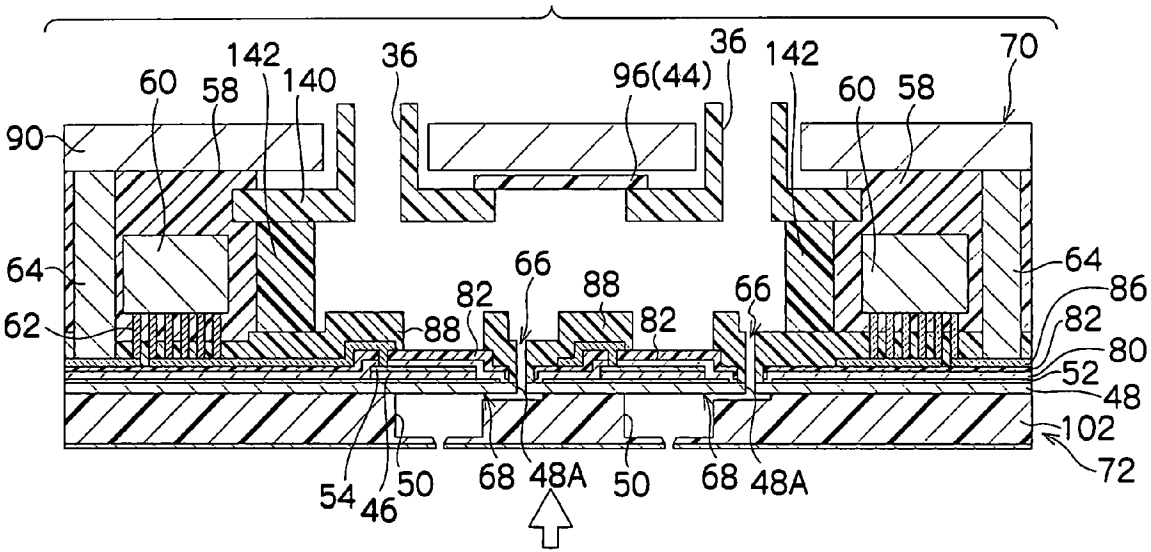
Figure 22E:
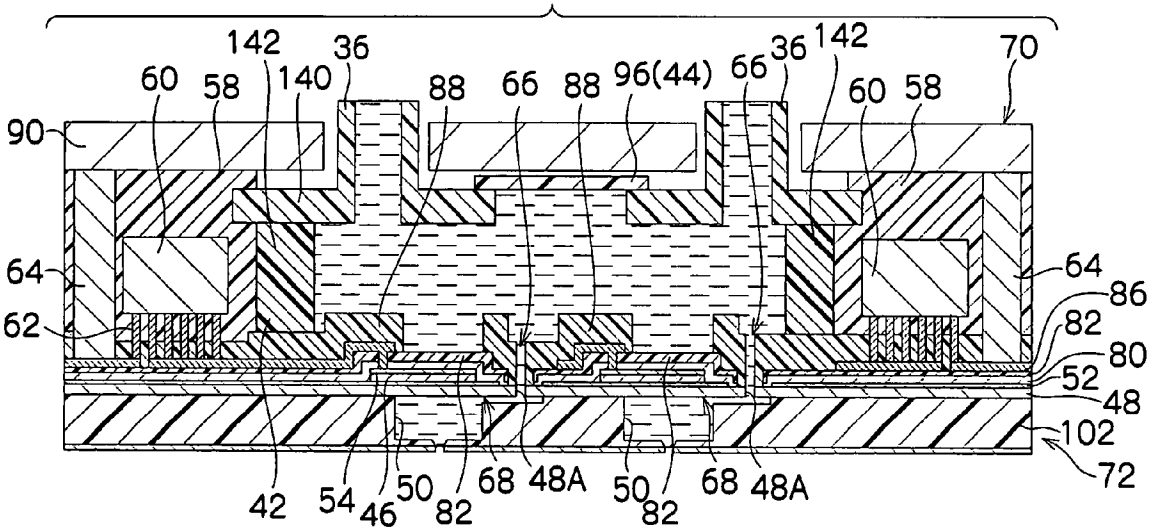

Thereafter, as shown in FIG. 22C, the surface from which the second supporting substrate 100 has been peeled-off is subjected to polishing processing using an abrasive whose main component is alumina, or to RIE processing using oxygen plasma. In this way, the surface layer is removed, and the nozzles 56 are opened. Then, as shown in FIG. 22D, by applying the fluorine material 108 (e.g., Cytop manufactured by Asahi Glass Co., Ltd.), which serves as a water repellant, onto the bottom surface where the nozzles 56 are open, the inkjet recording head 132 is completed. As shown in FIG. 22E, the ink 110 can be filled into the ink pooling chamber 38 and the pressure chambers 50.

Figure 23:
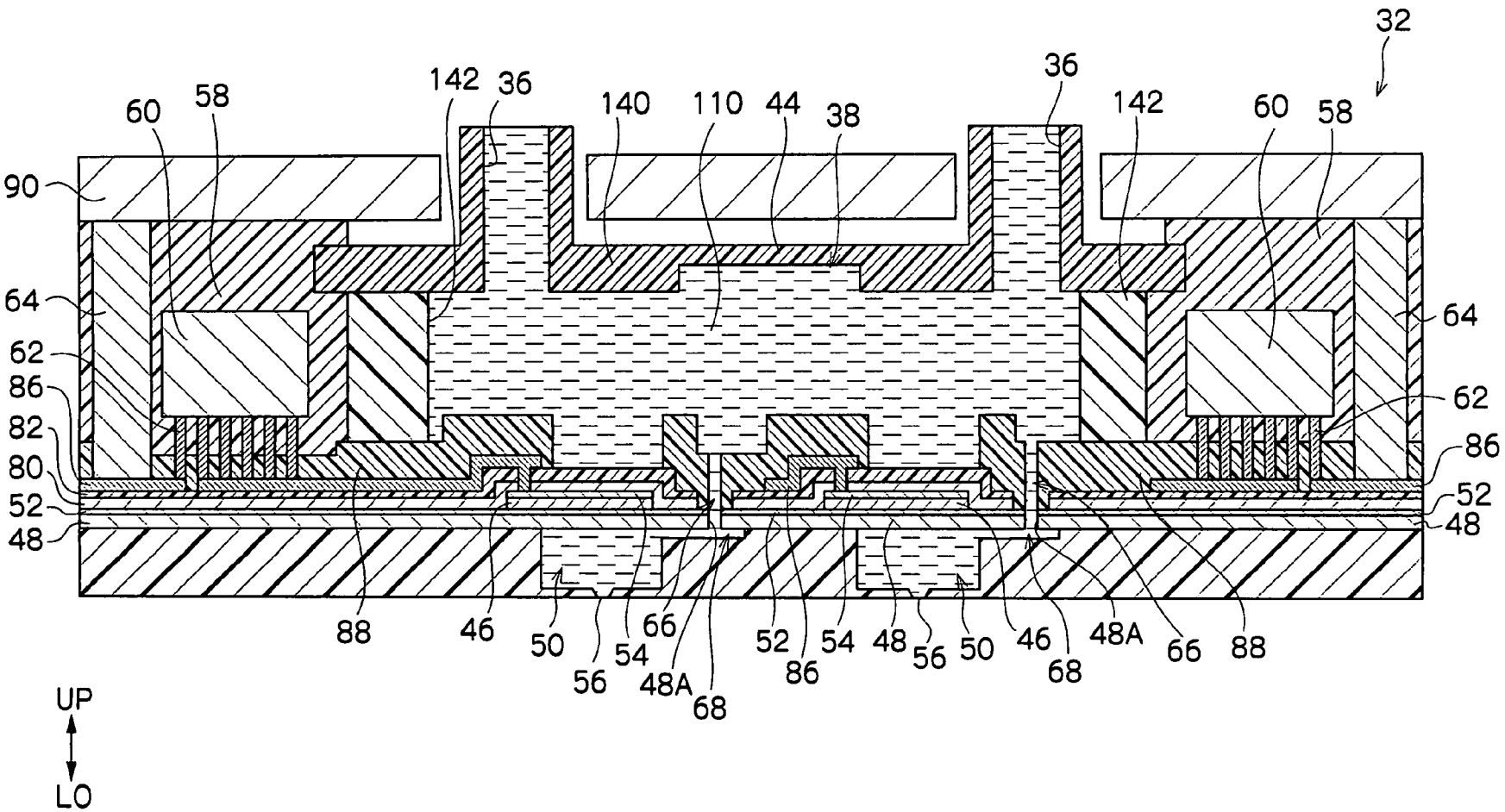
FIG. 23 is an explanatory diagram showing an inkjet recording head having a different air damper arrangement in the second embodiment of the present invention.

Note that the air damper 44 is not limited to the structure in which the photosensitive dry film 96 is affixed so as to cover the opening portion of the capping member 140. For example, as shown in FIG. 23, by making the thickness of the capping member 140 thin locally, the air damper 44 can be formed integrally with the capping member 140.

An inkjet recording device provided with the inkjet recording head 132 of the second embodiment, which is manufactured as described above, carries out printing processing (image recording) onto the recording sheet P in the same way as the inkjet recording device 10 provided with the inkjet recording head 32 of the first embodiment, and has similar operation and effects as the first embodiment.

In particular, in the second embodiment, because the capping member 140 and the partitioning wall member 142, which structure the ink pooling chamber 38, are both formed of resin, the ink pooling chamber 38 can be structured inexpensively. By strongly joining the capping member 140 and the partitioning wall member 142 together by thermocompression bonding or the like, the sealability (ink sealability) can be maintained good.

Figure 24:
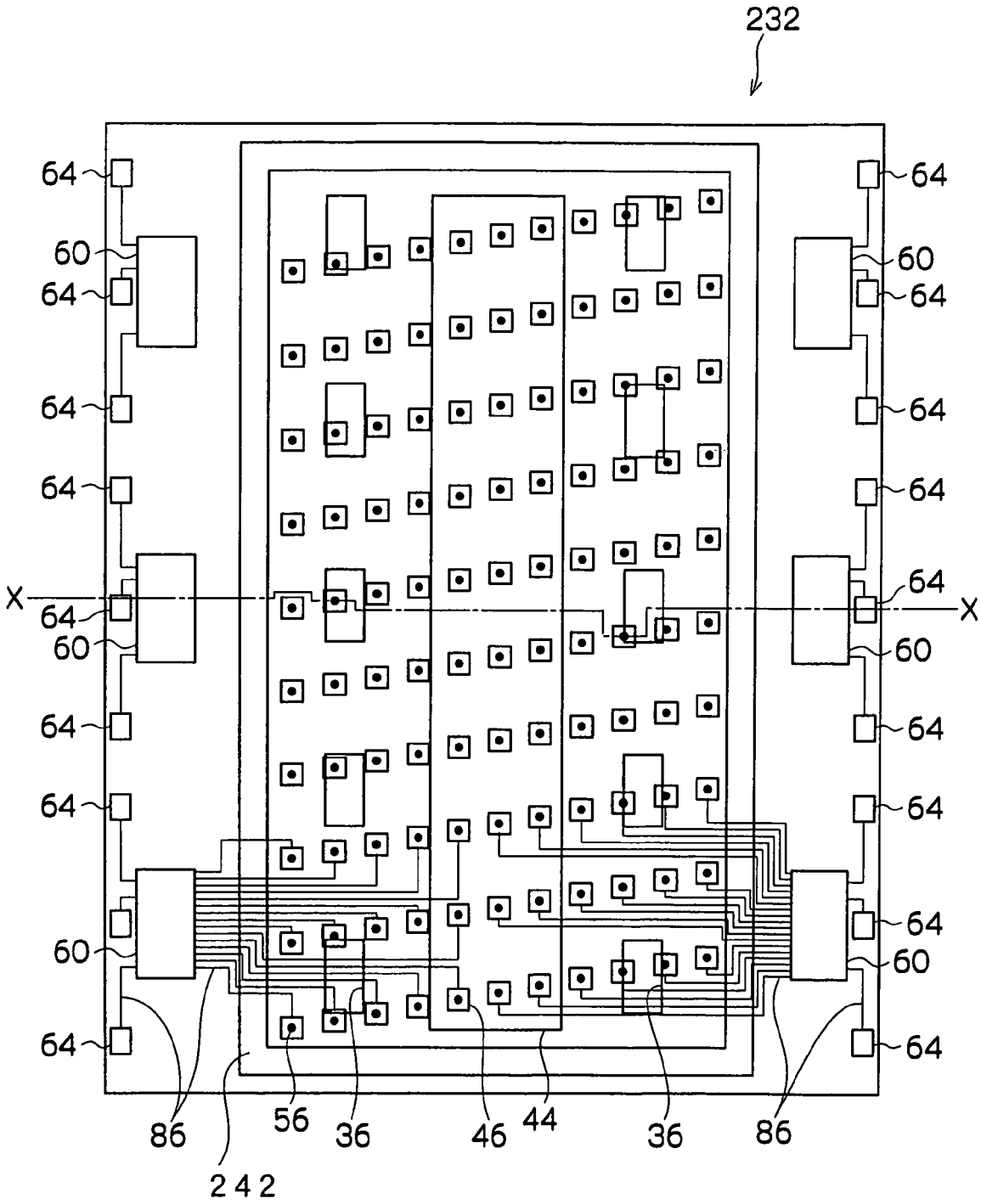
FIG. 24 is a schematic plan view showing the structure of an inkjet recording head of a third embodiment of the present invention.
Figure 25:
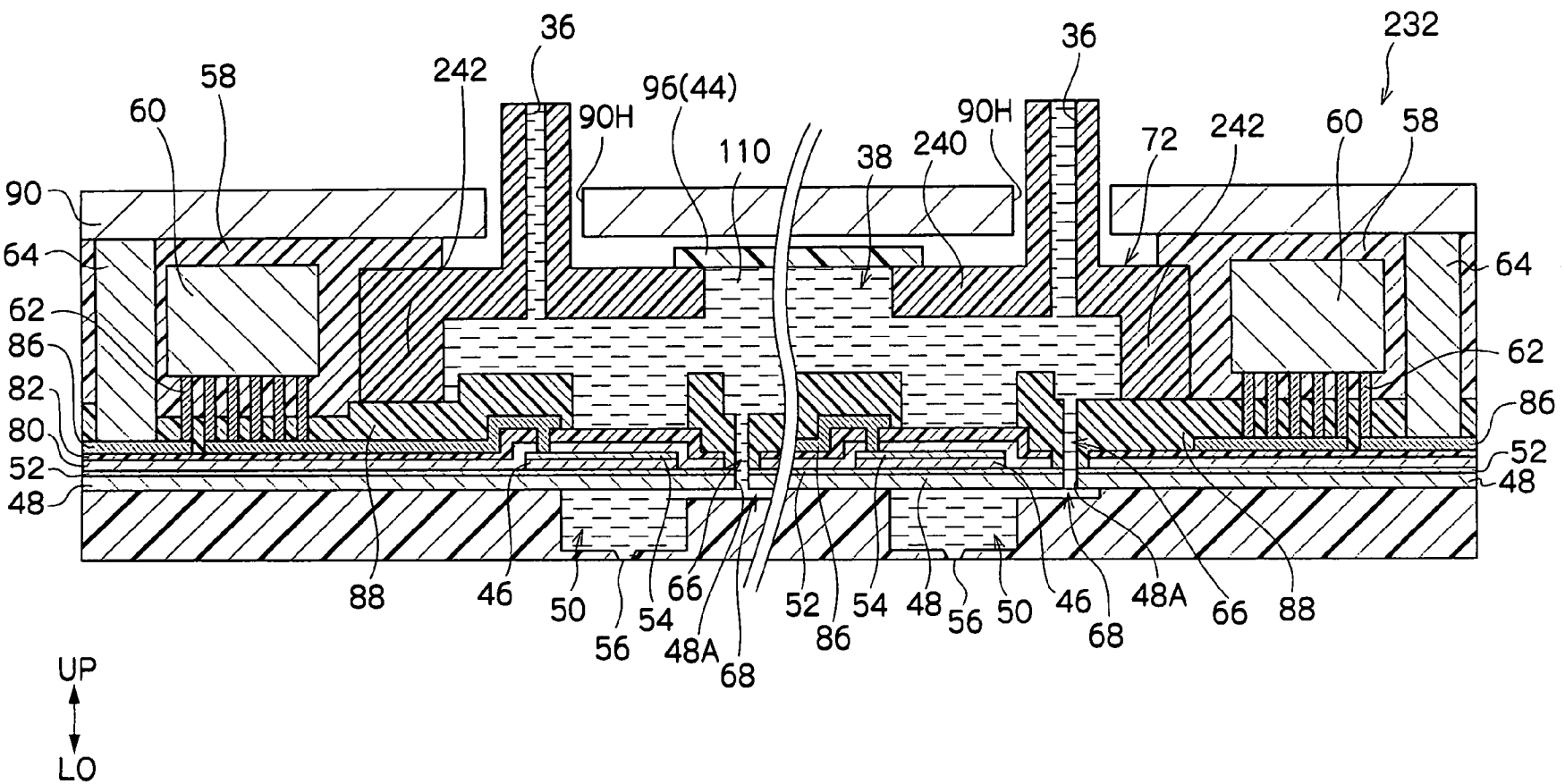
FIG. 25 is a schematic sectional view taken along line X-X of FIG. 24.

Next, an inkjet recording head 232 of a third embodiment, and the method of manufacture thereof, will be described. Note that the same structural elements as those of the inkjet recording head 32 of the first embodiment are denoted by the same reference numerals, and detailed description thereof is omitted. FIG. 24 is a schematic plan view showing the structure of the inkjet recording head 232, and FIG. 25 is a schematic sectional view taken along line X-X of FIG. 24.

The configuration and the volume of the ink pooling chamber 38 of the inkjet recording head 232 are regulated by a capping member 240, which is provided separately from the top plate member 90 and is disposed parallel to the top plate member 90, and a partitioning wall member 242 which is formed integrally with the capping member 240. Plural ink supplying ports 36 are formed in lines at predetermined places of the capping member 240. Ink can be supplied to the ink pooling chamber 38 without the need for a new member for supplying ink.

The capping member 240 and the partitioning wall member 242 are molded integrally of resin, and can maintain the ink sealing ability of the ink pooling chamber 38 good.

Next, the method of manufacturing the inkjet recording head 232 of the third embodiment will be described. Note that, in the following description, in the same way as in the first embodiment, description will be given by using a printed wiring board (a PWB substrate) as an example of the top plate member 90.

Figure 27:
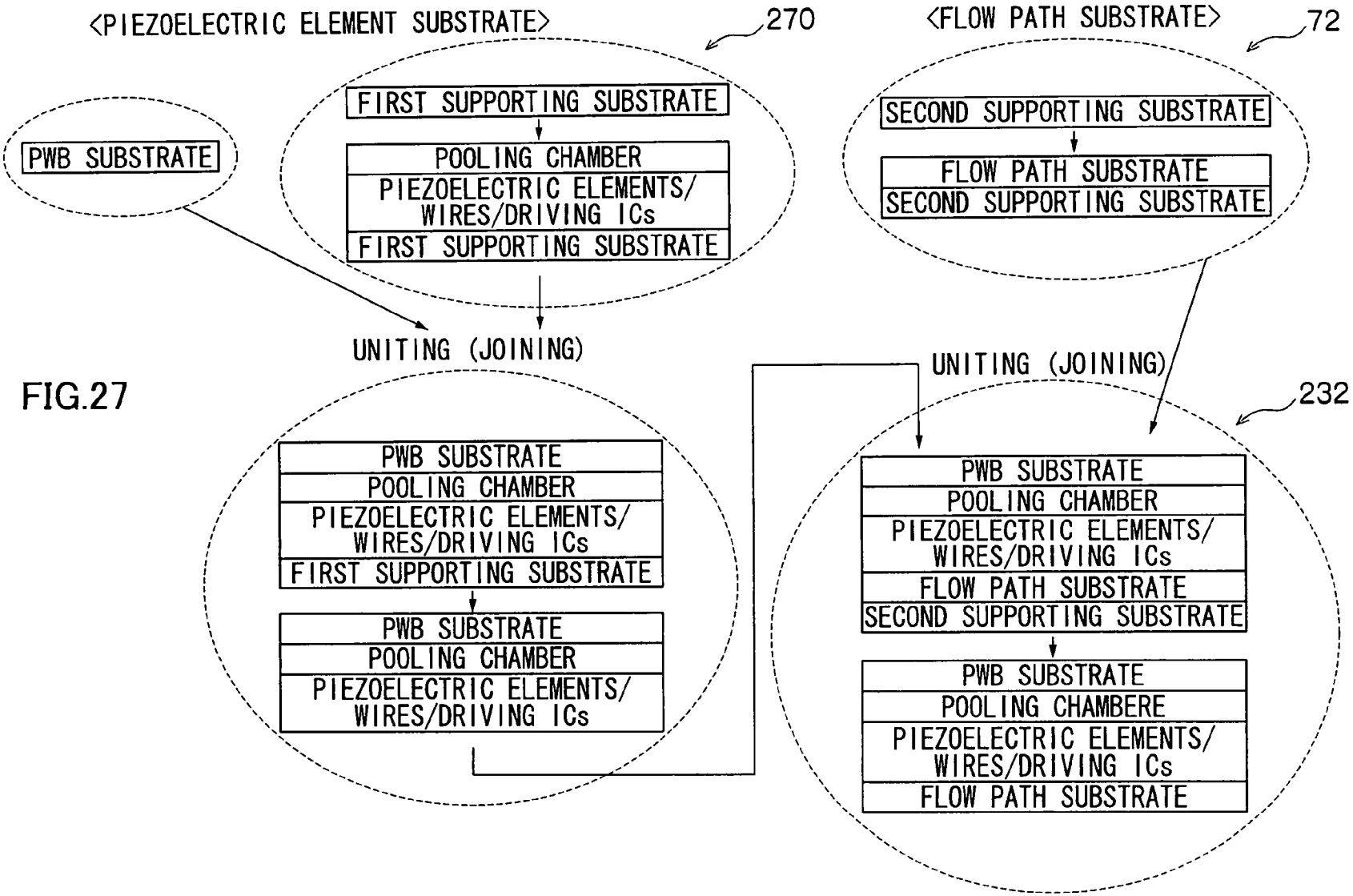
FIG. 27 is a diagram for explaining the overall processes of manufacturing the inkjet recording head of the third embodiment of the present invention.

As shown in FIG. 27, in the same way as in the first embodiment, the inkjet recording head 232 is manufactured by fabricating a piezoelectric element substrate 270 and the flow path substrate 72 separately, and uniting (joining) the two together. The top plate member 90 (the PWB substrate) is united (joined) to the piezoelectric element substrate 270 before the flow path substrate 72.

Figures 28A, 28B, 28C, 28D, 28E, 28F:
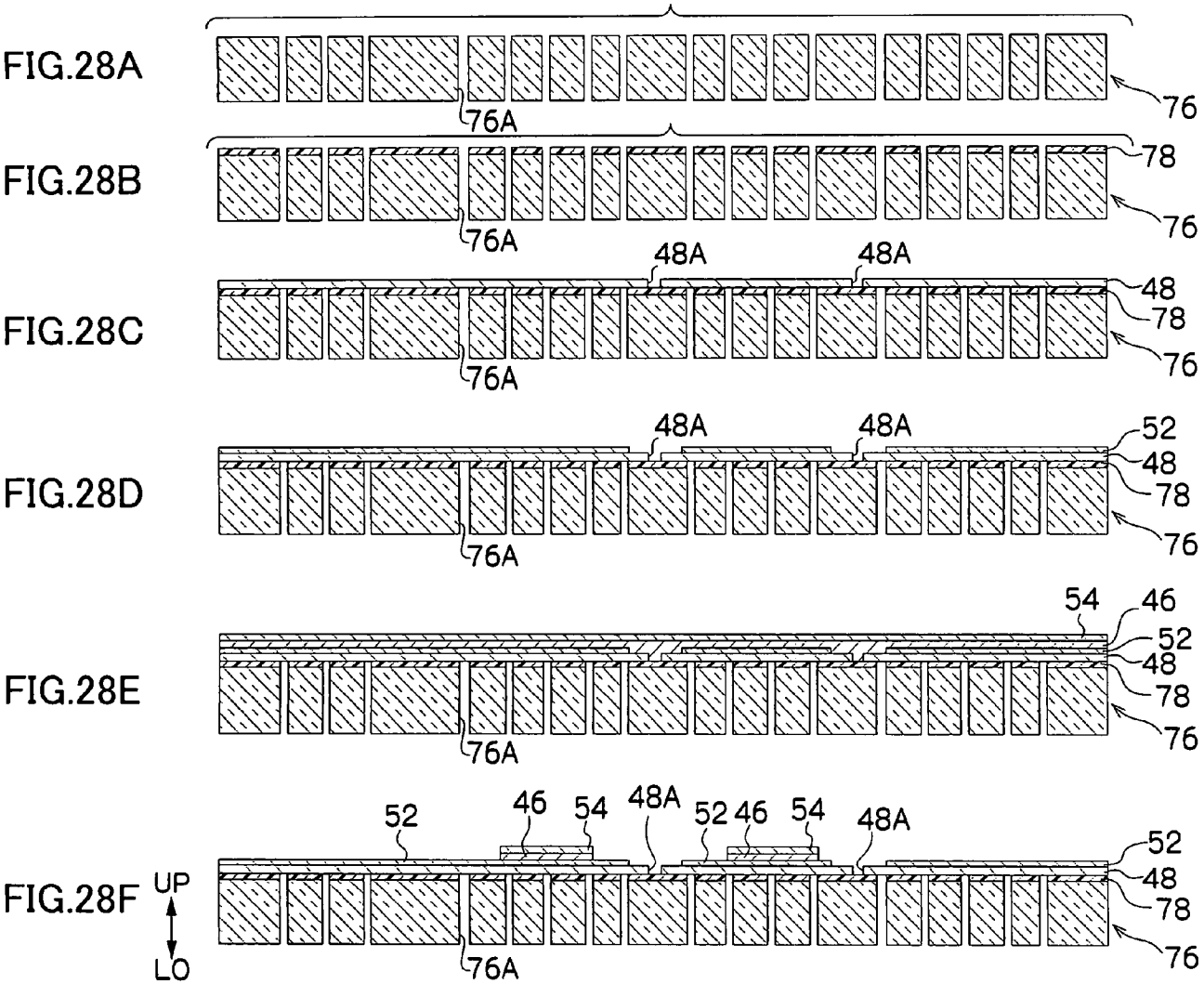
FIGS. 28A through 28L are diagrams explaining processes of manufacturing a piezoelectric element substrate relating to the third embodiment of the present invention.

As shown in FIG. 28A, first, the first supporting substrate 76, which is formed of glass and in which plural the through-holes 76A are formed, is prepared. As shown in FIG. 28B, the adhesive 78 is applied to the top surface (the obverse) of the first supporting substrate 76, and, as shown in FIG. 28C, the vibrating plate 48 is adhered on the top surface thereof.

Next, as shown in FIG. 28D, the lower electrode 52, which is layered on the top surface of the vibrating plate 48, is patterned. Then, as shown in FIG. 28E, a PZT film, which is the material of the piezoelectric elements 46, and the upper electrodes 54 are layered in that order by sputtering on the top surface of the lower electrode 52. As shown in FIG. 28F, the piezoelectric elements 46 (the PZT film) and the upper electrodes 54 are patterned.

Figures 28G, 28H, 28I, 28J:
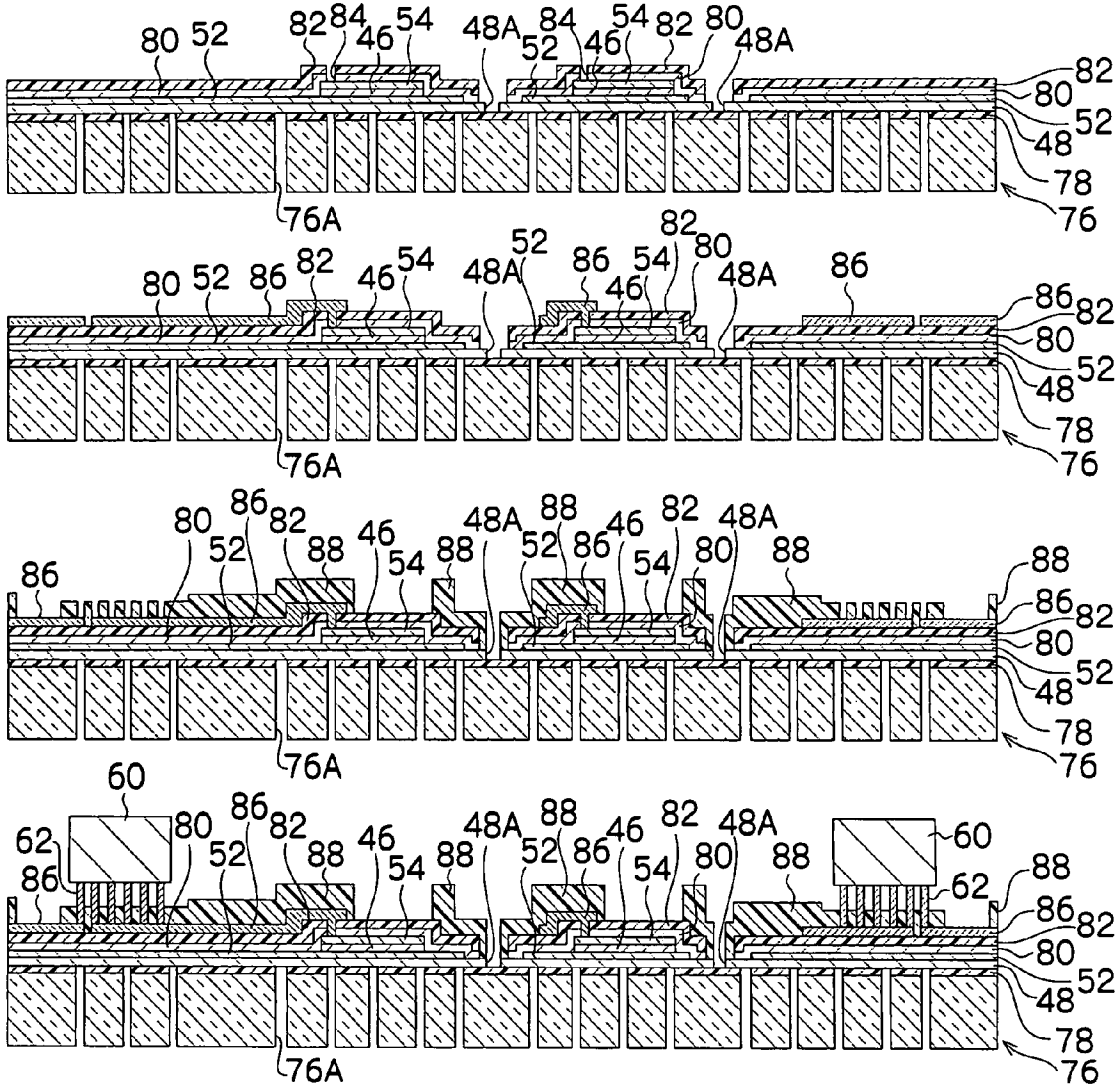

Thereafter, as shown in FIG. 28G, the low water permeable insulating film ($SiO_x$ film) 80 is layered on the top surfaces of the lower electrode 52 and the upper electrodes 54 which are exposed at the top surface, and the resin film 82 is layered on the top surface of this low water permeable insulating film ($SiO_x$ film) 80. By patterning these, the openings 84 (contact holes) for connecting the piezoelectric elements 46 and the metal wires 86 are formed.

Next, as shown in FIG. 28H, a metal film is layered on the top surfaces of the resin film 82 and the upper electrodes 54 within the openings 84, and the metal wires 86 are patterned.

Then, as shown in FIG. 28I, the resin protective film 88 is layered on the top surfaces of the metal wires 86 and the resin film 82, and is patterned.

Next, as shown in FIG. 28J, the driving ICs 60 are flip-chip mounted on the metal wires 86 via the bumps 62. Namely, in the second embodiment, the photosensitive resin which is to become the partitioning wall member 242 is patterned on the resin protective film 88. However, in the third embodiment, the driving ICs 60 are mounted without carrying out this step.

Figure 28K:
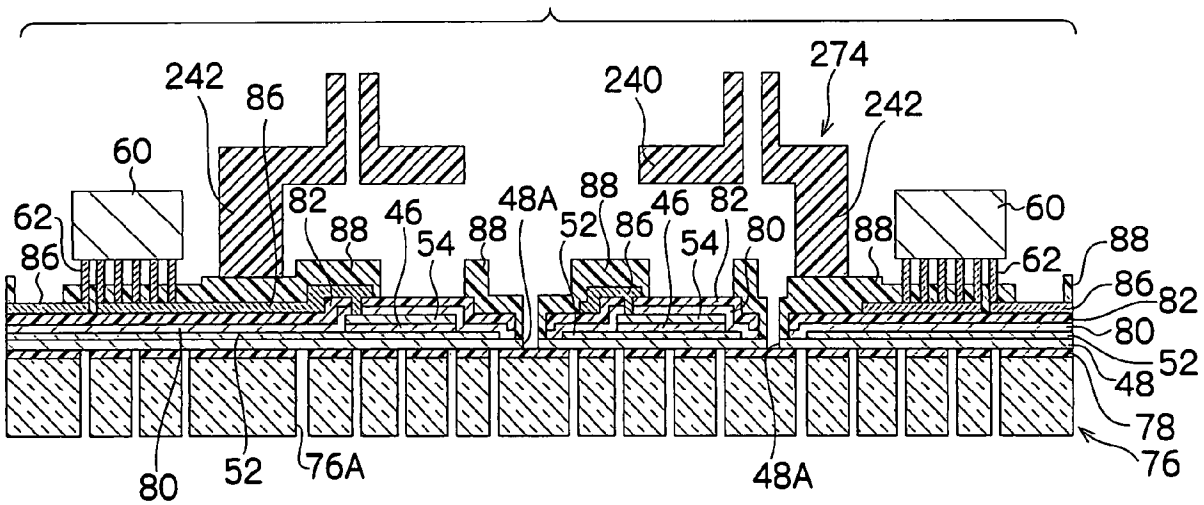

Subsequently, as shown in FIG. 28K, a capping/partitioning plate 274 is joined to a predetermined position of the resin protective film 88. The capping/partitioning plate 274 has a configuration in which the capping member 240 and the partitioning wall member 242 shown in FIG. 25 are integral. The ink pooling chamber 38 is substantially structured by joining the capping/partitioning plate 274 to the resin protective film 88 by, for example, thermocompression bonding or the like. Note that the tubular ink supplying ports 36, which are for supplying the ink to the ink pooling chamber 38, are formed in advance in the capping/partitioning plate 274.

Figure 28L:
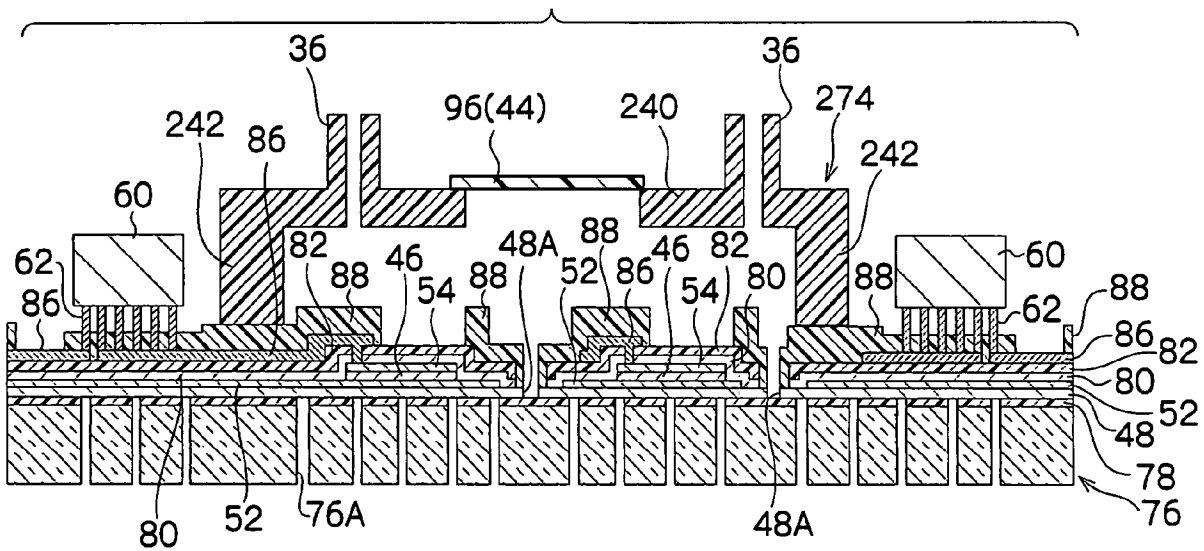

Then, as shown in FIG. 28L, the photosensitive dry film 96 is affixed to the opening portion of the capping member 240. The air damper 44 shown in FIG. 25 is provided by this photosensitive dry film 96.

In this way, the piezoelectric element substrate 270 is manufactured, and the PWB substrate which is the top plate member 90 is united (joined) to this piezoelectric element substrate 270.

Because the top plate member 90 can be manufactured in the same way as in the first embodiment, description of the manufacturing processes thereof is omitted.

Figure 29A:
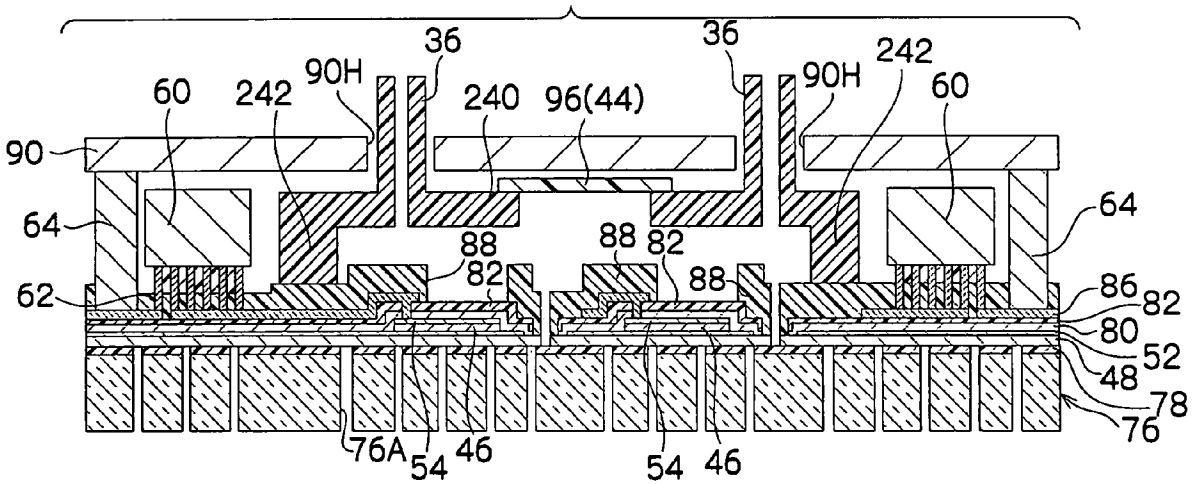
FIGS. 29A through 29D are diagrams explaining processes of joining a top plate member to the piezoelectric element substrate relating to the third embodiment of the present invention.

When the top plate member 90 is completed, as shown in FIG. 29A, the top plate member 90 is placed on the piezoelectric element substrate 270, and the both are united (joined) together by thermocompression bonding. Namely, the bumps 64 are joined to the metal wires 86.

At this time, the heights of the bumps 64 are higher than the combined thicknesses of the capping member 240, the partitioning wall member 242, and the photosensitive dry film 96. Therefore, the bumps 64 are automatically joined to the metal wires 86.

Figure 26:
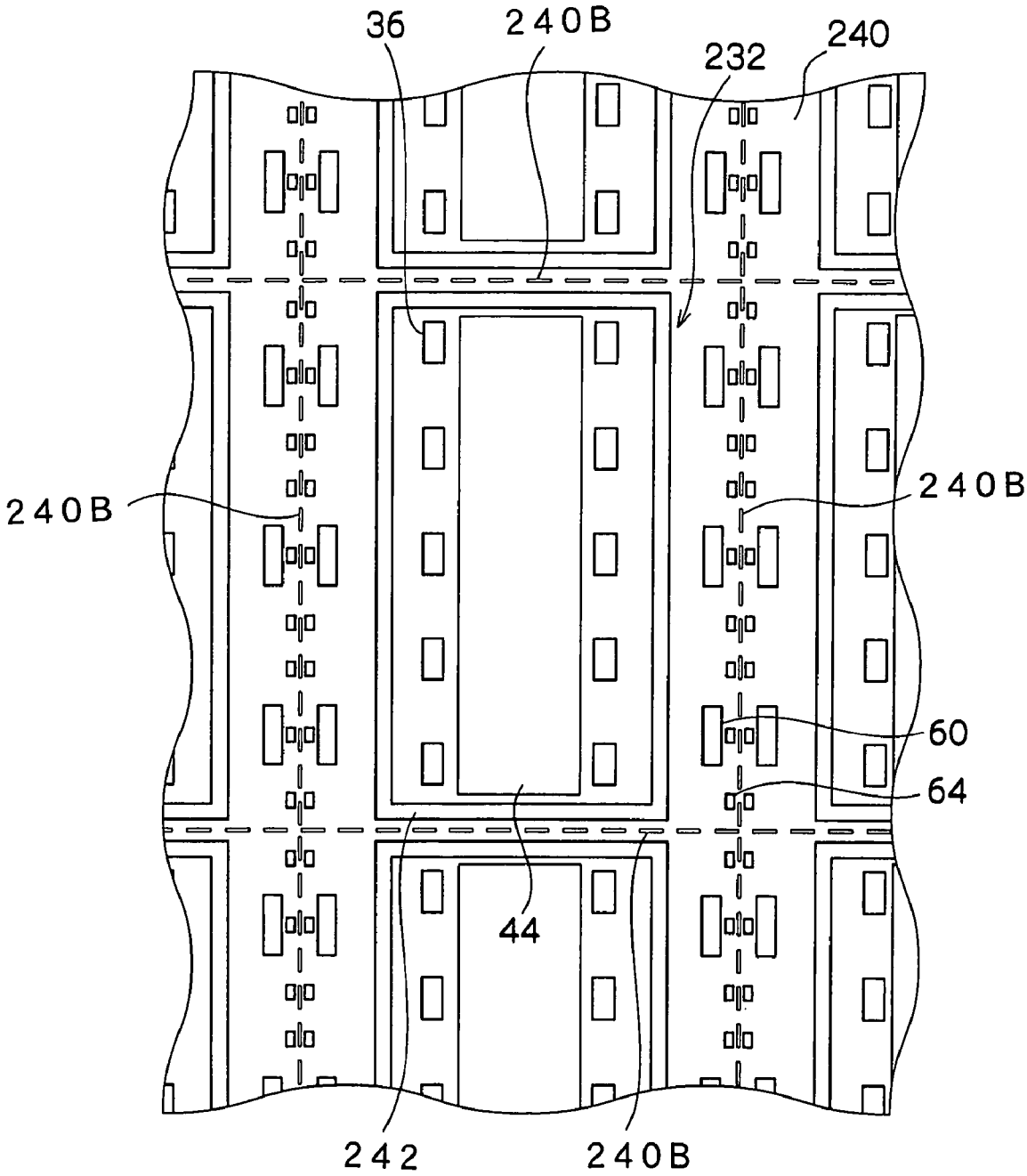
FIG. 26 is a schematic plan view showing a top plate before being cut as the inkjet recording heads relating to the third embodiment of the present invention.
Figure 29B:
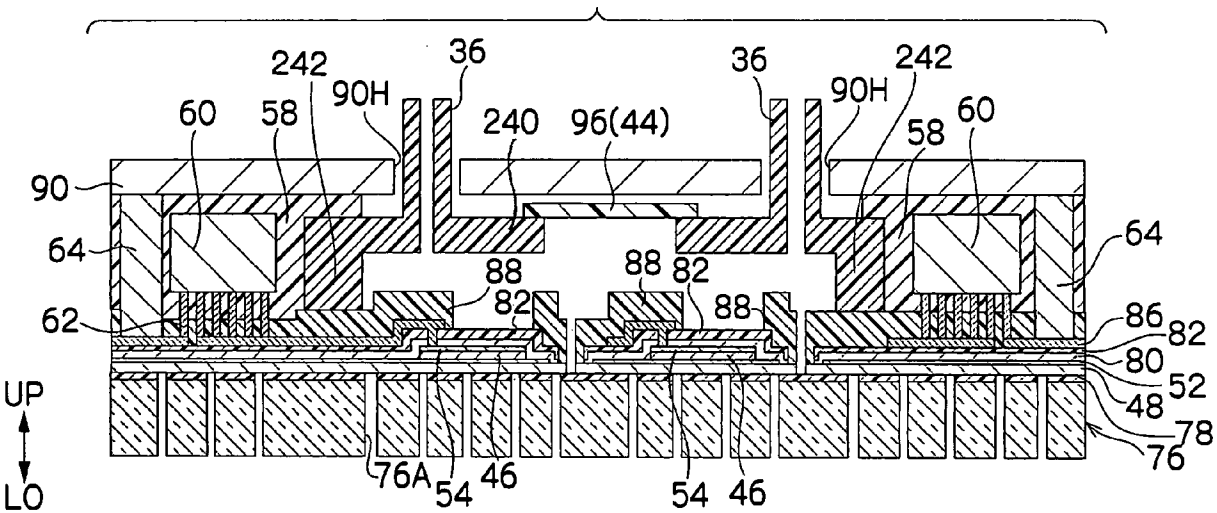

When the joining of the partitioning wall member 242 and the bumps 64 is completed, as shown in FIG. 29B, the resin material 58 for sealing (e.g., an epoxy resin) is injected-in at the driving ICs 60. Namely, the resin material 58 is made to flow-in from the injection openings 240B (see FIG. 26) which are formed in the top plate member 90.

Figure 29C:
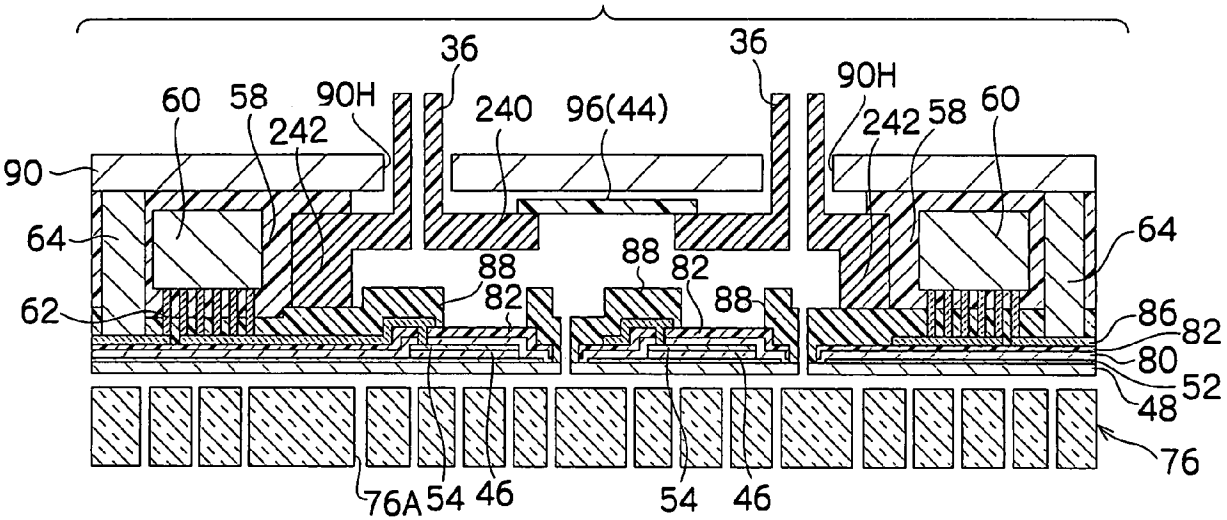
Figure 29D:
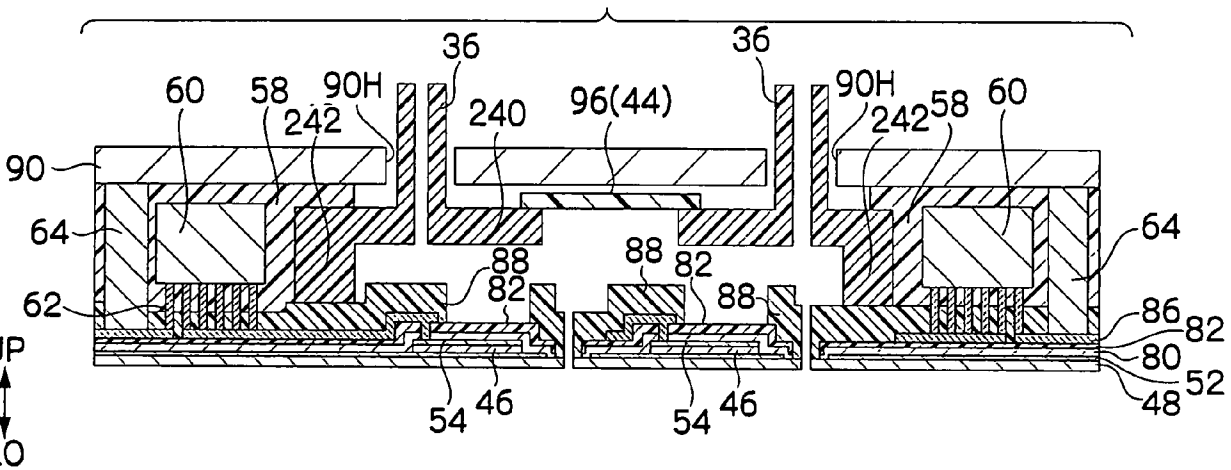

Next, as shown in FIG. 29C, an adhesive peeling solution is injected-in from the through-holes 76A of the first supporting substrate 76, and the first supporting substrate 76 is peeled-off from the piezoelectric element substrate 270. In this way, as shown in FIG. 29D, the piezoelectric element substrate 270, with which the top plate member 90 is united (joined), is completed. Then, from this state, the top plate member 90 becomes the supporting body of the piezoelectric element substrate 270.

Because the flow path substrate 72 can be manufactured in the same way as in the first embodiment, description of the manufacturing processes thereof is omitted.

Figure 30A:
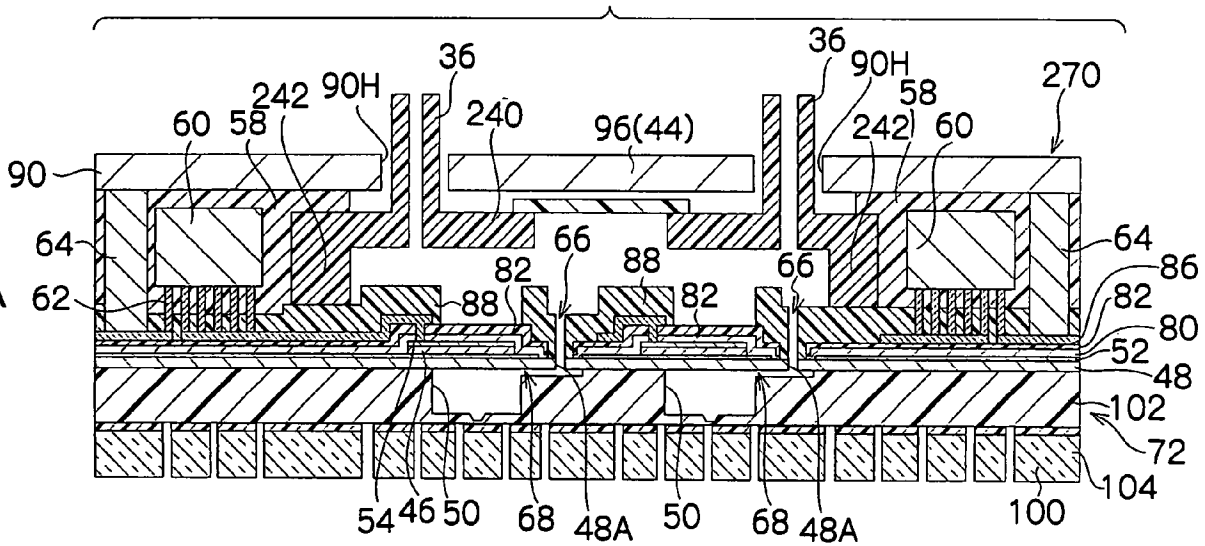
FIGS. 30A through 30E are diagrams explaining processes of joining a flow path substrate to the piezoelectric element substrate relating to the third embodiment of the present invention.

When the flow path substrate 72 is completed, as shown in FIG. 30A, the piezoelectric element substrate 270 and the flow path substrate 72 are united (joined) together by thermocompression bonding.

Figure 30B:
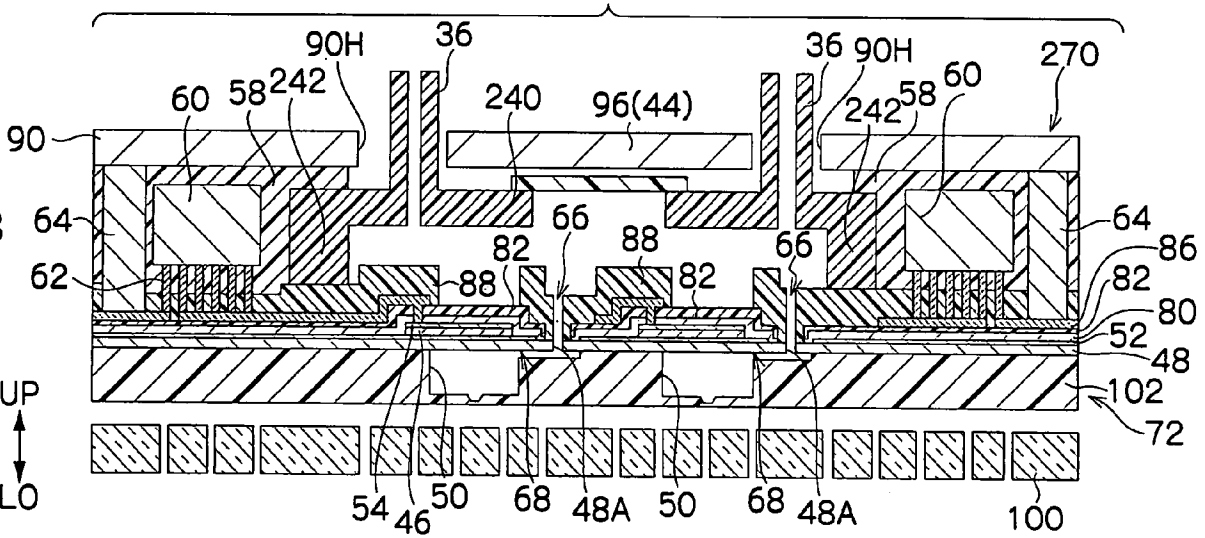

Next, as shown in FIG. 30B, an adhesive peeling solution is injected-in from the through-holes 100A of the second supporting substrate 100, and the second supporting substrate 100 is peeled-off from the flow path substrate 72.

Figure 30C:
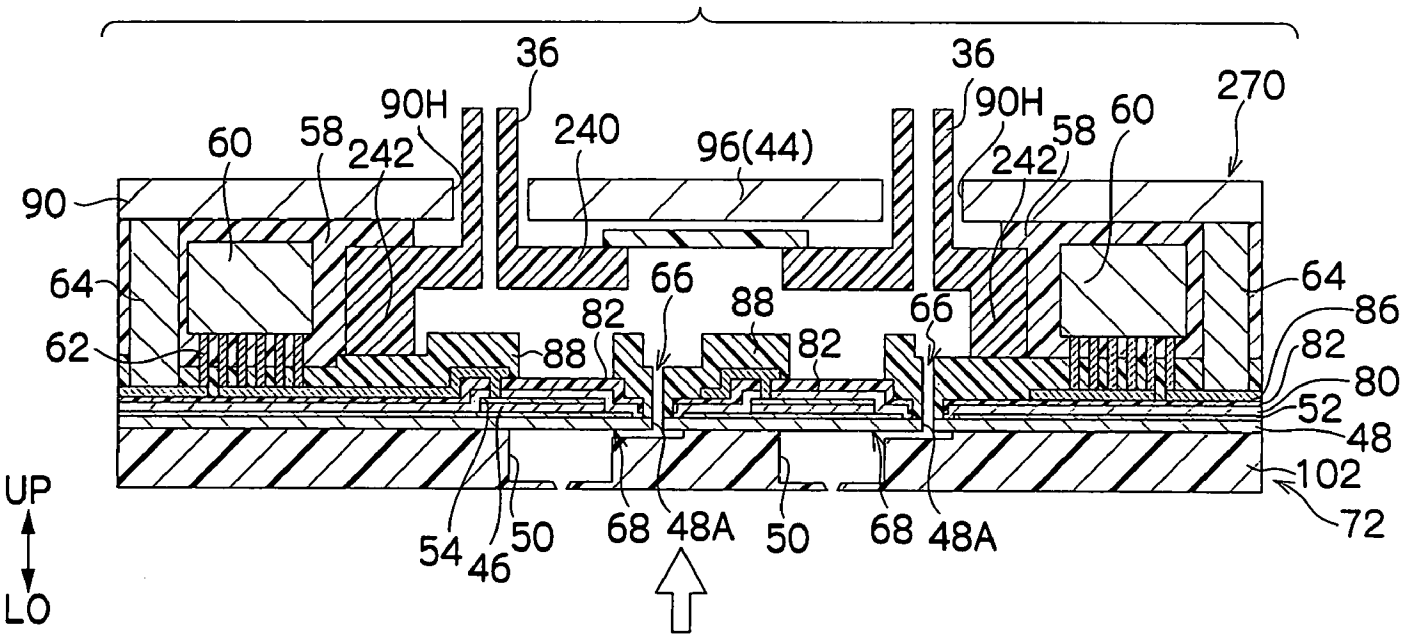
Figure 30D:
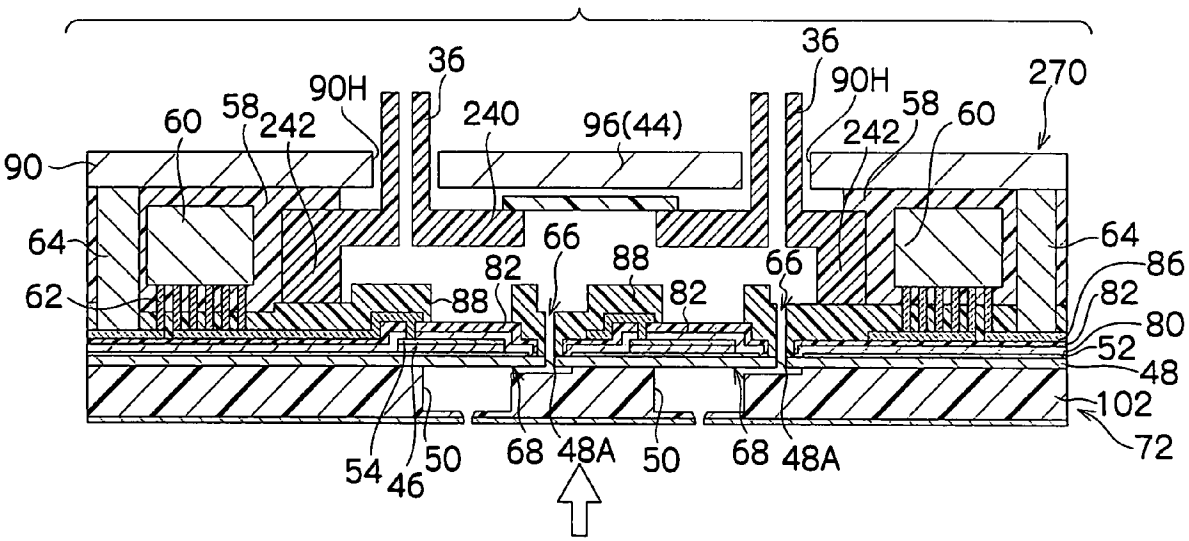
Figure 30E:
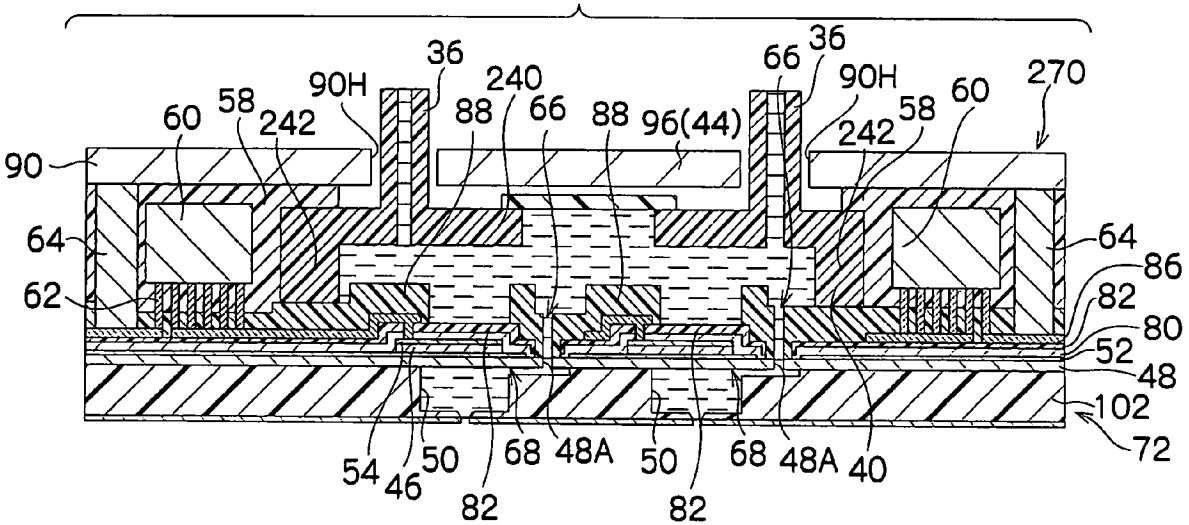

Thereafter, as shown in FIG. 30C, the surface from which the second supporting substrate 100 has been peeled-off is subjected to polishing processing using an abrasive whose main component is alumina, or to RIE processing using oxygen plasma. In this way, the surface layer is removed, and the nozzles 56 are opened. Then, as shown in FIG. 30D, by applying the fluorine material 108 (e.g., Cytop manufactured by Asahi Glass Co., Ltd.), which serves as a water repellant, onto the bottom surface where the nozzles 56 are open, the inkjet recording head 232 is completed. As shown in FIG. 30E, the ink 110 can be filled into the ink pooling chamber 38 and the pressure chambers 50.

Figure 31:
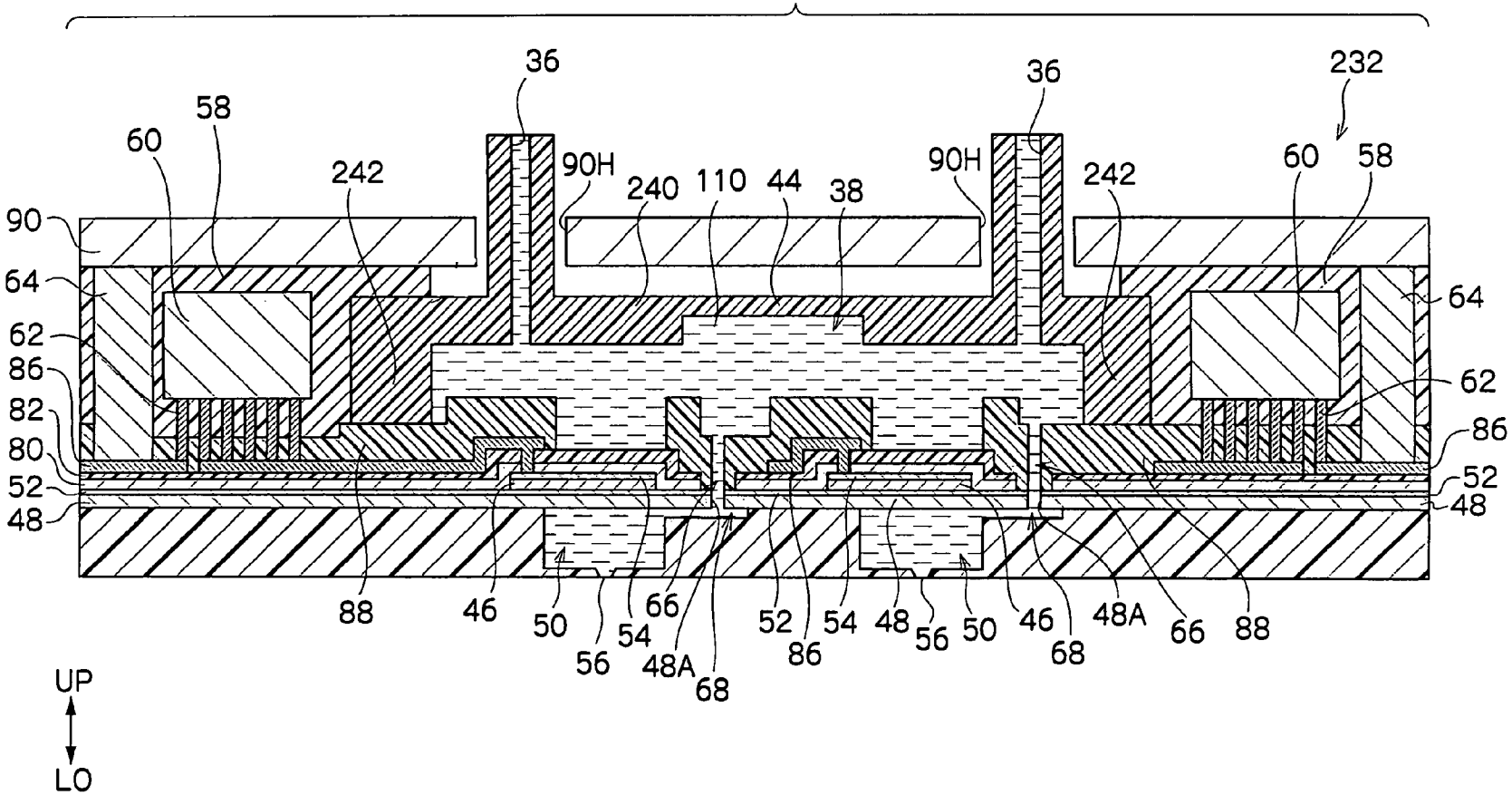
FIG. 31 is an explanatory diagram showing an inkjet recording head having a different air damper arrangement in the third embodiment of the present invention.
Figure 32:
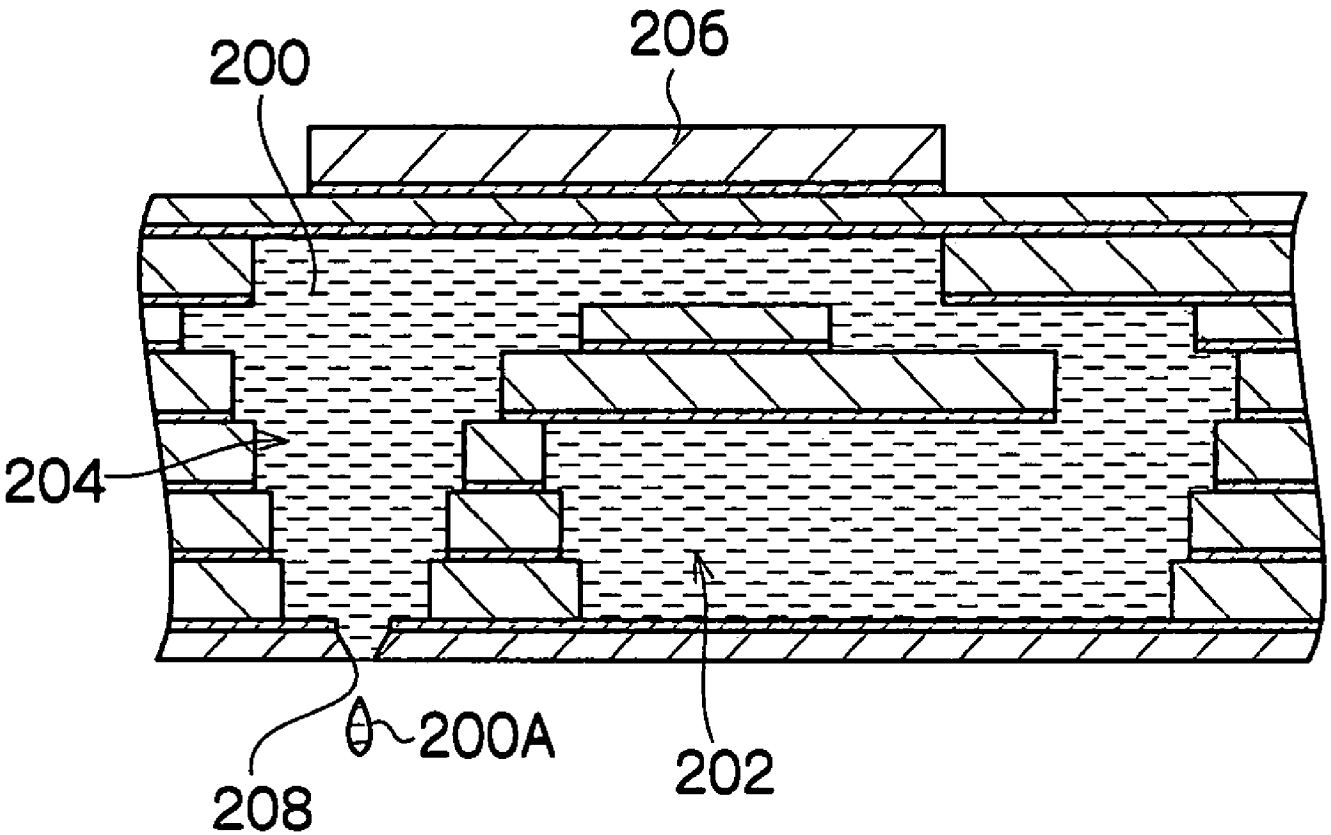
FIG.32 RELATED ART
FIG. 32 is a schematic sectional view showing the structure of a conventional inkjet recording head.
Figure 33:
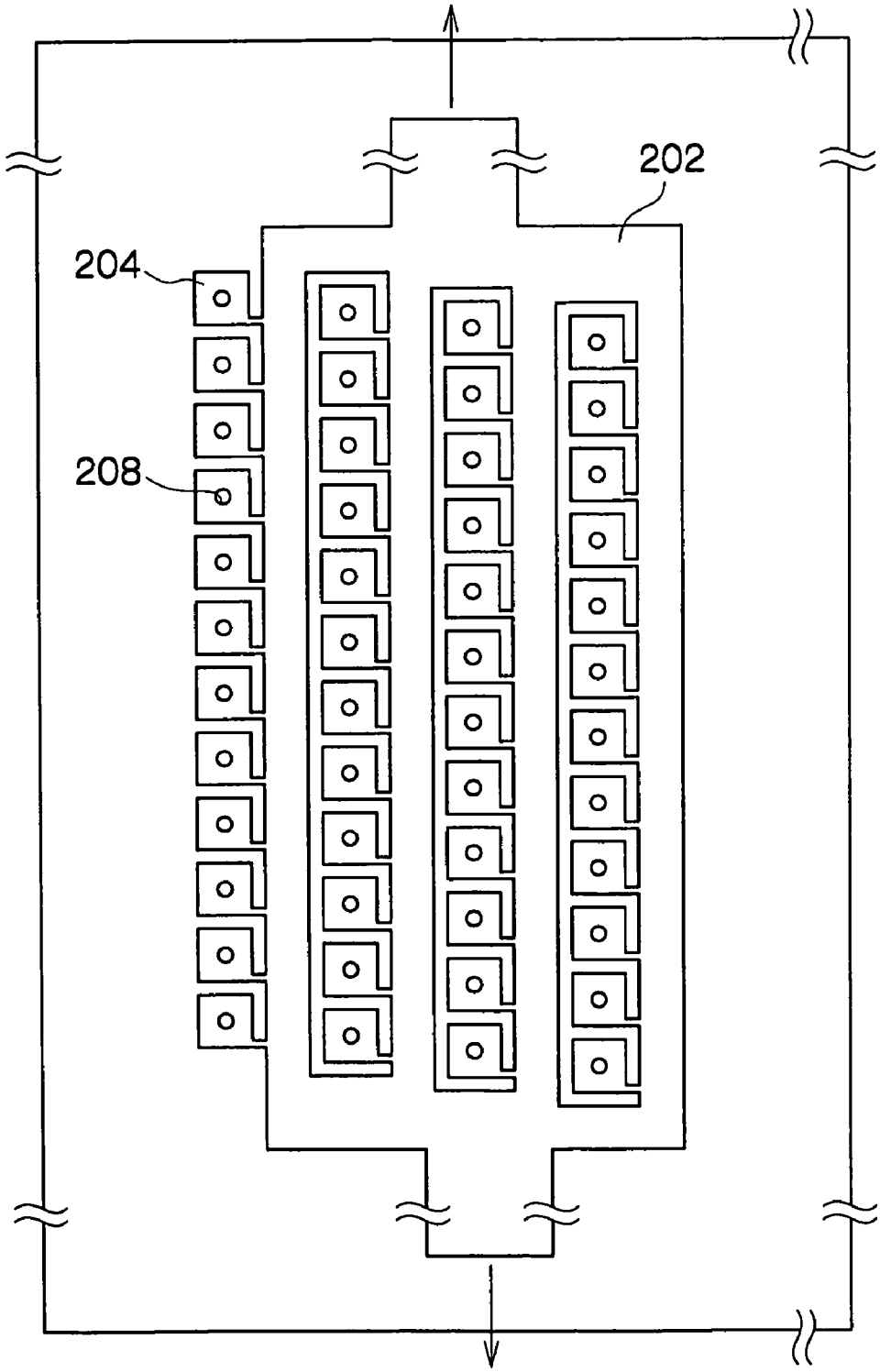
FIG.33 RELATED ART
FIG. 33 is a schematic plan view showing the structure of the conventional inkjet recording head.
Figure 34A:
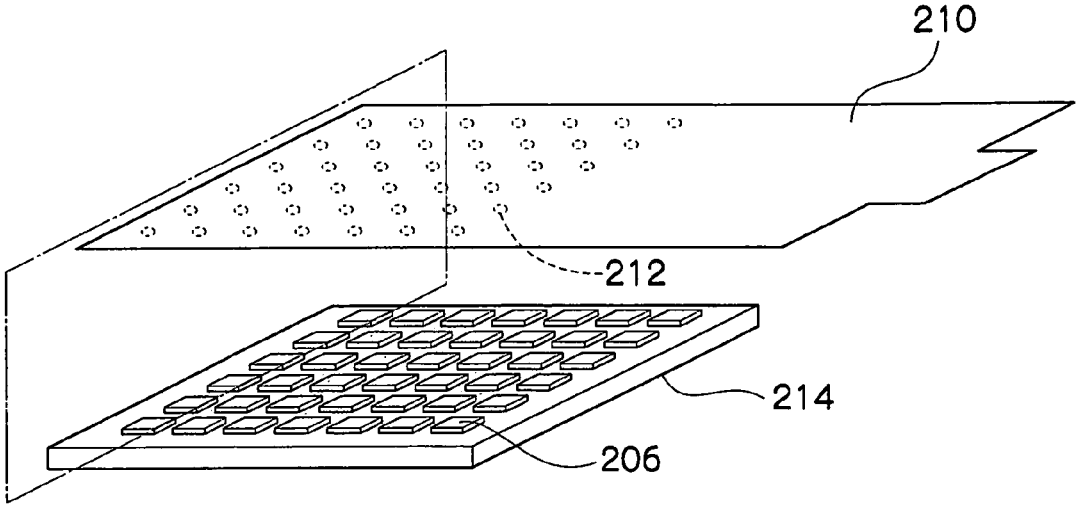
FIG.34A RELATED ART
FIGS. 34A and 34B are schematic perspective views showing the structure of the conventional inkjet recording head.
Figure 34B:
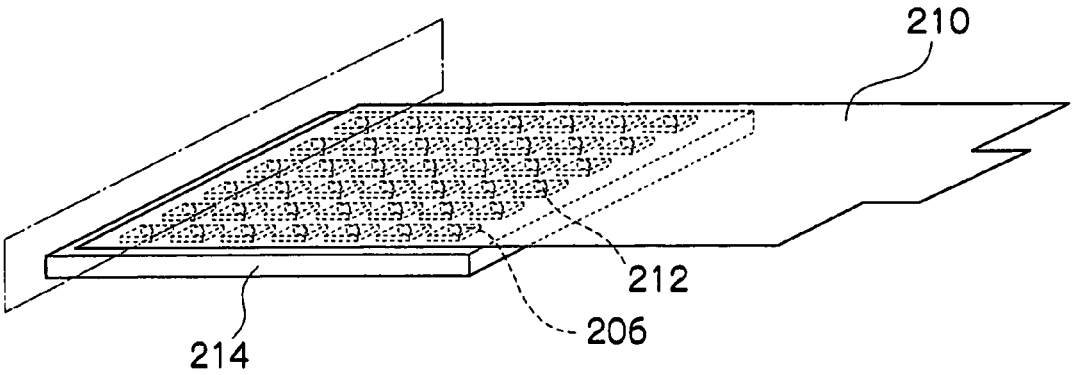
FIG.34B RELATED ART

Note that the air damper 44 is not limited to the structure in which the photosensitive dry film 96 is affixed so as to cover the opening portion of the capping member 240. For example, as shown in FIG. 31, by making the thickness of the capping member 240 thin locally, the air damper 44 can be formed integrally with the capping member 240.

An inkjet recording device provided with the inkjet recording head 232 of the third embodiment, which is manufactured as described above, carries out printing processing (image recording) onto the recording sheet P in the same way as the inkjet recording device 10 provided with the inkjet recording head 32 of the first embodiment, and has similar operation and effects as the first embodiment.

In particular, in the third embodiment, because the capping member 240 and the partitioning wall member 242, which structure the ink pooling chamber 38, are formed of an integrally-molded resin, the ink pooling chamber 38 can be structured inexpensively, and the sealability (ink sealability) can be maintained good.

In the above description, the piezoelectric element substrate 70 and the flow path substrate 72, which structure the inkjet recording heads 32, 132, 232, are manufactured respectively on the supporting substrates 76, 100 which are always hard. In these manufacturing processes, a manufacturing method is used in which the supporting substrates 76, 100 are removed at the point in time when they become unnecessary. Therefore, the inkjet recording heads 32, 132, 232 are structures which are extremely easy to manufacture. Note that the rigidity of the manufactured (completed) inkjet recording head 32 is ensured, because the inkjet recording head 32 is supported by the top plate member 90 (the top plate member 90 is used as a supporting body).

Moreover, in the inkjet recording devices of the above-described embodiments, the inkjet recording units 30 of the respective colors of black, yellow, magenta, and cyan are respectively installed in the carriage 12, and on the basis of image data, ink drops are selectively ejected from the inkjet recording heads 32 of these respective colors such that a full-color image is recorded on the recording sheet P. However, the inkjet recording in the present invention is not limited to the recording of characters or images onto the recording sheet P.

Namely, the recording medium is not limited to sheets, and the liquid which is ejected is not limited to ink. For example, the inkjet recording heads 32, 132, 232 relating to the present invention can be applied to liquid drop jetting devices in general which are used industrially, such as in fabricating color filters for displays by ejecting ink onto a high polymer film or glass, or in forming bumps for parts mounting by ejecting solder in a welded state onto a substrate, or the like.

Further, in the inkjet recording devices of the above-described embodiments, a Partial Width Array (PWA) having the main scanning mechanism 16 and the subscanning mechanism 18 is described as an example. However, the inkjet recording in the present invention is not limited to the same, and may be so-called Full Width Array (FWA) which corresponds to the width of the sheet. Because the present invention is effective in realizing a high-density nozzle array, it is ideal for FWA which necessitates single-pass printing.

What is claimed is:

1. An inkjet recording head comprising:

a nozzle ejecting ink drops;

a pressure chamber which communicates with the nozzle and in which ink is filled;

a vibrating plate structuring a portion of the pressure chamber;

an ink pooling chamber pooling ink to be supplied to the pressure chamber via an ink flow path;

a piezoelectric element displacing the vibrating plate;

a driving IC applying voltage to the piezoelectric element;

a wire supplying a signal to the driving IC; and a top plate member at which the wire is provided, wherein the ink pooling chamber is provided at a side of the vibrating plate opposite the side at which the pressure chamber is provided, and the driving IC is mounted on a piezoelectric element substrate which is formed so as to include the vibrating plate, and the ink pooling chamber includes a capping member, which is provided separately from the top plate member and which is a cap of the ink pooling chamber, and a partitioning wall member, which is formed of resin and is a partitioning wall of the ink pooling chamber.

2. The inkjet recording head of claim 1, wherein the capping member is formed of glass.

3. The inkjet recording head of claim 1, wherein the capping member is formed of resin.

4. The inkjet recording head of claim 1, wherein the capping member and the partitioning wall member are an integrally-molded resin member.

5. The inkjet recording head of claim 1, wherein an air damper, which mitigates pressure waves of the ink pooling chamber, is provided at the capping member.

6. The inkjet recording head of claim 1, wherein a bump for connection to the piezoelectric element substrate is provided at the top plate member.

7. The inkjet recording head of claim 1, wherein an ink supplying port for supplying ink into the ink pooling chamber is provided at the capping member.

8. The inkjet recording head of claim 7, wherein an insert-through hole, through which the ink supplying port is inserted, is formed in the top plate member.

9. The inkjet recording head of claim 1, wherein an insert-through hole, through which the ink supplying port is inserted, is formed in the top plate member.

10. The inkjet recording head of claim 1, wherein the nozzles are disposed in a form of a matrix.

11. The inkjet recording head of claim 1, wherein the driving IC is surface-mounted on the piezoelectric element substrate.

12. The inkjet recording head of claim 1, wherein the driving IC is disposed between the vibrating plate and the top plate member.

13. The inkjet recording head of claim 1, wherein a resin material is filled in a gap of a space where the driving IC is disposed, between the vibrating plate and the top plate member.

14. The inkjet recording head of claim 1, wherein a wire connecting the piezoelectric element and the driving IC is covered by a resin material.

15. The inkjet recording head of claim 1, wherein the wire is covered by being sandwiched by two resin layers whose coefficients of thermal expansion are substantially equivalent.

16. The inkjet recording head of claim 14, wherein the wire is covered by being sandwiched by two resin layers whose coefficients of thermal expansion are substantially equivalent.

17. An inkjet recording device comprising an inkjet recording head, the inkjet recording head including:

a nozzle ejecting ink drops;

a pressure chamber which communicates with the nozzle and in which ink is filled;

a vibrating plate structuring a portion of the pressure chamber;

an ink pooling chamber pooling ink to be supplied to the pressure chamber via an ink flow path;

a piezoelectric element displacing the vibrating plate;

a driving IC applying voltage to the piezoelectric element;

a wire supplying a signal to the driving IC; and a top plate member at which the wire is provided, wherein the ink pooling chamber is provided at a side of the vibrating plate opposite the side at which the pressure chamber is provided, and the driving IC is mounted on a piezoelectric element substrate which is formed so as to include the vibrating plate, and the ink pooling chamber includes a capping member, which is provided separately from the top plate member and which is a cap of the ink pooling chamber, and a partitioning wall member, which is formed of resin and is a partitioning wall of the ink pooling chamber.

18. The inkjet recording device of claim 17, wherein the capping member is formed of glass.

19. The inkjet recording device of claim 17, wherein the capping member is formed of resin.

20. The inkjet recording device of claim 17, wherein the capping member and the partitioning wall member are an integrally-molded resin member.

* * * * *